US010246871B2

(12) United States Patent
Pilz

(10) Patent No.: US 10,246,871 B2
(45) Date of Patent: Apr. 2, 2019

(54) FIRE-RATED JOINT SYSTEM

(71) Applicant: California Expanded Metal Products Company, City of Industry, CA (US)

(72) Inventor: Donald Anthony Pilz, Livermore, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 16/112,118

(22) Filed: Aug. 24, 2018

(65) Prior Publication Data

US 2018/0363293 A1 Dec. 20, 2018

Related U.S. Application Data

(63) Continuation of application No. 15/462,671, filed on Mar. 17, 2017, now Pat. No. 10,077,550, which is a continuation of application No. 15/285,440, filed on Oct. 4, 2016, now abandoned, which is a continuation-in-part of application No. 14/996,516, filed on Jan. 15, 2016, now Pat. No. 9,523,193, which is a continuation-in-part of application No. (Continued)

(51) Int. Cl.

| | |
|---|---|
| ***E04C 2/00*** | (2006.01) |
| ***E04B 1/94*** | (2006.01) |
| ***E04B 2/74*** | (2006.01) |

(52) U.S. Cl.

CPC ..... *E04B 1/948* (2013.01); *E04B 2/7411* (2013.01); *E04B 2/7457* (2013.01); *E04B 2002/7481* (2013.01)

(58) Field of Classification Search

CPC ..... E04B 2/825; E04B 2/7457; E04B 5/10; E04B 2002/7462; E04C 2003/0434; F16L 5/04

USPC ..... 52/232, 241, 481.1, 481.2, 483.1, 831, 52/846

See application file for complete search history.

(56) References Cited

U.S. PATENT DOCUMENTS

| | | | |
|---|---|---|---|
| 1,130,722 | A | 3/1915 | Fletcher |
| 1,563,651 | A | 12/1925 | Pomerantz |

(Continued)

FOREIGN PATENT DOCUMENTS

| | | |
|---|---|---|
| CA | 2234347 | 10/1999 |
| CA | 2697295 | 12/2013 |

(Continued)

OTHER PUBLICATIONS

U.S. Appl. No. 15/285,440, filed Oct. 4, 2016, Pilz.

(Continued)

*Primary Examiner* — Joshua J Michener
*Assistant Examiner* — James J Buckle, Jr.
(74) *Attorney, Agent, or Firm* — Knobbe Martens Olson & Bear LLP

(57) ABSTRACT

A fire-rated angle piece and wall assemblies or other assemblies that incorporate the fire-rated angle piece, in which the angle piece can include an intumescent or other fire-resistant material strip. The angle can be attached adjacent to a corner of a framing member, such as metal tracks, headers, header tracks, sill plates, bottom tracks, metal studs, wood studs or wall partitions, and placed between the framing member and a wall board member at a perimeter of a wall assembly to create a fire block arrangement. A fire spray material can be applied over a portion of the angle piece.

20 Claims, 41 Drawing Sheets

Related U.S. Application Data

14/726,275, filed on May 29, 2015, now Pat. No. 9,458,628, which is a continuation of application No. 14/086,802, filed on Nov. 21, 2013, now Pat. No. 9,045,899, which is a continuation-in-part of application No. 13/560,805, filed on Jul. 27, 2012, now Pat. No. 8,595,999, which is a continuation-in-part of application No. 13/426,314, filed on Mar. 21, 2012, now Pat. No. 8,590,231.

(60) Provisional application No. 62/310,182, filed on Mar. 18, 2016, provisional application No. 62/104,613, filed on Jan. 16, 2015, provisional application No. 62/104,525, filed on Jan. 16, 2015, provisional application No. 61/589,188, filed on Jan. 20, 2012.

(56) References Cited

U.S. PATENT DOCUMENTS

| | | | |
|---|---|---|---|
| 2,105,771 | A | 1/1938 | Holdsworth |
| 2,218,426 | A | 10/1940 | Hulbert, Jr. |
| 2,683,927 | A | 7/1954 | Maronek |
| 2,733,786 | A | 2/1956 | Drake |
| 3,129,792 | A | 4/1964 | Gwynne |
| 3,271,920 | A | 9/1966 | Downing, Jr. |
| 3,309,826 | A | 3/1967 | Zinn |
| 3,324,615 | A | 6/1967 | Zinn |
| 3,355,852 | A | 12/1967 | Lally |
| 3,397,495 | A | 8/1968 | Thompson |
| 3,481,090 | A | 12/1969 | Lizee |
| 3,537,219 | A | 11/1970 | Navarre |
| 3,566,559 | A | 3/1971 | Dickson |
| 3,707,819 | A | 1/1973 | Calhoun et al. |
| 3,744,199 | A | 7/1973 | Navarre |
| 3,757,480 | A | 9/1973 | Young |
| 3,786,604 | A | 1/1974 | Kramer |
| 3,837,126 | A | 9/1974 | Voiturier et al. |
| 3,839,839 | A | 10/1974 | Tillisch et al. |
| 3,908,328 | A | 9/1975 | Nelsson |
| 3,934,066 | A | 1/1976 | Murch |
| 3,935,681 | A | 2/1976 | Voiturier et al. |
| 3,955,330 | A | 5/1976 | Wendt |
| 3,964,214 | A | 6/1976 | Wendt |
| 3,974,607 | A | 8/1976 | Balinski |
| 3,976,825 | A | 8/1976 | Anderberg |
| 4,011,704 | A | 3/1977 | O'Konski |
| 4,103,463 | A | 8/1978 | Dixon |
| 4,130,972 | A | 12/1978 | Varlonga |
| 4,139,664 | A | 2/1979 | Wenrick |
| 4,144,335 | A | 3/1979 | Edwards |
| 4,144,385 | A | 3/1979 | Downing |
| 4,152,878 | A | 5/1979 | Balinski |
| 4,164,107 | A | 8/1979 | Kraemling et al. |
| 4,178,728 | A | 12/1979 | Ortmanns et al. |
| 4,203,264 | A | 5/1980 | Kiefer et al. |
| 4,283,892 | A | 8/1981 | Brown |
| 4,318,253 | A | 3/1982 | Wedel |
| 4,329,820 | A | 5/1982 | Wendt |
| 4,361,994 | A | 12/1982 | Carver |
| 4,424,653 | A | 1/1984 | Heinen |
| 4,434,592 | A | 3/1984 | Reneault et al. |
| 4,437,274 | A | 3/1984 | Slocum et al. |
| 4,454,690 | A | 6/1984 | Dixon |
| 4,622,794 | A | 11/1986 | Geortner |
| 4,649,089 | A | 3/1987 | Thwaites |
| 4,672,785 | A | 6/1987 | Salvo |
| 4,709,517 | A | 12/1987 | Mitchell et al. |
| 4,711,183 | A | 12/1987 | Handler et al. |
| 4,723,385 | A | 2/1988 | Kallstrom |
| 4,756,945 | A | 7/1988 | Gibb |
| 4,761,927 | A | 8/1988 | O'Keeffe et al. |
| 4,787,767 | A | 11/1988 | Wendt |
| 4,805,364 | A | 2/1989 | Smolik |
| 4,825,610 | A | 5/1989 | Gasteiger |
| 4,845,904 | A | 7/1989 | Menchetti |
| 4,850,385 | A | 7/1989 | Harbeke |
| 4,854,096 | A | 8/1989 | Smolik |
| 4,885,884 | A | 12/1989 | Schilger |
| 4,918,761 | A | 4/1990 | Harbeke |
| 4,930,276 | A | 6/1990 | Bawa et al. |
| 5,010,702 | A | 4/1991 | Daw et al. |
| 5,094,780 | A | 3/1992 | von Bonin |
| 5,103,589 | A | 4/1992 | Crawford |
| 5,125,203 | A | 6/1992 | Daw |
| 5,127,203 | A | 7/1992 | Paquette |
| 5,127,760 | A | 7/1992 | Brady |
| 5,146,723 | A | 9/1992 | Greenwood et al. |
| 5,155,957 | A | 10/1992 | Robertson et al. |
| 5,157,883 | A | 10/1992 | Meyer |
| 5,167,876 | A | 12/1992 | Lem |
| 5,173,515 | A | 12/1992 | von Bonin et al. |
| 5,203,132 | A | 4/1993 | Smolik |
| 5,212,914 | A | 5/1993 | Martin et al. |
| 5,222,335 | A | 6/1993 | Petrecca |
| 5,244,709 | A | 9/1993 | Vanderstukken |
| 5,285,615 | A | 2/1994 | Gilmour |
| 5,315,804 | A | 5/1994 | Attalla |
| 5,325,651 | A | 7/1994 | Meyer et al. |
| 5,347,780 | A | 9/1994 | Richards et al. |
| 5,367,850 | A | 11/1994 | Nicholas |
| 5,374,036 | A | 12/1994 | Rogers et al. |
| 5,376,429 | A | 12/1994 | McGroarty |
| 5,390,458 | A | 2/1995 | Menchetti |
| 5,390,465 | A | 2/1995 | Rajecki |
| 5,394,665 | A | 3/1995 | Johnson |
| 5,412,919 | A | 5/1995 | Pellock et al. |
| 5,452,551 | A | 9/1995 | Charland et al. |
| 5,454,203 | A | 10/1995 | Turner |
| 5,456,050 | A | 10/1995 | Ward |
| 5,471,791 | A | 12/1995 | Keller |
| 5,471,805 | A | 12/1995 | Becker |
| 5,477,652 | A | 12/1995 | Torrey et al. |
| 5,552,185 | A | 9/1996 | De Keyser |
| 5,592,796 | A | 1/1997 | Landers |
| 5,604,024 | A | 2/1997 | von Bonin |
| 5,644,877 | A | 7/1997 | Wood |
| 5,687,538 | A | 11/1997 | Frobosilo et al. |
| 5,689,922 | A | 11/1997 | Daudet |
| 5,709,821 | A | 1/1998 | von Bonin et al. |
| 5,724,784 | A | 3/1998 | Menchetti |
| 5,735,100 | A | 4/1998 | Campbell |
| 5,740,643 | A | 4/1998 | Huntley |
| 5,755,066 | A | 5/1998 | Becker |
| 5,765,332 | A | 6/1998 | Landin et al. |
| 5,787,651 | A | 8/1998 | Horn et al. |
| 5,797,233 | A | 8/1998 | Hascall |
| 5,806,261 | A | 9/1998 | Huebner et al. |
| 5,822,935 | A | 10/1998 | Mitchell et al. |
| 5,870,866 | A | 2/1999 | Herndon |
| 5,913,788 | A | 6/1999 | Herren |
| 5,921,041 | A | 7/1999 | Egri, II |
| 5,927,041 | A | 7/1999 | Sedlmeier et al. |
| 5,930,963 | A | 8/1999 | Nichols |
| 5,930,968 | A | 8/1999 | Pullman |
| 5,950,385 | A | 9/1999 | Herren |
| 5,968,615 | A | 10/1999 | Schlappa |
| 5,968,669 | A | 10/1999 | Liu et al. |
| 5,974,750 | A | 11/1999 | Landin et al. |
| 5,974,753 | A | 11/1999 | Hsu |
| 6,023,898 | A | 2/2000 | Josey |
| 6,058,668 | A | 5/2000 | Herren |
| 6,110,559 | A | 8/2000 | De Keyser |
| 6,116,404 | A | 9/2000 | Heuft et al. |
| 6,128,874 | A | 10/2000 | Olson et al. |
| 6,131,352 | A | 10/2000 | Barnes et al. |
| 6,151,858 | A | 11/2000 | Ruiz et al. |
| 6,176,053 | B1 | 1/2001 | St. Germain |
| 6,182,407 | B1 | 2/2001 | Turpin et al. |
| 6,189,277 | B1 | 2/2001 | Boscamp |
| 6,207,077 | B1 | 3/2001 | Burnell-Jones |
| 6,207,085 | B1 | 3/2001 | Ackerman |
| 6,213,679 | B1 | 4/2001 | Frobosilo et al. |
| 6,216,404 | B1 | 4/2001 | Vellrath |
| 6,233,888 | B1 | 5/2001 | Wu |

(56) References Cited

U.S. PATENT DOCUMENTS

| | | | |
|---|---|---|---|
| 6,256,948 | B1 | 7/2001 | Van Dreumel |
| 6,256,960 | B1 | 7/2001 | Babcock et al. |
| 6,279,289 | B1 | 8/2001 | Soder et al. |
| 6,305,133 | B1 | 10/2001 | Cornwall |
| 6,318,044 | B1 | 11/2001 | Campbell |
| 6,374,558 | B1 | 4/2002 | Surowiecki |
| 6,381,913 | B2 | 5/2002 | Herren |
| 6,405,502 | B1 | 6/2002 | Cornwall |
| 6,430,881 | B1 | 8/2002 | Daudet et al. |
| 6,470,638 | B1 | 10/2002 | Larson |
| 6,595,383 | B2 | 7/2003 | Pietrantoni |
| 6,606,831 | B2 | 8/2003 | Degelsegger |
| 6,647,691 | B2 | 11/2003 | Becker et al. |
| 6,668,499 | B2 | 12/2003 | Degelsegger |
| 6,679,015 | B1 | 1/2004 | Cornwall |
| 6,698,146 | B2 | 3/2004 | Morgan et al. |
| 6,705,047 | B2 | 3/2004 | Yulkowski |
| 6,732,481 | B2 | 5/2004 | Stahl, Sr. |
| 6,748,705 | B2 | 6/2004 | Orszulak |
| 6,783,345 | B2 | 8/2004 | Morgan et al. |
| 6,799,404 | B2 | 10/2004 | Spransy |
| 6,843,035 | B1 | 1/2005 | Glynn |
| 6,854,237 | B2 | 2/2005 | Surowiecki |
| 6,871,470 | B1 | 3/2005 | Stover |
| 7,043,880 | B2 | 5/2006 | Morgan et al. |
| 7,059,092 | B2 | 6/2006 | Harkins et al. |
| 7,104,024 | B1 | 9/2006 | deGirolamo et al. |
| 7,152,385 | B2 | 12/2006 | Morgan et al. |
| 7,191,845 | B2 | 3/2007 | Loar |
| 7,240,905 | B1 | 7/2007 | Stahl |
| 7,251,918 | B2 | 8/2007 | Reif et al. |
| 7,302,776 | B2 | 12/2007 | Duncan et al. |
| 7,398,856 | B2 | 7/2008 | Foster et al. |
| 7,413,024 | B1 | 8/2008 | Simontacchi et al. |
| 7,487,591 | B2 | 2/2009 | Harkins et al. |
| 7,506,478 | B2 | 3/2009 | Bobenhausen |
| 7,513,082 | B2 | 4/2009 | Johnson |
| 7,540,118 | B2 | 6/2009 | Jensen |
| 7,594,331 | B2 | 9/2009 | Andrews et al. |
| 7,617,643 | B2 | 11/2009 | Pilz et al. |
| 7,681,365 | B2 | 3/2010 | Klein |
| 7,685,792 | B2 | 3/2010 | Stahl, Sr. et al. |
| 7,716,891 | B2 | 5/2010 | Radford |
| 7,752,817 | B2 | 7/2010 | Pilz et al. |
| 7,775,006 | B2 | 8/2010 | Giannos |
| 7,776,170 | B2 | 8/2010 | Yu et al. |
| 7,797,893 | B2 | 9/2010 | Stahl, Sr. et al. |
| 7,810,295 | B2 | 10/2010 | Thompson |
| 7,814,718 | B2 | 10/2010 | Klein |
| 7,827,738 | B2 | 11/2010 | Abrams et al. |
| 7,866,108 | B2 | 1/2011 | Klein |
| 7,870,698 | B2 | 1/2011 | Tonyan et al. |
| 7,950,198 | B2 | 5/2011 | Pilz et al. |
| 8,056,293 | B2 | 11/2011 | Klein |
| 8,061,099 | B2 | 11/2011 | Andrews |
| 8,062,108 | B2 | 11/2011 | Carlson et al. |
| 8,069,625 | B2 | 12/2011 | Harkins et al. |
| 8,074,412 | B1 | 12/2011 | Gogan et al. |
| 8,074,416 | B2 | 12/2011 | Andrews |
| 8,087,205 | B2 | 1/2012 | Pilz et al. |
| 8,100,164 | B2 | 1/2012 | Goodman et al. |
| 8,132,376 | B2 | 3/2012 | Pilz et al. |
| 8,136,314 | B2 | 3/2012 | Klein |
| 8,151,526 | B2 | 4/2012 | Klein |
| 8,181,404 | B2 | 5/2012 | Klein |
| 8,225,581 | B2 | 7/2012 | Strickland et al. |
| 8,281,552 | B2 | 10/2012 | Pilz et al. |
| 8,322,094 | B2 | 12/2012 | Pilz et al. |
| 8,353,139 | B2 | 1/2013 | Pilz |
| 8,413,394 | B2 | 4/2013 | Pilz et al. |
| 8,495,844 | B1 | 7/2013 | Johnson |
| 8,499,512 | B2 | 8/2013 | Pilz et al. |
| 8,555,566 | B2 | 10/2013 | Pilz et al. |
| 8,578,672 | B2 | 11/2013 | Mattox et al. |
| 8,584,415 | B2 | 11/2013 | Stahl, Jr. et al. |
| 8,590,231 | B2 | 11/2013 | Pilz |
| 8,595,999 | B1 | 12/2013 | Pilz et al. |
| 8,596,019 | B2 | 12/2013 | Aitken |
| 8,607,519 | B2 | 12/2013 | Hilburn |
| 8,640,415 | B2 | 2/2014 | Pilz et al. |
| 8,646,235 | B2 | 2/2014 | Hilburn, Jr. |
| 8,671,632 | B2 | 3/2014 | Pilz et al. |
| 8,728,608 | B2 | 5/2014 | Maisch |
| 8,793,947 | B2 | 8/2014 | Pilz et al. |
| 8,938,922 | B2 | 1/2015 | Pilz et al. |
| 8,973,319 | B2 | 3/2015 | Pilz et al. |
| 9,045,899 | B2 | 6/2015 | Pilz et al. |
| 9,127,454 | B2 | 9/2015 | Pilz et al. |
| 9,151,042 | B2 | 10/2015 | Simon et al. |
| 9,206,596 | B1 | 12/2015 | Robinson |
| 9,290,932 | B2 | 3/2016 | Pilz et al. |
| 9,290,934 | B2 | 3/2016 | Pilz et al. |
| 9,371,644 | B2 | 6/2016 | Pilz et al. |
| 9,458,628 | B2 | 10/2016 | Pilz et al. |
| 9,481,998 | B2 | 11/2016 | Pilz et al. |
| 9,512,614 | B2 | 12/2016 | Klein et al. |
| 9,523,193 | B2 | 12/2016 | Pilz |
| 9,551,148 | B2 | 1/2017 | Pilz |
| 9,616,259 | B2 | 4/2017 | Pilz et al. |
| 9,637,914 | B2 | 5/2017 | Pilz et al. |
| 9,683,364 | B2 | 6/2017 | Pilz et al. |
| 9,719,253 | B2 | 8/2017 | Stahl, Jr. et al. |
| 9,739,052 | B2 | 8/2017 | Pilz et al. |
| 9,739,054 | B2 | 8/2017 | Pilz et al. |
| 9,752,318 | B2 | 9/2017 | Pilz |
| 9,879,421 | B2 | 1/2018 | Pilz |
| 9,909,298 | B2 | 3/2018 | Pilz |
| 9,931,527 | B2 | 4/2018 | Pilz et al. |
| 9,995,039 | B2 | 6/2018 | Pilz et al. |
| 10,000,923 | B2 | 6/2018 | Pilz |
| 10,011,983 | B2 | 7/2018 | Pilz et al. |
| 10,077,550 | B2 | 9/2018 | Pilz |
| 2002/0029535 | A1 | 3/2002 | Loper |
| 2002/0160149 | A1 | 10/2002 | Garofalo |
| 2002/0170249 | A1 | 11/2002 | Yulkowski |
| 2003/0079425 | A1 | 5/2003 | Morgan et al. |
| 2003/0089062 | A1 | 5/2003 | Morgan et al. |
| 2003/0196401 | A1 | 10/2003 | Surowiecki |
| 2003/0213211 | A1 | 11/2003 | Morgan et al. |
| 2004/0010998 | A1 | 1/2004 | Turco |
| 2004/0016191 | A1 | 1/2004 | Whitty |
| 2004/0045234 | A1 | 3/2004 | Morgan et al. |
| 2004/0139684 | A1 | 7/2004 | Menendez |
| 2004/0211150 | A1 | 10/2004 | Bobenhausen |
| 2005/0183361 | A1 | 8/2005 | Frezza |
| 2005/0246973 | A1 | 11/2005 | Jensen |
| 2006/0032163 | A1 | 2/2006 | Korn |
| 2006/0123723 | A1 | 6/2006 | Weir et al. |
| 2006/0137293 | A1 | 6/2006 | Klein |
| 2007/0056245 | A1 | 3/2007 | Edmondson |
| 2007/0068101 | A1 | 3/2007 | Weir et al. |
| 2007/0130873 | A1 | 6/2007 | Fisher |
| 2007/0193202 | A1 | 8/2007 | Rice |
| 2007/0261343 | A1 | 11/2007 | Stahl, Sr. |
| 2008/0087366 | A1 | 4/2008 | Yu et al. |
| 2008/0134589 | A1 | 6/2008 | Abrams et al. |
| 2008/0172967 | A1 | 7/2008 | Hilburn |
| 2008/0196337 | A1 | 8/2008 | Surowiecki |
| 2008/0250738 | A1 | 10/2008 | Howchin |
| 2009/0223159 | A1 | 9/2009 | Colon |
| 2010/0126092 | A1 | 5/2010 | Pilz et al. |
| 2011/0041415 | A1 | 2/2011 | Esposito |
| 2011/0056163 | A1 | 3/2011 | Kure |
| 2011/0067328 | A1 | 3/2011 | Naccarato et al. |
| 2011/0099928 | A1 | 5/2011 | Klein et al. |
| 2011/0146180 | A1 | 6/2011 | Klein |
| 2011/0167742 | A1 | 7/2011 | Klein |
| 2011/0185656 | A1 | 8/2011 | Klein |
| 2011/0214371 | A1 | 9/2011 | Klein |
| 2012/0023846 | A1 | 2/2012 | Mattox et al. |
| 2012/0247038 | A1 | 10/2012 | Black |
| 2012/0266550 | A1 | 10/2012 | Naccarato et al. |
| 2012/0297710 | A1 | 11/2012 | Klein |
| 2014/0219719 | A1 | 8/2014 | Hensley et al. |

(56) References Cited

U.S. PATENT DOCUMENTS

| | | | |
|---|---|---|---|
| 2015/0135631 | A1 | 5/2015 | Foerg |
| 2015/0275510 | A1 | 10/2015 | Klein et al. |
| 2016/0017599 | A1 | 1/2016 | Klein et al. |
| 2016/0097197 | A1 | 4/2016 | Pilz |
| 2016/0130802 | A1 | 5/2016 | Pilz |
| 2016/0208484 | A1 | 7/2016 | Pilz |
| 2016/0265219 | A1 | 9/2016 | Pilz |
| 2017/0016227 | A1 | 1/2017 | Klein |
| 2017/0044762 | A1 | 2/2017 | Pilz |
| 2017/0130445 | A1 | 5/2017 | Pilz |
| 2017/0175386 | A1 | 6/2017 | Pilz |
| 2017/0198473 | A1 | 7/2017 | Pilz |
| 2017/0209722 | A1 | 7/2017 | Pilz |
| 2017/0234004 | A1 | 8/2017 | Pilz |
| 2017/0260741 | A1 | 9/2017 | Ackerman |
| 2017/0328057 | A1 | 11/2017 | Pilz |
| 2018/0010333 | A1 | 1/2018 | Foerg et al. |
| 2018/0030723 | A1 | 2/2018 | Pilz |
| 2018/0030726 | A1 | 2/2018 | Pilz |
| 2018/0195282 | A1 | 7/2018 | Pilz |
| 2018/0289994 | A1 | 10/2018 | Pilz |

FOREIGN PATENT DOCUMENTS

| | | |
|---|---|---|
| CA | 2736834 | 12/2015 |
| EP | 0 346 126 | 12/1989 |
| GB | 2 159 051 | 11/1985 |
| GB | 2 411 212 | 8/2005 |
| JP | 06-146433 | 5/1994 |
| JP | 06-220934 | 8/1994 |
| WO | WO 2003/038206 | 5/2003 |
| WO | WO 2007/103331 | 9/2007 |
| WO | WO 2009/026464 | 2/2009 |

OTHER PUBLICATIONS

U.S. Appl. No. 15/469,370, filed Mar. 24, 2017, Pilz et al.
U.S. Appl. No. 15/481,272, filed Apr. 6, 2017, Pilz.
U.S. Appl. No. 15/680,025, filed Aug. 17, 2017, Pilz et al.
U.S. Appl. No. 15/680,072, filed Aug. 17, 2017, Pilz et al.
U.S. Appl. No. 15/943,349, filed Apr. 2, 2018, Pilz et al.
U.S. Appl. No. 15/986,280, filed May 22, 2018, Pilz et al.
U.S. Appl. No. 16/001,228, filed Jun. 6, 2018, Pilz et al.
BlazeFrame 2009 catalog of products, available at least as of Mar. 4, 2010 from www.blazeframe.com, in 20 pages.
Canadian First Office Action for Application No. 2,697,295, dated Sep. 21, 2011, in 4 pages.
Canadian Second Office Action for Application No. 2,697,295, dated May 23, 2012, in 4 pages.
Canadian Office Action for Application No. 2,827,183, dated Mar. 27, 2015 in 4 pages.
Canadian Office Action for Application No. 2,827,183, dated Mar. 7, 2016 in 4 pages.
Catalog page from Stockton Products, printed from www.stocktonproducts.com, on Dec. 16, 2007, showing #5 Drip, in 1 page.
ClarkDietrich Building Systems, Product Submittal Sheet, (FTSC) Flat Trail Vertical Slide Clip. CD-FTSC11 Jul. 2011. 1 page.
DoubleTrackTM information sheets by Dietrich Metal Framing, in 2 pages; accessible on Internet Wayback Machine on Jul. 8, 2006.
FireStikTM by CEMCO Brochure, published on www.firestik.us, in 18 pages; accessible on Internet Wayback Machine on Aug. 13, 2007.
Information Disclosure Statement letter; U.S. Appl. No. 12/196,115, dated Aug. 4, 2011.
International Search Report for Application No. PCT/US2008/073920, dated Apr. 9, 2009.
"Intumescent Expansion Joint Seals", Astroflame; http://www.astroflame.com/intumescent_expansion_joint_seals; Jul. 2011; 4 pages.
James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
"System No. HW-D-0607", May 6, 2010, Metacaulk, www.rectorseal.com, www.metacault.com; 2008 Underwriters Laboratories Inc.; 2 pages.
Trim-Tex, Inc., Trim-Tex Wall Mounted Deflection Bead Installation Instructions, 2 pages.
"Wall Mounted Deflection Bead", Trim-Tex Drywall Products; Oct. 9, 2016; 3 pages.

FIRE-RATED JOINT SYSTEM

RELATED APPLICATIONS

Related applications are listed in an Application Data Sheet (ADS) filed with this application. All applications listed in the ADS are hereby incorporated by reference herein in their entireties.

BACKGROUND

Field

The present invention generally relates to fire-rated building structures. In particular, the present invention relates to fire-rated joint systems, wall assemblies, and other building structures that incorporate the fire-rated joint systems.

Description of the Related Art

Fire-rated construction components and assemblies are commonly used in the construction industry. These components and assemblies are aimed at preventing fire, heat, and smoke from leaving one room or other portion of a building and entering another room or portion of a building. The fire, heat or smoke usually moves between rooms through vents, joints in walls, or other gaps or openings. The fire-rated components often incorporate fire-retardant materials which substantially block the path of the fire, heat or smoke for at least some period of time. Intumescent materials work well for this purpose, because they swell and char when exposed to flames helping to create a barrier to the fire, heat, and/or smoke.

One particular wall joint with a high potential for allowing fire, heat or smoke to pass from one room to another is the joint between the top of a wall and the ceiling, which can be referred to as a head-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages that are described herein.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and at least one flange extending from the web. Typically, the header track includes a pair of flanges, which extend in the same direction from opposing edges of the web. The header track can be slotted header track, which includes a plurality of slots spaced along the length of the track and extending in a vertical direction. When the wall studs are placed into the slotted track, each of the plurality of slots accommodates a fastener used to connect the wall stud to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, as described above.

Recently, improved methods of providing a fire-rated head-of-wall joint have been developed. One example of a fire-rated wall construction component is a head-of-wall fire block device sold by the Assignee of the present application under the trademark FireStik®. The FireStik® fire block product incorporates a metal profile with a layer of intumescent material on its inner surface. The metal profile of the FireStik® fire block product is independently and rigidly attached to a structure, such as the bottom of a floor or ceiling, at a position adjacent to the gap between the wallboard (e.g., drywall) and the ceiling on the opposite side (i.e., outside) of the wallboard relative to the studs and header track. The intumescent material, which is adhered to the inner surface of the metal profile, faces the wallboard, stud and header track. The space created in between the wallboard and ceiling, and the space between the stud and header track, allows for independent vertical movement of the stud in the header track when no fire is present.

When temperatures rise, the intumescent material on the FireStik® fire block product expands rapidly and chars. This expansion creates a barrier which fills the head-of-wall gap and inhibits or at least substantially prevents fire, heat and smoke from moving through the head-of-wall joint and entering an adjacent room for at least some period of time.

Still another example of an improved construction component for creating a fire-rated head-of-wall joint is a header track with integrated intumescent material strips sold by the Assignee of the present application under the trademark FAS Track®. In contrast to the FireStik® fire block product, the FAS Track® header track product incorporates the intumescent material directly on the header track so that the fire block material is installed during the framing process. Both the FireStik® and the FAS Track® fire block products are typically installed by the framing crew. The integration of the intumescent material into the FAS Track® header track product can eliminate the need to install an additional fire block product after the wall board has been installed, which is typically done by a different crew than the framing crew.

SUMMARY

Although the FireStik® and the FAS Track® products represent an improvement over the conventional method of stuffing mineral wool material into the head-of-wall joint and applying the elastomeric spray material over the mineral wool, there still exists room for improved products and methods for efficiently and cost-effectively creating fire-rated wall joints. Certain embodiments of the present invention involve a fire-rated angle piece that incorporates a fire-resistant or intumescent material on at least one surface of the angle piece. The angle piece is separate from the header track, but is configured to be installed prior to the installation of the wall board and, preferably, during the framing process. Advantageously, the present angle piece can be installed along with the installation of the header track or can be installed after the installation of the header track. Such an arrangement avoids the need to have the framers return after the installation of the wall board. In addition, the angle piece can be stacked and shipped without damaging the intumescent material more easily than a header track that incorporates the intumescent material.

An embodiment involves a fire-rated assembly for a linear wall gap, which includes a track that has a web, a first flange and a second flange. The web is substantially planar and has a first side edge and a second side edge. The first flange and the second flange extend in the same direction from the first and second side edges, respectively. Each of the first and second flanges is substantially planar such that the track defines a substantially U-shaped cross section. An angle has a first flange and a second flange, wherein each of the first flange and the second flange is substantially planar such that the angle defines a substantially L-shaped cross section. Each of the first and second flanges has a free end opposite a corner of the angle. In some embodiments, a heat-expandable intumescent strip is attached to the angle and extends lengthwise along an outer surface of the second flange. The intumescent strip comprises a portion that extends past an outer surface of the first flange of the angle. The first flange of the angle is positioned between the web of the track and an overhead structure with the second flange of the angle being positioned adjacent one of the first or second flanges of the track with at least a portion of the second flange contacting the one of the first or second flanges of the track.

In other embodiments, a heat-expandable intumescent strip is attached to the angle and extends lengthwise along an interior surface of the second flange. In use, the first flange of the angle is positioned between the web of the track and an overhead structure with the second flange of the angle being positioned adjacent one of the first or second flanges of the track such that the intumescent strip is between the second flange and the one of the first or second flanges of the track.

In some arrangements, an upper edge of the intumescent strip is spaced below an upper end of the second leg thereby defining an upper portion of the second leg that is not covered by the intumescent strip. A lower edge of the intumescent strip can be spaced above a lower end of the second leg thereby defining a lower portion of the second leg that is not covered by the intumescent strip. A height of the intumescent strip can be about twice a height of the upper portion of the second leg. A height of the lower portion of the second leg can be about twice the height of the intumescent strip.

In some arrangements, a height of the intumescent strip is equal to or less than about one-half of a height of the second leg. In other arrangements, the height of the intumescent strip is equal to or less than about one-third of a height of the second leg. The second flange of the angle can be approximately the same height as the one of the first and second flange of the track. A plurality of slots can be included on the first and second flanges of the track, which extend in a direction perpendicular to a length of the first track and the second flange of the angle can cover an entirety of the slots.

In some arrangements, the wall assembly includes a plurality of studs and a wall board, wherein an upper end of each of the studs is received within and secured to the track and the wall board is secured to the plurality of studs, and wherein the second flange of the angle is positioned between the wall board and the one of the first and second flanges of the track. The wall assembly can define a maximum distance of relative movement between the track and the plurality and studs or the wall board, wherein a height of the intumescent strip is about one-half or less than the maximum distance. The assembly can include a layer of an elastomeric fire spray material applied to the overhead structure and the angle. The layer of fire spray material preferably is not applied to the wall board.

In some arrangements, an angle is defined between the first flange and the second flange of the angle that is less than 90 degrees such that a gap is created between an upper end of the second flange of the angle and an upper end of the one of the first and second flanges of the track. The angle can be approximately 87 degrees.

The assembly can include a second intumescent strip that extends along and is attached to a portion of the first flange of the angle such than the portion contacts the overhead structure when the fire-rated assembly is assembled to the overhead structure. The track can be a footer or header track. The track can be a stud framing member made from wood or metal.

An embodiment involves a fire-rated wall joint product, which includes an elongated, generally L-shaped angle piece having a first flange and a second flange oriented at an angle relative to the first flange. The first flange and the second flange each have a free edge and are connected to one another along an edge that is opposite the free edges thereby defining a corner. The first flange and second flange are formed from a single piece of material. An intumescent material strip is applied to an interior surface of the second flange and a height of the intumescent material strip is equal to or less than about one-half a height of the second flange.

In some arrangements, the height of the intumescent material strip is equal to or less than about one-third of the height of the second flange. The height of the intumescent material strip can be about one-seventh of the height of the second flange. The intumescent material strip can be spaced from an upper end of the second flange.

An embodiment involves a method of assembling a fire-rated wall joint, including securing a header track to a ceiling, positioning a horizontal leg of an elongated, generally L-shaped fire-rated angle piece between the header track and the ceiling such that at least a portion of an intumescent material strip located on a vertical leg of the angle piece faces toward the header track, positioning upper ends of a plurality of studs into the header track, and securing at least one wall board member to the plurality of studs such that the vertical leg of the angle piece is positioned between the at least one wall board member and the header track.

Another embodiment involves a method of assembling a fire-rated wall joint, including securing a header track to a ceiling, positioning a horizontal leg of an elongated, generally L-shaped fire-rated angle piece between the header track and the ceiling such that at least a portion of an intumescent material strip located on a vertical leg of the angle piece faces away from the header track, positioning upper ends of a plurality of studs into the header track, and securing at least one wall board member to the plurality of studs such that the vertical leg of the angle piece is positioned between the at least one wall board member and the header track.

In some arrangements, the positioning of the horizontal leg between the header track and the ceiling is done after the securing of the header track to the ceiling. The method can also include applying a layer of an elastomeric fire spray to the ceiling and the angle piece and not to the at least one wall board member.

In some arrangements, a fire-rated wall joint product includes an elongated, generally L-shaped angle piece comprising a first flange and a second flange oriented at an angle relative to the first flange. The first flange and the second flange each have a free edge and are connected to one another along an edge that is opposite the free edges thereby defining a corner. The first flange and second flange can be formed from a single piece of material. The wall joint product can also include a first intumescent material strip applied to an interior surface of the first flange, wherein a height of the intumescent material strip is equal to or less than about one-half a height of the first flange. The wall joint product can further include a second intumescent material strip applied to an interior surface of the second flange, wherein a height of the intumescent material strip is equal to or less than about one-half a height of the second flange.

In some arrangements, the height of the first intumescent material strip is equal to or less than about one-third of the height of the first flange. The height of the second intumescent material strip can be equal to or less than about one-third of the height of the second flange. In other arrangements, the height of the first intumescent material strip is about one-seventh of the height of the first flange. The height of the second intumescent material strip can be about one-seventh of the height of the second flange. In some arrangements, the first intumescent material strip is spaced from the corner. In other arrangements, the second intumescent material strip can be spaced from an upper end of the second flange.

An embodiment involves a method of assembling a fire-rated wall joint product, including securing a header track to a ceiling; positioning upper ends of a plurality of studs into the header track; positioning an elongated, generally L-shaped angle piece between the header track and the ceiling, the L-shaped angle piece comprising a first flange, a second flange oriented at an angle relative to the first flange, and an intumescent material strip applied to an exterior surface of the second flange, the first flange and the second flange each having a free edge and being connected to one another along an edge that is opposite the free edges thereby defining a corner, the first flange and second flange formed from a single piece of material; and securing at least one wall board member to the plurality of studs such that the second flange is positioned between the at least one wall board member and the header track.

Another embodiment involves a method of assembling a fire-rated wall joint product, including securing a header track to a ceiling; positioning upper ends of a plurality of studs into the header track; positioning an elongated, generally L-shaped angle piece between the header track and the ceiling, the L-shaped angle piece comprising a first flange, a second flange oriented at an angle relative to the first flange, a flap, and an intumescent material strip applied to an exterior surface of the second flange, the first flange and the flap each having a free edge, the first flange and the second flange being connected to one another along an edge thereby defining a first corner and the second first flange and the flap being connected to one another along an edge thereby defining a second corner, the first flange and the second flange each being planar, the first and second flange and the flap being formed from a single piece of material; and securing at least one wall board member to the plurality of studs such that the second flange is positioned between the at least one wall board member and the header track.

In some arrangements, a fire-rated assembly for a linear wall gap includes a track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section; an angle piece comprising a first flange, a second flange oriented at a first angle relative to the first flange, a flap oriented at a second angle relative to the first flange, and an intumescent material strip applied to an exterior surface of the second flange, the second flange and the flap each having a free edge, the first flange and the second flange being connected to one another along an edge thereby defining a first corner and the first flange and the flap being connected to one another along an edge thereby defining a second corner, the first flange and the second flange each being planar, the first and second flanges and the flap being formed from a single piece of material; a heat-expandable intumescent strip attached to the angle and extending lengthwise along an interior surface of the second flange; wherein, in use, the first flange of the angle is positioned adjacent to an overhead structure with the second flange of the angle being positioned adjacent one of the first or second flanges of the track such that the intumescent strip is between the second flange and a wall board.

In other arrangements, a fire-rated wall joint product includes an elongated, generally L-shaped angle piece comprising a first flange, a second flange oriented at a first angle relative to the first flange, and a flap oriented at a second angle to the first flange, the second flange and the flap each having a free edge, the first flange and the second flange connected to each other along an edge thereby defining a first corner, the first flange and the flap connected to one another along an edge thereby defining a second corner, the first flange and the flap being planar, the first and second flanges and the flap being formed from a single piece of material; and an intumescent material strip applied to an exterior surface of the first flange, wherein a height of the intumescent material strip is equal to or less than about one-half a width of the first flange.

In some arrangements, the fire-rated joint product further includes a second intumescent material applied to an exterior surface of the second flange. In some arrangements, the second flange further comprises a kickout portion such that a lower portion of the second flange is parallel to the upper portion of the second flange. In some arrangements, the flap further comprises a second intumescent strip applied to an interior surface of the flap. In some arrangements, the flap further comprises a first section and a second section oriented at an angle relative to the first second, the first section and the second section being connected to one another along an edge defining a corner, the second portion substantially parallel to the first flange. In some arrangements, the intumescent material strip wraps the first corner between the first flange and the second flange.

In another arrangement, a fire-rated wall joint product includes an elongated piece comprising a strap having a free edge and a hem having an outwardly curved portion, the strap and the hem being formed from a single piece of material; and an intumescent material strip applied to an exterior surface of the strap and extending beyond the free edge of the strap, wherein a length of the intumescent material strip is equal to or less than about one-half a height of the strap.

In some arrangements, the strap of a fire-rated joint product further includes a kickout portion such that a lower portion of the strap is parallel to the upper portion of the strap. In some arrangements, the strap has a two-ply section having a first layer and a second layer such that the free edge of the strap is adjacent the kickout portion of the strap, the two-ply section forming a gap between the first layer and the second layer. In some arrangements, an intumescent material is applied within the gap.

In yet another arrangement, a fire-rated wall joint product includes an elongated piece comprising a strap have a free edge and a S-curve attachment portion extending from an end of the strap opposite the free edge, the strap having a kickout portion such that a lower portion of the strap is parallel to the upper portion of the strap, the attachment portion forming an angle with the strap, the strap and the attachment portion being formed from a single piece of material; and an intumescent material strip applied to an exterior surface of the strap such that the intumescent material extends above a junction between the attachment portion and the strap, wherein a length of the intumescent material strip is equal to or less than about one-half a height of the strap.

In another embodiment, a fire-blocking wall assembly includes a first wall partition comprising a first surface; a second wall partition comprising a second surface; wherein the first wall partition and the second wall partition move laterally and vertically with respect to each other; a fire-blocking drift joint comprising a body having a first end, a second end, and a compressible portion between the first end and the second end, the compressible portion having a first leg and a second leg such that the first and second legs form an angle, the first end having a first flange, the second end having a second flange, each of the first end and the second end having a free end opposite the compressible portion, the drift joint further comprising a fire-retardant material applied to an outer surface of the second flange; wherein the fire-blocking drift joint is installed between the first wall partition and the second wall partition; wherein the first flange attaches to the second surface of the second wall partition and the second flange engages the first surface of the first wall partition.

In some arrangements, the body comprises a single piece of steel. In some arrangements, the body comprises two pieces of steel mechanically fastened together. In some arrangements, the compressible section comprises a first and second layer of steel. In some arrangements, a space created between the first and second layer of steel is at least partially filled with a fire-retardant material. In some arrangements, the compressible section has a U-shaped or a V-shaped profile. In some arrangements, each of the first flange and the second flange is substantially planar such that the body defines a substantially U-shaped cross section with the first and second ends substantially parallel. In some arrangements, each of the first flange and the second flange is planar such that the body defines a cross section with the first and second ends at an angle to each other. In some arrangements, the compressible section is in a compressed state when inserted into the fire-seal partition interface. In some arrangements, the fire-blocking drift joint maintains a fire-seal partition across the fire-seal partition interface while allowing the first vertical wall partition and the second vertical wall partition to move independently relative to each other in both lateral and vertical directions.

In another arrangement, a fire-blocking expansion joint assembly includes a horizontal ceiling element comprising a first attachment surface; a horizontal wall element comprising a second attachment surface; an interface between the horizontal ceiling element and the horizontal wall element; a fire-blocking expansion joint comprising a body having a first end, a second end, and a compressible portion between the first end and the second end, the compressible portion having a first leg and a second leg such that the first and second legs come together to form an angle that is V-shaped or U-shaped, each of the first end and the second end having a free end opposite the compressible portion, the first end having a first flange, the second end having a second flange; wherein the first flange attaches to the first attachment surface of the horizontal ceiling element and the second flange attaches to the second attachment surface of the horizontal wall element such that the fire-blocking expansion joint is installed within the interface.

In some arrangements, the body comprises a single piece of steel. In some arrangements, the body comprises two pieces of steel. In some arrangements, the compressible section comprises a first and second layer forming an open space between the first and second layers. In some arrangements, the space created between the first and second layer of steel is filled with a fire-retardant material. In some arrangements, the compressible section has a U-shaped or a V-shaped profile. In some arrangements, each of the first flange and the second flange is substantially planar such that the body defines a substantially U-shaped cross section with the first and second ends substantially parallel. In some arrangements, each of the first flange and the second flange is planar such that the body defines a cross section with the first and second ends forming an angle. In some arrangements, the compressible section is in a compressed state when inserted into the interface. In some arrangements, the fire-blocking expansion joint maintains a fire-seal partition across the interface while allowing the horizontal ceiling element and the horizontal wall element to move independently relative to each other.

In another embodiment, a fire-rated assembly for a linear wall gap, includes a track, an angle piece and a heat-expandable intumescent strip. The track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section. The angle piece has a first flange, a second flange oriented at a first angle relative to the first flange, the first flange and the second flange being connected to one another along an edge thereby defining a corner, the first and second flanges being formed from a non-metal material. The heat-expandable intumescent strip attached to one of the first and second flanges of the angle piece, the heat-expandable intumescent strip having an activation temperature that is lower than a melting temperature of the non-metal material. In use, the first flange of the angle is positioned adjacent to an overhead structure with the second flange of the angle being positioned adjacent one of the first or second flanges of the track. The angle piece is configured to deform and contain expanding intumescent material of the heat-expandable intumescent strip when the angle piece and the heat-expandable intumescent strip are exposed to temperatures greater than the activation temperature.

In some arrangements, the non-metal material is comprised of polyvinyl chloride (PVC).

In another embodiment, a fire-rated wall joint product includes an angle piece and a heat-expandable intumescent strip. The angle piece includes a first flange, a second flange oriented at a first angle relative to the first flange, the first flange and the second flange being connected to one another along an edge thereby defining a corner, the first and second flanges being formed from a non-metal material. The heat-expandable intumescent strip is attached to one of the first and second flanges, the heat-expandable intumescent strip having an activation temperature that is lower than a melting temperature of the non-metal material. The angle piece is configured to deform and contain expanding intumescent material of the heat-expandable intumescent strip when the angle piece and the heat-expandable intumescent strip are exposed to temperatures greater than the activation temperature.

In some arrangements, the non-metal material is comprised of polyvinyl chloride (PVC).

In another embodiment, a fire-rated wall joint product includes a body portion and a heat-expandable intumescent strip. The body portion includes a first end and a second end, the body portion being formed from a non-metal material. The heat-expandable intumescent strip attached to the body portion between the first and second ends, the heat-expandable intumescent strip having an activation temperature that is lower than a melting temperature of the non-metal material. The non-metal material is configured to deform and contain expanding intumescent material of the heat-expandable intumescent strip when the body portion and heat-expandable intumescent strip are exposed to temperatures greater than the activation temperature.

In some arrangements, the non-metal material is comprised of polyvinyl chloride (PVC).

In another embodiment, a fire-rated assembly for a linear wall gap includes a track, an angle piece and a gasket. The track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section. The angle piece comprising a first flange, a second flange oriented at a first angle relative to the first flange, the first flange and the second flange being connected to one another along an edge thereby defining a corner. The gasket is attached to the angle piece, and the gasket comprises a compressible material. In use, the first flange of the angle is positioned adjacent to an overhead structure such that the gasket contacts the overhead structure to form a seal between the first flange and the overhead structure.

In some arrangements, the gasket is attached to the first flange of the angle.

In some arrangements, a first end of the gasket is attached to the first flange and a second end of the gasket is attached to the second flange such that the gasket is positioned over the corner of the angle piece.

In some arrangements, the fire-rated assembly further comprises a heat-expandable intumescent strip attached to one of the first and second flanges of the angle piece.

In another embodiment, a fire-rated wall joint product includes an angle piece and a gasket. The angle piece includes a first flange, a second flange oriented at a first angle relative to the first flange, the first flange and the second flange being connected to one another along an edge thereby defining a corner. The gasket is attached to the angle piece, the gasket comprising a compressible material.

In some arrangements, the gasket is attached to the first flange of the angle.

In some arrangements, a first end of the gasket is attached to the first flange and a second end of the gasket is attached to the second flange such that the gasket is positioned over the corner of the angle piece.

In another embodiment, a fire-rated wall assembly includes a first vertical wall structure, a second vertical wall structure positioned laterally adjacent to the first vertical wall structure, the first and second vertical wall structures defining a vertical wall gap therebetween, and an elongated, generally L-shaped angle. The L-shaped angle includes a first leg and a second leg oriented at an angle relative to the first leg, the first leg having a length that is greater than a length of the second leg, the first leg and the second leg each having a free edge and being connected to one another along an edge that is opposite the free edges thereby defining a corner, the first and second legs formed from a single piece of material, and at least one fire-resistant seal positioned on a surface of the first leg facing away from the second leg. The second leg of the L-shaped angle is disposed within the vertical wall gap such that the at least one fire-resistant seal contacts the second vertical wall structure and seals the vertical wall gap while allowing relative movement between the first and second vertical wall structures.

In some arrangements, the at least one fire-resistant seal is compressed between surfaces of the first and second vertical wall structures.

In some arrangements, the fire-rated wall assembly includes an overlapping region defined by portions of the first and second vertical wall structures which define the vertical wall gap, the overlapping region having a length defined by ends of the overlapping region, wherein the at least one fire-resistant seal is positioned between ¼ to ¾ of a distance between the ends of the overlapping region.

In some arrangements, the at least one fire-resistant seal is positioned substantially at a midpoint between the ends of the overlapping region.

In some arrangements, the first vertical wall structure includes an internal stud wall and the second vertical wall structure includes one of an external wall structure or a window mullion assembly.

In some arrangements, the second leg is fastened to a stud of the internal stud wall by a fastener.

In another embodiment, a fire-rated movement joint product for a vertical wall gap includes an elongated, generally L-shaped component comprising a first leg and a second leg oriented at an angle relative to the first leg, the first leg having a length that is greater than a length of the second leg, the first leg and the second leg each having a free edge and being connected to one another along an edge that is opposite the free edges thereby defining a corner, the first and second legs formed from a single piece of material; and at least one fire-resistant seal positioned on a surface of the first leg facing away from the second leg.

In some arrangements, the fire-rated movement joint product includes a second fire-resistant seal positioned on a surface of the first leg facing the second leg.

In some arrangements, the at least one fire-resistant seal is positioned at an end of the first leg opposite the corner.

In some arrangements, the fire-rated movement joint product includes a corner bead that protrudes from the first and second legs.

In some arrangements, the fire-rated movement joint product includes a corner bead that protrudes from the first and second legs.

In some arrangements, the compressible gasket is spaced a distance from the at least one fire-resistant seal.

In some arrangements, the at least one fire-resistant seal is positioned between the compressible gasket and the corner.

In some arrangements, the L-shaped component is formed from a metal material.

In some arrangements, the metal material is comprised of steel.

In some arrangements, the L-shaped component is formed from a non-metal material.

In some arrangements, the non-metal material is comprised of polyvinyl chloride (PVC).

BRIEF DESCRIPTION OF THE DRAWINGS

Certain features, aspects and advantages of the various devices, systems and methods presented herein are described with reference to drawings of certain embodiments, which are intended to illustrate, but not to limit, such devices, systems, and methods. It is to be understood that the drawings are for the purpose of illustrating concepts of the embodiments discussed herein and may not be to scale. For example, certain gaps or spaces between components illustrated herein may be exaggerated to assist in the understanding of the embodiments. Dimensions, if provided in the specification, are merely for the purpose of example in the context of the specific arrangements shown and are not intended to limit the disclosure. The drawings contain twenty-eight (28) figures.

In FIG. 10, the head-of-wall assembly is shown in a closed or upward position.

FIG. 42 illustrates the angle piece as part of an open joint (left side) and a closed joint (right side).

DETAILED DESCRIPTION

Several preferred embodiments of the fire-rated angle pieces and fire-rated joint systems are described herein, typically in the context of a wall assembly and, in particular, a head-of-wall assembly. However, the fire-rated angle pieces and fire-rated joint systems can also be used in other applications, such as at the bottom or sides of a wall or a joint in an intermediate location of a wall. The fire-rated angle pieces and fire-rated joint systems can also be used in non-wall applications. In view of the head-of-wall assembly being but one of the multiple applications for the fire-rated angle pieces and fire-rated joint systems, the use of relative or directional terminology, or other such descriptions, is for convenience in describing the particular embodiments, arrangements or orientations shown. Therefore, such terms are not intended to be limiting, unless specifically designated as such.

Figure 1:
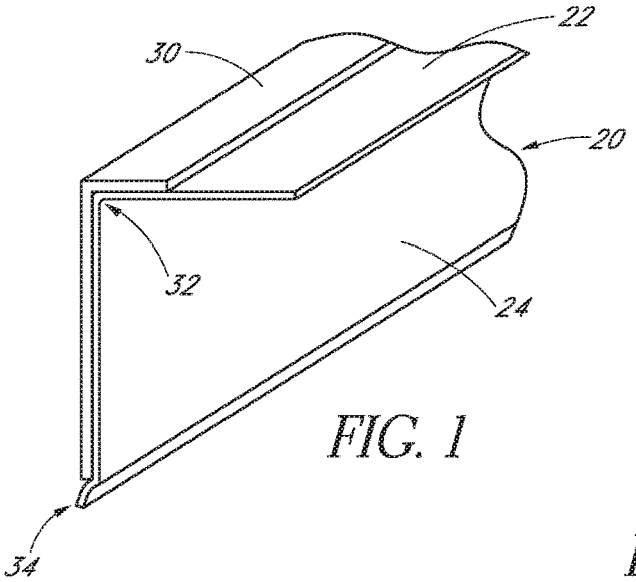
FIG. 1 is a perspective view of a fire-rated angle piece, which incorporates a fire-resistant or intumescent material strip.
Figure 2:
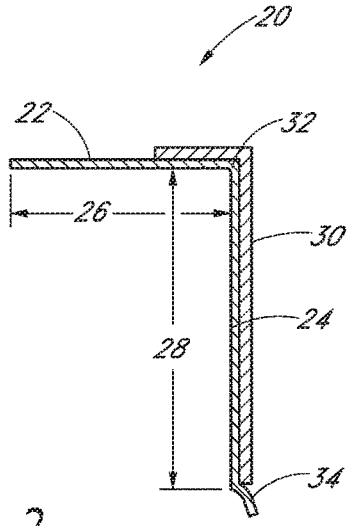
FIG. 2 is a cross-sectional view of the fire-rated angle piece of FIG. 1.
Figure 3:
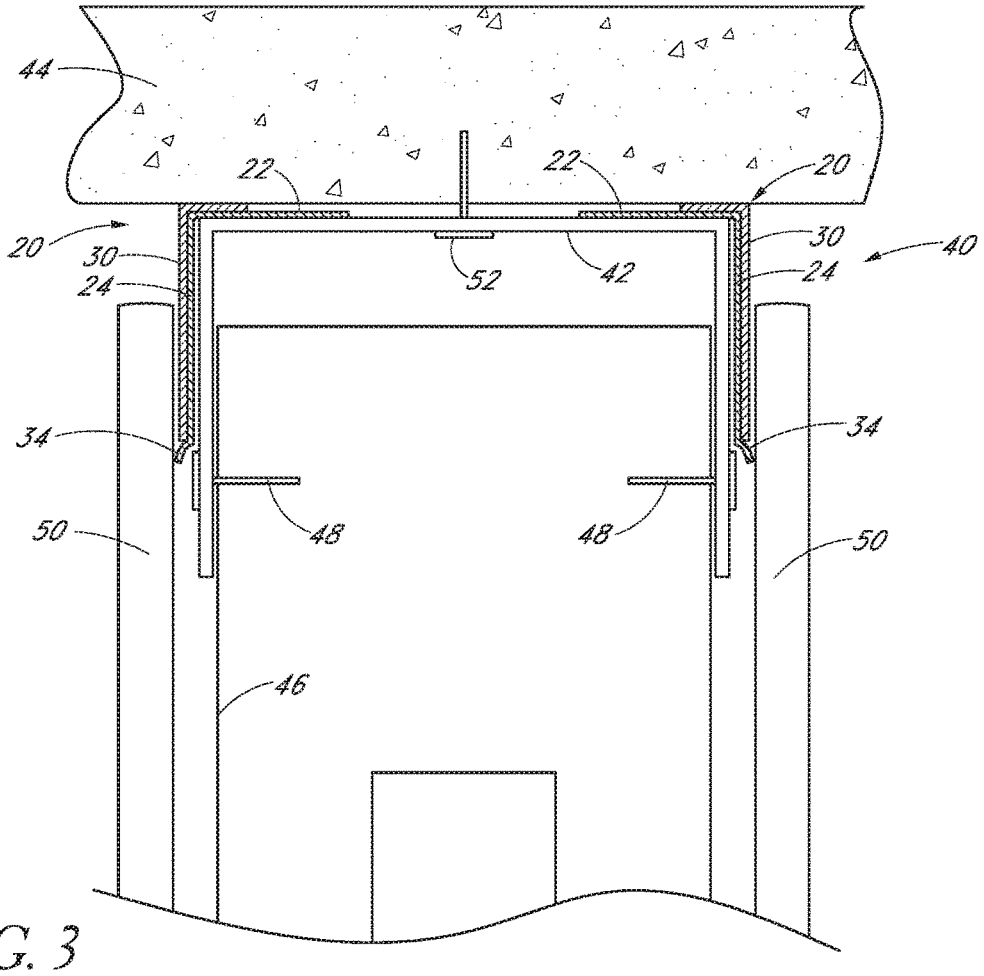
FIG. 3 is a cross-sectional view of a head-of-wall joint incorporating the fire-rated angle piece of FIG. 1.

FIGS. 1-3 illustrate an embodiment of a fire-rated profile or angle piece 20, which is also referred to herein simply as an angle 20, alone (FIGS. 1 and 2) and incorporated into a head-of-wall assembly (FIG. 3). The angle 20 preferably is formed from a light gauge steel material by any suitable process, such as roll forming, for example. Preferably, the angle 20 is an elongated member having a consistent or substantially consistent cross-sectional shape throughout its length. One or more preferred embodiments of the angle 20 are generally or substantially L-shaped in cross-section. In one embodiment, the angle 20 may be between about 5 feet and 25 feet in length. The angle 20 can be between about 10 and 20 feet in length. Preferably, the angle 20 is about 10-12 feet in length to facilitate shipping and storage. Desirably, the angle 20 is sufficiently long to allow installation along a wall with a relatively small number of pieces. However, the length of the angle 20 should be short enough that shipping and material handling is relatively convenient. Accordingly, the above-recited lengths are presently preferred. However, other lengths may also be used in other situations.

Preferably, the angle 20 includes a top or upper wall portion or top or upper leg or flange 22. The upper wall portion 22 is also referred to herein as a horizontal leg because it is typically oriented in a horizontal or substantially horizontal plane when installed in a head-of-wall assembly, as described herein. The angle 20 also includes a side wall portion 24, which is also referred to herein as a vertical leg or flange because it is typically oriented in a vertical or substantially vertical plane when the angle 20 is installed in a head-of-wall assembly. The illustrated vertical leg 24 is unitarily formed with the horizontal leg 22. That is, the horizontal leg 22 and the vertical leg 24 are constructed from a single piece of material. As described above, typically, the single piece of material is a flat piece of light gauge steel, which is then deformed into the shape of the angle 20, such as through a roll-forming, bending (such as on a press brake) or other suitable process. Preferably, both the horizontal leg 22 and the vertical leg 24 are substantially planar and define an angle therebetween of about 90 degrees or, in some arrangements, slightly less than 90 degrees. For example, the legs 22 and 24 may define an angle of between about 80 degrees and about 90 degrees, between about 85 degrees and 90 degrees or about 87 degrees. This can assist in providing a gap at the upper end of the vertical leg 24 to accommodate a fastener head, as is described in greater detail below.

In one embodiment of the light gauge steel angle 20, the horizontal leg 22 can define a width 26 (i.e., horizontal cross-sectional dimension) of about ¾ inch or less, 1 inch or less, or 1½ inches or less. Preferably, the horizontal leg 22 is about 1½ inches wide. The vertical leg 24 can define a width or height 28 (i.e., vertical cross-sectional dimension) between about ½ inch and about 3 inches or more depending on amount of fire and smoke protection desired and/or based on deflection requirements. The dimensions of the width of the horizontal leg 22 preferably are selected such that two angles 20 can be employed in a head-of-wall assembly (illustrated in FIG. 3) with one angle 20 on each side of the wall. Preferably, the width of the horizontal leg 22 is selected such that the legs 22 of the two angles 20 do not overlap one another when assembled into the head-of-wall assembly. Accordingly, if the angle 20 is configured for use with a wall assembly that is wider than standard width, the width of the horizontal leg 22 can be increased to, for example, about 1½ inches to about 3 inches, or more. The width or height of the vertical leg 24 is selected such that the leg 24 fills the entire head-of-wall gap, or gap between the ceiling and upper end surfaces of the wall board, in an open-most position of the head-of-wall joint (assuming a dynamic joint). Alternatively, the width or height of the vertical leg 24 is selected to cover a substantial portion, such as ⅓ to ½ or more, of the corresponding leg of the header track. Thus, the actual width or height of the vertical leg 24 can vary from the exemplary widths or heights described herein.

Preferably, a fire retardant material or a fire retardant material strip, such as an intumescent tape or intumescent strip 30, is adhesively (or otherwise) applied to the full length of the fire-rated angle 20. In a preferred arrangement, the intumescent tape 30 wraps over the corner 32 of the angle 20 (intersection between the horizontal leg 22 and the vertical leg 24) and is positioned on each of the horizontal leg 22 and vertical leg 24. Preferably, the intumescent tape 30 extends only partially across the horizontal leg 22 and extends substantially or entirely across the vertical leg 24. Preferably, the intumescent tape 30 extends less than half-way or about ⅓ of the way across the horizontal leg 22. In other arrangements, the intumescent tape 30 can extend all the way across the horizontal leg 22 and/or only partially across the vertical leg 24. However, preferably, at least a portion of the intumescent tape 30 is located on the horizontal leg 22. Such an arrangement results in the intumescent tape 30 being sandwiched, pinched or compressed between the header track/horizontal leg 22 and the ceiling thereby keeping the intumescent tape 30 in place in the event of elevated heat or fire. Although heat-resistant adhesive preferably is used to affix the intumescent tape 30 to the angle 20, the adhesive can still fail at temperatures lower than that required to cause expansion of the intumescent tape 30. By pinching the intumescent tape 30 between the ceiling and the angle 20/header track, the intumescent tape 30 is held in place even if the adhesive fails.

Preferably, as described above, the intumescent tape or strip 30 is constructed with a material that expands in response to elevated heat or fire to create a fire-blocking char. One suitable material is marketed as BlazeSeal™ from Rectorseal of Houston, Tex. Other suitable intumescent materials are available from 3M Corporation, Hilti Corporation, Specified Technologies, Inc., or Grace Construction Products. The intumescent material expands to many times (e.g., up to 35 times or more) its original size when exposed to sufficient heat (e.g., 350 degrees Fahrenheit). Thus, intumescent materials are commonly used as a fire block because the expanding material tends to fill gaps. Once expanded, the intumescent material is resistant to smoke, heat and fire and inhibits fire from passing through the head-of-wall joint or other wall joint. Thus, intumescent materials are preferred for many applications. However, other fire retardant materials can also be used. Therefore, the term intumescent strip 30 is used for convenience in the present specification and that the term is to be interpreted to cover other expandable or non-expandable fire-resistant materials as well, such as intumescent paints (e.g., spray-on), fiberglass wool (preferably with a binder, such as cured urea-phenolic resin) or fire-rated dry mix products, unless otherwise indicated. The intumescent strip 30 can have any suitable thickness that provides a sufficient volume of intumescent material to create an effective fire block for the particular application, while having small enough dimensions to be accommodated in a wall assembly. That is, preferably, the intumescent material strips 30 do not cause unsightly protrusions or humps in the wall from excessive build-up of material. In one arrangement, the thickness of the intumescent strip 30 is between about 1/16 (0.0625) inches and ⅛ (0.125) inches, or between about 0.065 inches and 0.090 inches. One preferred thickness is about 0.075 inches.

An optional kick-out 34 extending from a free end of the vertical leg 24 allows the framing screw to cycle under the angle 20 and also provides some protection to the intumescent strip 30, as is described in greater detail below. Preferably, the kick-out 34 extends in the direction of the intumescent strip 30 and in a direction opposite the horizontal leg 22. The kick-out 34 preferably is also unitary with the vertical leg 24 and horizontal leg 22 (i.e., constructed from a single piece of material). The illustrated kick-out 34 is arcuate in shape. Preferably, the kick-out 34 defines an arc of about 90 degrees or about ¼ of a circle. However, the kick-out 34 may define a variable radius, rather than a single radius. The kick-out 34 preferably extends outwardly from an outer surface of the vertical leg 24 by a distance substantially equal to or greater than the thickness of the intumescent tape 30.

FIG. 3 illustrates a wall assembly 40 (in particular, a head-of-wall assembly) including an embodiment of the angle 20 installed on each side of a header track 42. The intumescent strip 30 on the angle 20 is compressed between the header track 42 and an overhead structure/ceiling 44 creating a gasket to protect against smoke, fire and sound passing through the gap between the header track 42 and the ceiling 44. In the illustrated arrangement, the ceiling 44 is a concrete deck. However, the angle 20 can be employed with other types of overhead structures, including a fluted pan deck, which is disclosed herein with reference to FIGS. 12 and 13. The wall assembly 40 also includes a plurality of wall studs 46 (only one is shown), which are coupled to the header track 42 by suitable fasteners 48 (e.g., ½ inch framing screws). The header track 42 can be a slotted header track, which allows vertical movement of the wall studs 46 relative to the header track 42. Wall board members 50 (e.g., drywall) are coupled to the wall studs 46 by suitable fasteners (not shown) and, thus, can move along with the wall studs 46 relative to the header track 42. The wall board 50 is pressed up against the kick-out 34 to provide a continuous seal against smoke and sound passing through the gap between the header track 42/angle 20 and the wall board 50.

The header track 42 is secured to the ceiling 44 by a suitable fastener 52 (e.g., concrete fastener). If the wall assembly 40 includes a dynamic head-of-wall, a gap may be present between upper ends of the wall studs 46 and wall board 50 to allow relative movement therebetween, as shown. The horizontal leg 22 of each angle 20 is interposed between the web of the header track 42 and the ceiling 44 such that the angles 20 are held in place by the header track 42. Compression of the portion of the intumescent strip 30 positioned on the horizontal leg 22 can assist in securing the angle 20 between the header track 42 and the ceiling 44 and inhibiting or preventing undesired removal of the angle 20. The vertical leg 24 of the angle 20 is interposed between the side leg of the header track 42 and the wall board 50. That is, the vertical leg 24 of the angle 20 is positioned on the inside of the wall board 50, which provides an attractive finished head-of-wall joint. As described, the kick-out 34 (if present) can contact the wall board 50 to provide a seal. In addition, the kick-out 34 can facilitate entry of the head portion of the fasteners 48 into the gap between the vertical leg 24 and the side leg of the header track 42 during cycling of the wall studs 46 and wall board 50 relative to the header track 42.

Advantageously, such an arrangement permits the use of a separate component (i.e., the angle 20) to carry the intumescent strip 30 instead of the intumescent strip 30 being placed directly on the header track 42 and also permits the angle 20 to be placed inside the wall board 50. The use of a separate component (angle 20) to carry the intumescent strip 30 can be advantageous because shipping and storage of the angle 20 without damaging the intumescent strip 30 is simplified relative to when the intumescent strip 30 is carried by the header track 42. For example, the angles 20 can be easily stacked and shipped in a box, whereas it is more difficult to stack and ship a header track 42 incorporating intumescent strip(s) 30. In addition, the use of a separate component (angle 20) to carry the intumescent strip 30 allows a fire-rated head-of-wall joint to be created with nearly any type or brand of header track 42 (or other components).

Figure 10:
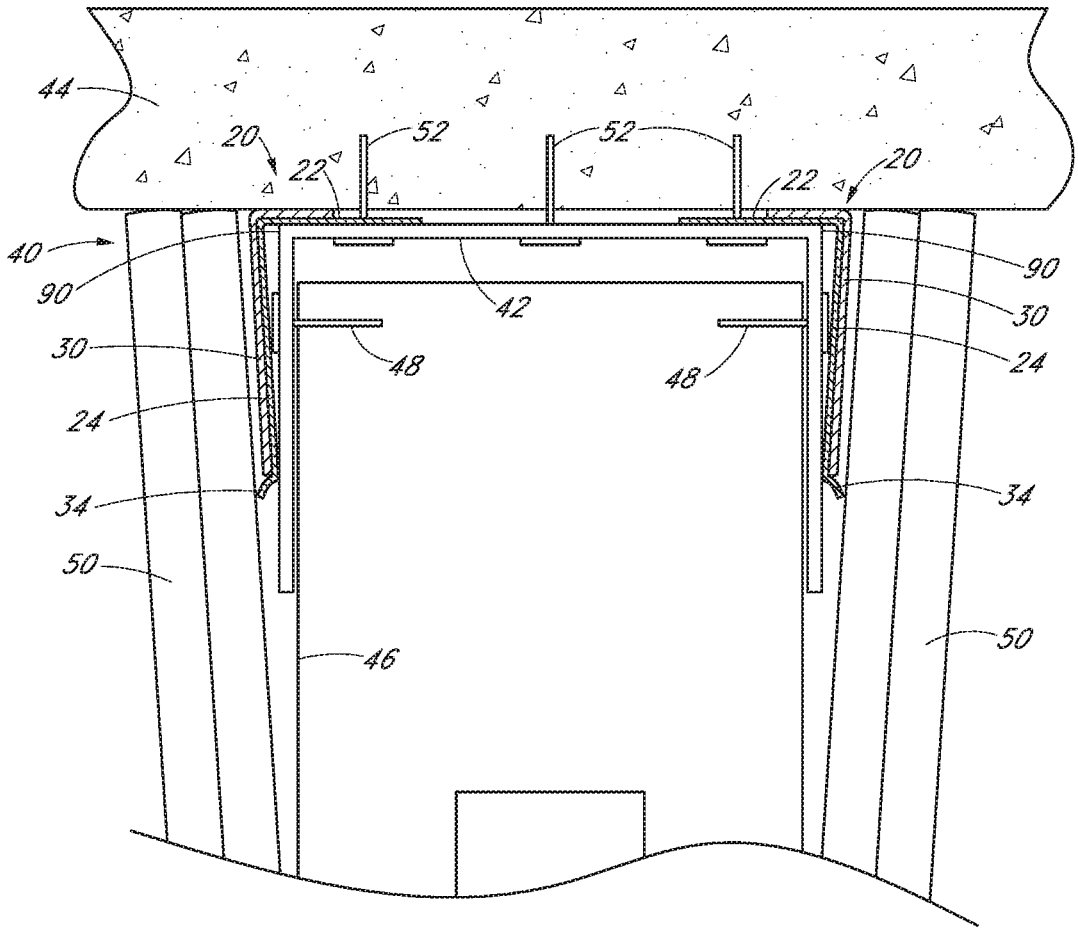
FIG. 10 is a cross-sectional view of a head-of-wall assembly incorporating another embodiment of the fire-rated angle piece.
Figure 11:
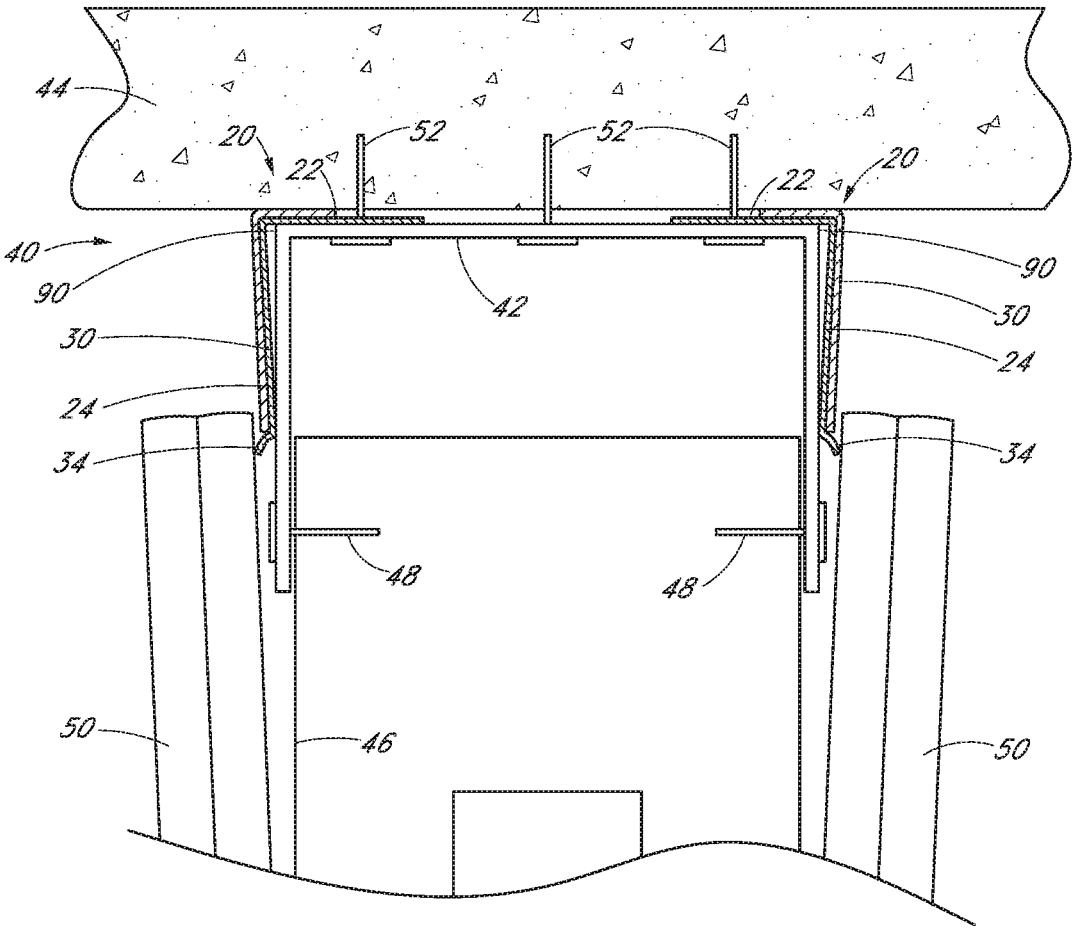
FIG. 11 is a cross-sectional view of the head-of-wall assembly of FIG. 10 in an open or downward position.

The angle(s) 20 can be installed before, during or after installation of the header track 42. If separate fasteners or fastening methods are used, the angle(s) 20 could be affixed to the ceiling 44 separately and prior to the installation of the header track 42. However, preferably, the angle(s) 20 is/are installed during or after installation of the header track 42. The angle(s) 20 can be placed on the header track 42 and then held in place against the ceiling 44 as the header track 42 is secured to the ceiling 44. Alternatively, the angle(s) 20 can be affixed to the header track 42, even if temporarily (e.g., using an adhesive or caulk), and then the header and angle(s) 20 can be secured to the ceiling 44. Or, the angle(s) 20 can be installed after the header track 42 is partially or completely installed. For example, the header track 42 can be secured to the ceiling 44 with a minimum number of fasteners 52, the angle(s) 20 installed, and then the remaining fasteners 52 can be installed to secure the header track 42 to the ceiling 44. Alternatively, the header track 42 can be completely installed and then the angle(s) 20 can be inserted between the header track 42 and the ceiling. The edges of the header track 42 can be slightly flexed to allow insertion of the horizontal leg 22 of the angle 20. The angle(s) 20 can be lightly tapped or otherwise pressed into place. If desired, a spacer (e.g., washer or embossment on the upper surface of the track 42) can be positioned between the ceiling 44 and the header track 42 to create a small gap (preferably smaller than the combined thickness of the horizontal leg 22 and intumescent strip 30) to facilitate insertion of the angle(s) 20. Additional fasteners 52 can be installed through both the header track 42 and angle 20, if desired, as shown in FIGS. 10 and 11.

In the event of elevated heat or a fire, once a threshold heat has been reached, the intumescent strip 30 will rapidly expand to fill any gap present at the head-of-wall, such as between the header track 42 and the ceiling 44 and/or between the angle 20/header track 42 and the wall board 50. The pinching of the intumescent strip 30 between the ceiling and the angle 20/header track 42 assists in keeping the intumescent strip 30 in place when or if the adhesive used to secure the strip 30 to the angle 20 degrades to the point that it is no longer effective. Thus, the illustrated wall assembly 40 provides a reliable fire-rated head-of-wall joint.

Figure 4:
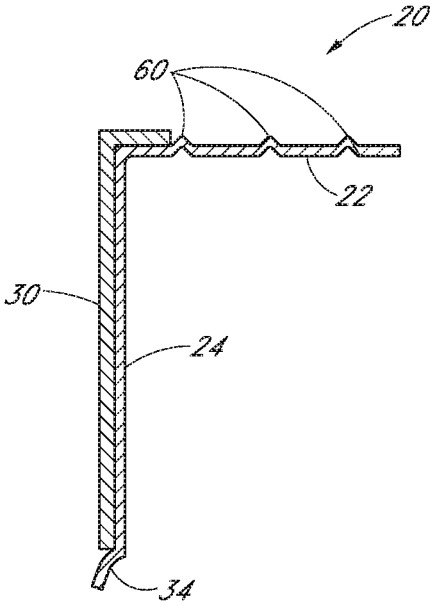
FIG. 4 is a cross-sectional view of an alternative fire-rated angle piece that includes a retention feature on an upper wall portion of the angle piece.
Figure 5:
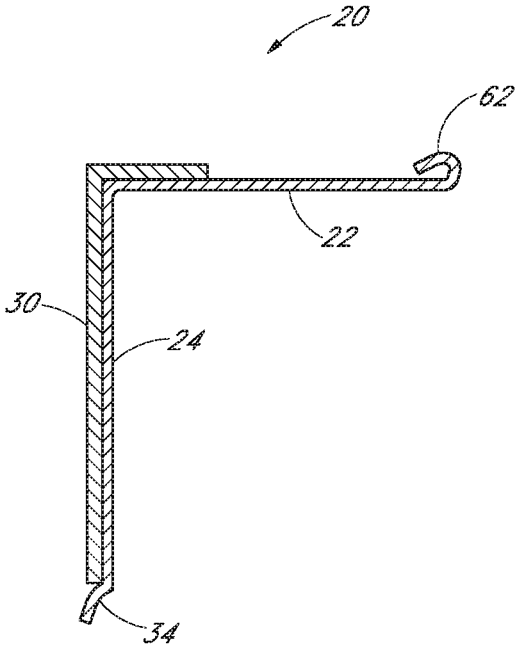
FIG. 5 is a cross-sectional view of another alternative fire-rated angle piece that includes another retention feature, in the form of a hem, on the upper wall portion of the angle piece.
Figure 6:
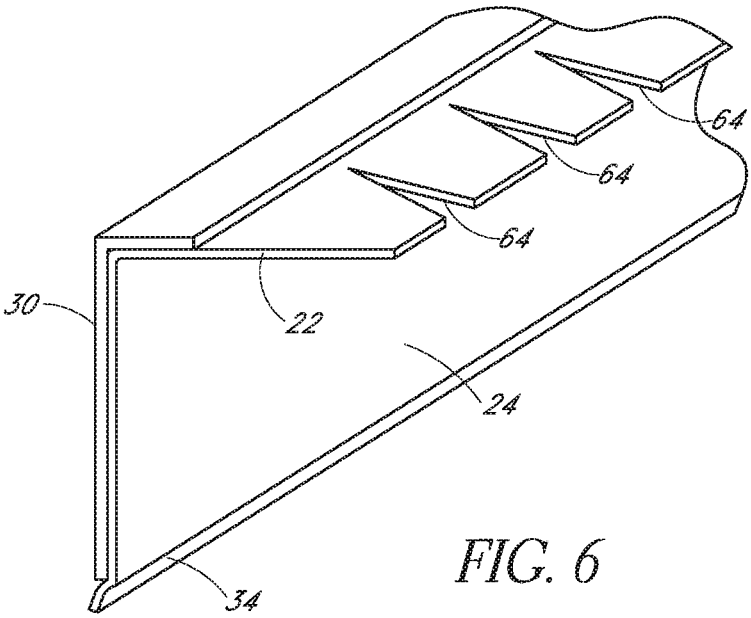
FIG. 6 is a perspective view of another fire-rated angle piece that incorporates notches or slots in the upper wall portion to allow bending of the angle piece or accommodate fasteners used to secure the header track to the ceiling.

With additional reference to FIGS. 4-6, the top horizontal leg 22 of the angle 20 can be made in different styles to provide a way to secure the leg 22 between the header track 42 and the ceiling 44 and inhibiting or preventing inadvertent or undesired removal of the angle 20. As discussed above, the angle 20 illustrated in FIGS. 1-3, which includes planar or flat steel legs 22, 24 will just rely on the compression of the intumescent strip 30 between the angle 20 and the overhead structure 44 or just the compression/friction of the horizontal leg 22 of the angle 20 between the track 42 and the ceiling 44, for example, if the intumescent strip 30 does not wrap onto the horizontal leg 22. With reference to FIG. 4, the top leg 22 can be formed (e.g., embossed) with a retention features, such as raised or interference surface features. In particular, the interference surface features may be provided in the form of protrusions or dimples 60 that serve to increase the friction between the angle 20 and the ceiling 44 and/or create interference contact between the protrusions 60 and imperfections in the ceiling 44. In any event, the force required to remove the angle 20 (the "removal force") can be increased. The raised or interference surface features, protrusions or dimples can be of any suitable shape, preferably which is capable of being created during a roll forming process. To the extent that the protrusions/dimples 60 have a longer dimension in one direction than other directions, the longer dimension preferably extends partially or entirely in a lengthwise direction to increase the dimension tending to resist movement of the angle 20 away from the header track 42 (substantially perpendicular to the wall). The protrusions/dimples 60 preferably have a height that is less than the thickness of the intumescent strip 30 such that they do not prevent a good seal between the intumescent strip 30 and the ceiling 44. However, in other arrangements, the protrusion/dimples 60 can be used to create a seal, especially if configured to extend the entire length of the angle 20, and can extend above the upper surface of the intumescent strip 30.

With reference to FIG. 5, the top leg 22 of the angle 20 can have a small hem 62 so that the angle 20 can be pushed into place and once properly installed the hem 62 inhibits or prevents the angle 20 from being removed or slipping out due to structure vibrations or movement. As shown, preferably, the hem 62 is a fold in the free end of the horizontal leg 22 that is positioned above the remaining, preferably planar, portion of the horizontal leg 22. Preferably, the hem 62 is substantially completed folded over; however, in other arrangements, the hem 62 may be a partial fold similar to the kick-out 34, for example.

With reference to FIG. 6, the upper leg 22 can include slots, cut-outs or notches 64 extending from a free end of the leg 22. In one arrangement, the notches 64 are substantially V-shaped (referred to herein as a V-Cut pattern and individually as V-Cuts). The V-Cut pattern 64 allows the angle 20 to be flexible so that it could be used on radius walls. The V-Cut pattern 64 would also help get around any fasteners 52 that are installed to hold the header track 42 in place that may be close to the outer edge. Features shown in and described with reference to FIGS. 4-6 can be combined with one another and/or incorporated with the other angles 20 described herein.

Figure 9:
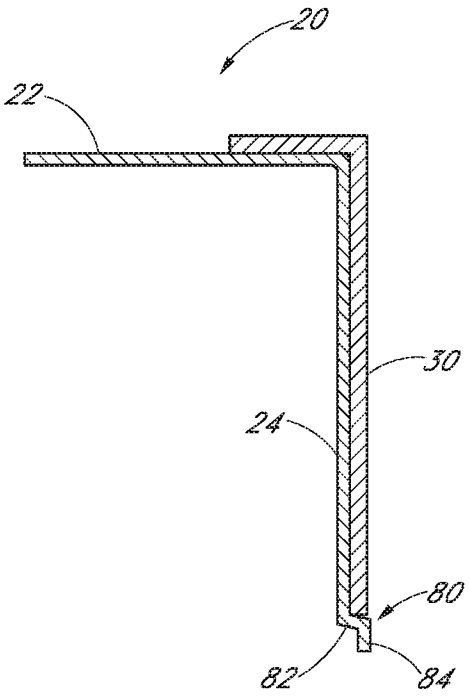
FIG. 9 is a cross-sectional view of another fire-rated angle piece that includes yet another alternative configuration of the free end of the side wall portion.
Figure 8:
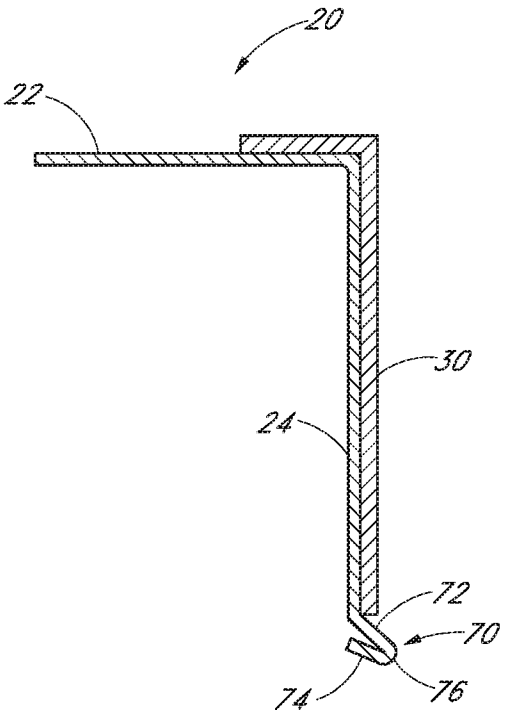
FIG. 8 is a cross-sectional view of another fire-rated angle piece that includes an alternative configuration of a free end of a side wall portion of the angle piece.
Figure 7:
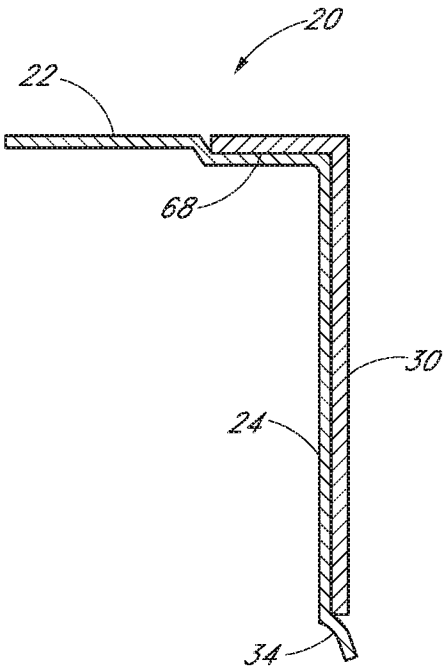
FIG. 7 is a cross-sectional view of another fire-rated angle piece that includes a recess defined in the upper wall portion to accommodate the intumescent material.

With reference to FIGS. 7-9, the kick-out 34 of the vertical leg 24 can be done in different styles. For example, with reference to FIG. 7, a quarter-round pattern provides an open end in which the screw 48 can cycle under the angle 20, as described above. In addition, as shown in FIG. 7, the horizontal leg 22 of the angle 20 may not be completely flat or planar. Rather, in the illustrated arrangement, the leg 22 defines a recessed portion or recess 68 configured to receive the portion of the intumescent strip 30 positioned on the horizontal leg 22. Preferably, the recess 68 is sized and shaped such that the upper surface of the intumescent strip 30 is positioned above the upper surface of the adjacent portion of the horizontal leg 22 such that a good seal is created with the ceiling 44. However, in other arrangements, the upper surface of the intumescent strip 30 can be flush with or positioned below the upper surface of the adjacent portion of the horizontal leg 22.

With reference to FIG. 8, the kick-out is in the form of a small hem 70 provided on the free end of the vertical leg 24 and includes a first or outwardly extending portion 72 and a second or return portion 74. The first portion 72 is angled downward from the remaining upper portion of the vertical leg 24. The return portion 74 extends back toward the inside of the angle 20, but preferably is either aligned with or stops short of the inner surface (extension of the inner surface) of the vertical leg 24 such that interference with the head of the fastener 48 is inhibited or eliminated. Thus, the length of the return portion 74 is preferably less than the length of the outwardly extending portion 72. The intersection of the first and second portions 72, 74 define a corner or rounded surface portion 76 that can contact the wall board 50 to create a seal. Preferably, the corner 76 is positioned outwardly of the outer surface of the intumescent strip 30 to provide protection to the strip 30 during cycling of the wall board 50. However, in other arrangements, the intumescent strip 30 may extend outwardly beyond the corner 76. Similar to the kick-out 34 described with reference to FIGS. 1-7, the hem 70 also provides an open end for the framing screw 48 to cycle.

With reference to FIG. 9, the kick-out is in the form of a block-out 80. The block-out 80 includes a first portion 82 that extends approximately 90 degrees outward from the remaining upper portion of the vertical leg 24 and a second portion 84 that extends approximately 90 degrees downward from the first portion 82. The block-out 80 can also provide an open end for the screw 48 to cycle. Preferably, the outer surface of the block-out 80 is positioned outwardly of the outer surface of the intumescent strip 30 to protect the strip 30 during cycling of the wall board 50. However, the intumescent strip 30 could also extend outwardly of the block-out 80. Features illustrated in and described with reference to FIGS. 7-9 can be incorporated in other embodiments and versions of the angle 20 described herein.

FIGS. 10 and 11 illustrate a head-of-wall assembly 40 similar to that shown in and described with reference to FIG. 3 in which a metal stud framed wall is attached to a solid concrete deck. Accordingly, the same reference numbers are used to describe the same or corresponding components. FIG. 10 illustrates the head-of-wall joint in a closed (i.e., relatively upward) position and FIG. 11 illustrates the head-of-wall joint in an open (i.e., relatively downward) position. In the illustrated arrangement, optional fasteners 52 (e.g., 1" concrete fasteners) are shown being used to secure the angles 20 in place. The fasteners 52 pass through both the web of the header track 42 and the horizontal leg 22 of the angle 20.

Preferably, the header track 42 is installed to the concrete slab/ceiling 44 prior to the intumescent deflection angle 20. As described, the angle 20 can have an additional fasteners 52 installed through the header track 42 and leg 22 of the angle 20 to hold it in place or it can be a compression friction fit utilizing interference features 60 (FIG. 4), a small hem 62 (FIG. 5) or the compression on the portion of the intumescent strip 30 that wraps over the corner of the angle 20. FIGS. 10 and 11 illustrate a gap or a space 90 between the outside leg surface of the header track 42 and the inside surface of the vertical leg 24 of the angle 20 at least at an upper end of the leg 24 and, preferably, only at an upper end of the leg 24. This gap 90 has a function and purpose as it allows the head portion of the framing screw 48 to fit between the outside leg surface of the header track 42 and the inside surface of the vertical leg 24 of the angle 20, as shown in FIG. 10. This allows the bottom portion of the angle leg 24 to push up tight against the outside leg surface of the header track 42 without causing damage to the intumescent strip 30 or angle 20 during the cycling of the wall assembly or the movement cycle test of the UL 2079 fire-rated wall joint testing protocol. The angle 20 shown in this figure is bent to approximately an 87 degree angle, but any angle less than 90 degrees will work. The less-than-90-degree angle is what facilitates the creation of the gap 90 in the upper corner between the outside leg of the header track 42 and the inside surface of the vertical leg 24 of the angle 20, while preferably also maintaining contact between the lower end of the vertical leg 24 of the angle 20 and an intermediate portion of the leg of the header track 42. The approximately 45 degree (or other suitable angle) kick-out 34 allows the framing screw 48 to slide up into the gap 90 between the track 42 and the angle 20 and back out again, for an open deflection joint. However, a gap 90 can also be created with a 90 degree angle between the legs 22 and 24 of the angle 20. For example, if a suitable radius is used in the intersection between the horizontal leg 22 and the vertical leg 24, the radius can inhibit or prevent the angle 20 from being placed tightly against the leg of the header track 42 thereby creating a gap 90. However, the illustrated arrangement is preferred because it not only creates a gap 90, but also keeps the lower end of the vertical leg 24 of the angle 20 in contact with the leg of the header track 42.

As described above, FIG. 11 illustrates the head-of-wall assembly 40 in an open position, such as with the deflection gap in a wide open position with an approximately 1¾ inch gap between the upper ends of the wall board 50 and the ceiling 44. The upper edge of the wall board 50 preferably has a tight compression fit against the kick-out 34 to protect against smoke passage within the fire-rated deflection joint. The framing screw 48 is now located below the vertical leg 24 of the angle 20 and at or near the bottom of the slotted header track 42 when the joint is in the open position.

Figure 12:
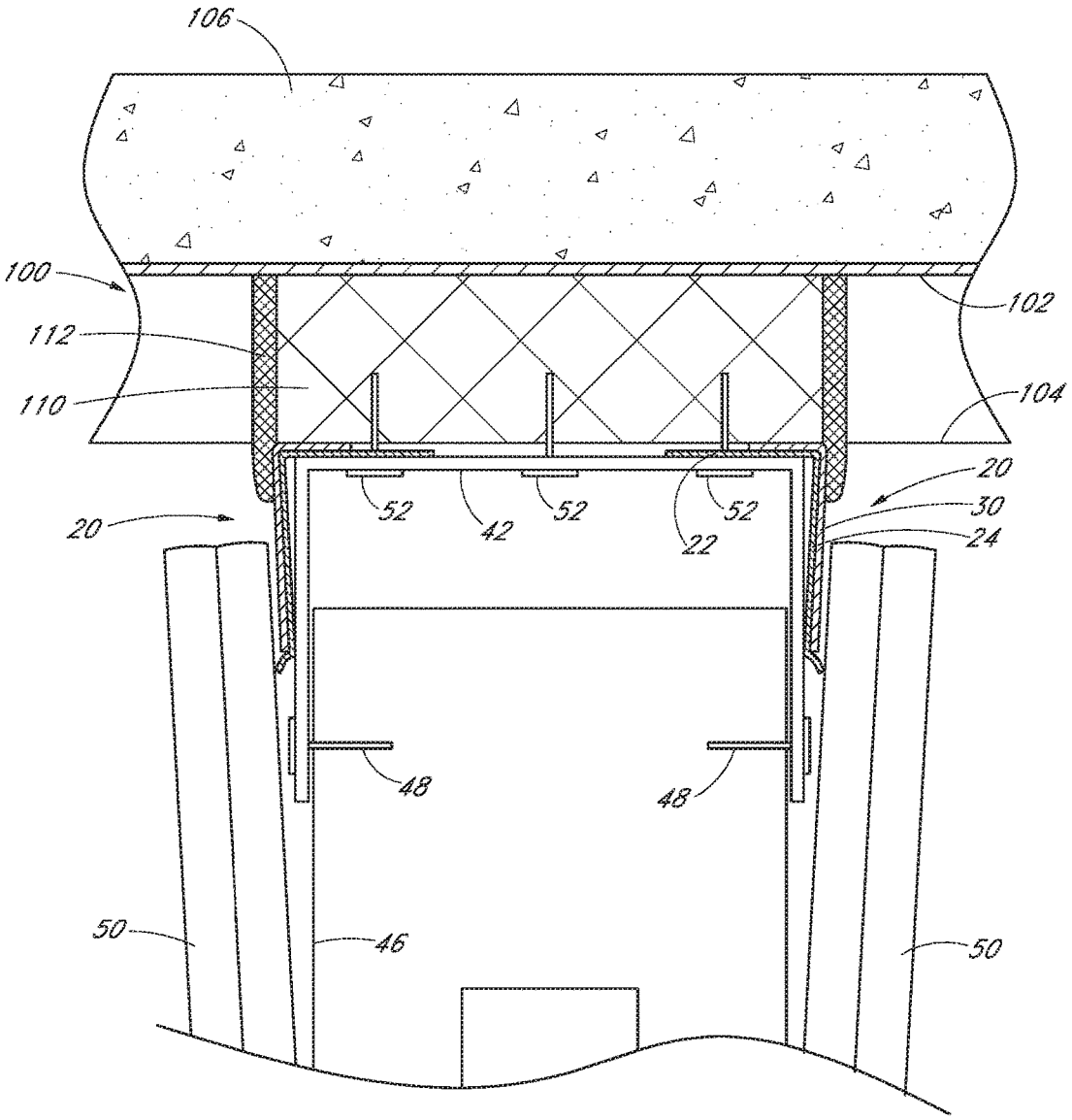
FIG. 12 is a cross-sectional view of a head-of-wall assembly attached to a fluted pan deck ceiling arrangement and including a layer of sprayed elastomeric material.
Figure 13:
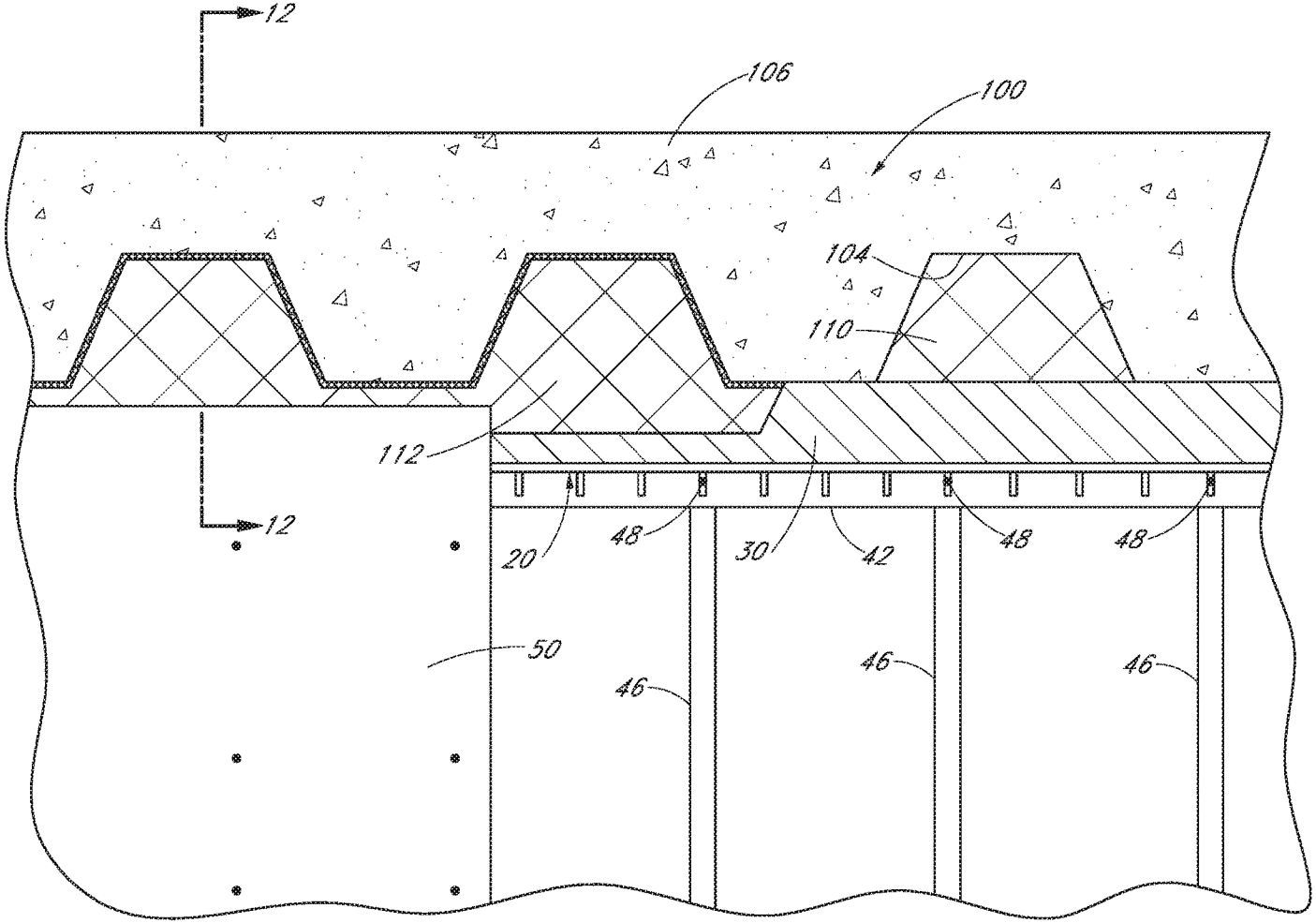
FIG. 13 is an elevation view of the head-of-wall assembly of FIG. 12.

FIGS. 12 and 13 illustrate a wall assembly 40 similar to that shown in and described with reference to FIG. 3 and FIGS. 10 and 11. Accordingly, the same reference numbers are used to describe the same or corresponding components. In FIGS. 12 and 13, a metal stud framed wall assembly 40 is attached to a ceiling 44 in the form of a fluted pan deck 100. The fluted pan deck 100 includes a pan 102, which defines downwardly-opening spaces, voids or flutes 104, and a layer of concrete 106 supported by the pan 102. In the illustrated arrangement, the wall assembly 40 is oriented perpendicular or substantially perpendicular to the flutes 102 of the fluted pan deck 100. Fire-rated walls require fire-resistant material, such as mineral wool 110, to be installed within the voids 104 of the fluted pan deck 100 when the wall assembly 40 is running perpendicular to the flutes 104. The voids or flutes 104 of a fluted pan deck 100 vary in size but generally are about 7½ inches by 3 inches. Mineral wool 110 is compressed and placed into these voids 104. A fire spray material 112 (e.g., a fire-resistant elastomeric material that can be applied with a sprayer) is then sprayed over the top of the mineral wool 110 to protect against smoke passage. The fire spray 112 will generally have elastomeric qualities to it for flexibility and in some cases may even have intumescent qualities. In traditional stuff and spray assemblies, the fire spray 112 will go over the mineral wool 110 and lap over the top edge of the wall board 50, for example, by about ½ inch.

An aspect of the present invention involves the realization that because the fire spray 112 extends over two dissimilar materials, i.e., the mineral wool 110 which is compressible and wall board (e.g., drywall) 50 which is rigid, a great deal of stress is created in the fire spray 112 covering the deflection gap as both materials will act differently as they are cycled up and down. The mineral wool 110 is flexible and will be more forgiving as it cycles, but the drywall 50 is rigid and will pull away from the mineral wool 110 and fire spray 112. Therefore, as these assemblies go through the movement cycle test of UL 2079, the fire spray tends to rip or tear along the joint between the drywall and the mineral wool. Cracks, rips, or tears create a weak spot in the joint and it becomes very vulnerable to the air-leakage test and burn test that follow the movement cycle test according to UL 2079. However, in the arrangement illustrated in FIGS. 12 and 13, it is apparent that the fire spray 112 only laps on the intumescent angle 20. The wall board (e.g., drywall) 50 is able to cycle unencumbered against intumescent angle 20 without stress cracks to the fire rated deflection joint. Such an arrangement is capable of providing a Class III Seismic movement joint according to UL 2079. Traditional stuff and spays typically are only capable of providing Class II Wind Movement according to UL 2079 because these types of joints are very vulnerable to cracking or tearing. FIG. 12 illustrates the wall in a position in which the upper edges of the wall board 50 are below the fire spray 112 and FIG. 13 shows a relatively more upward position of the wall board 50 in which the upper edge of the wall board 50 partially covers the fire spray 112. In FIG. 13, a portion of the wall board 50 and fire spray 112 is removed to show the other components of the wall.

Figure 14:
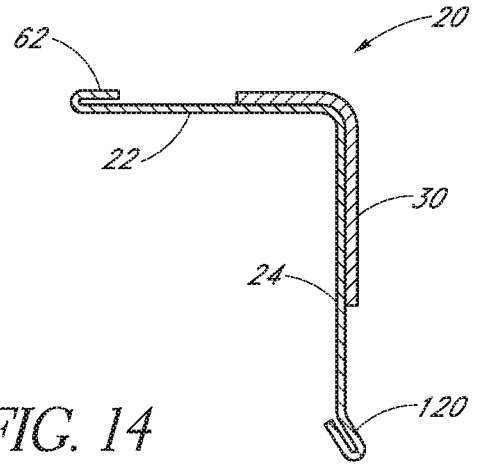
FIG. 14 is a cross-sectional view of an alternative fire-rated angle piece including a hem at the free end of the upper wall portion and a hem at the free end of the side wall portion.

FIG. 14 illustrates another embodiment of a fire-rated angle 20, which is similar to the above-described angles 20. Accordingly, the same reference numbers are used to describe the same or corresponding features. The angle 20 of FIG. 14 includes a locking hem 62 on the upper horizontal leg 22 and another locking hem 120 on the vertical leg 24. The locking hem 62 is similar to the locking hem 62 described in connection with the angle 20 of FIG. 5. In particular, the free end of the locking hem 62 preferably faces toward the vertical leg 24 of the angle 20 to facilitate installation of the angle 20 between the header track 42 and the ceiling 44 (especially when the header track 42 has already been installed) and inhibit or prevent removal of the angle 20 from the installed position. Although the locking hem 62 of the horizontal leg 22 is positioned above the horizontal leg 22 (between the horizontal leg 22 and the ceiling 44), it could also be positioned below the leg 22. However, engagement of the locking hem 62 with the ceiling 44 is believed to provide better resistance to removal of the angle 20 than engagement of the locking hem 62 with the header track 42.

The hem 120 on the vertical leg 24 is just one option for the kick-out 34. The kick-out 34 allows the framing screw 48 to move up and down, under the angle 20 and back out, as described previously. Preferably, the free end of the hem 120 preferably ends prior to the inner surface of the vertical leg 24, or a downward extension or projection of the inner surface, to avoid having the fastener 48 hang up on the free end of the hem 120 as the fastener 48 cycles into and out of the space behind the angle 20. The angle 20 of FIG. 14 also includes a narrower version of the intumescent strip 30 relative to the prior versions shown in FIGS. 1-13. In the illustrated arrangement, the portion of the intumescent strip 30 positioned on the vertical leg 24 ends short of the hem 120. However, preferably, the width of the intumescent strip 30 on the vertical leg 24 is equal to or greater than the width of the strip 30 on the horizontal leg 22. Preferably, the portion of the intumescent strip 30 on the vertical leg 24 covers at least about one-half or at least about two-thirds of the vertical leg 24. In the illustrated arrangement, the intumescent strip 30 covers about two-thirds of the vertical leg 24.

Figure 15:
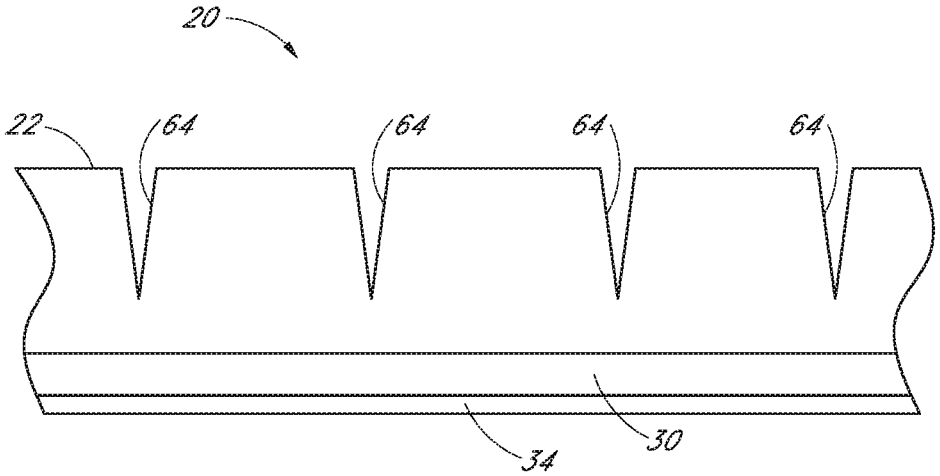
FIG. 15 is a top view of the fire-rated angle piece of FIG. 6.
Figure 16:
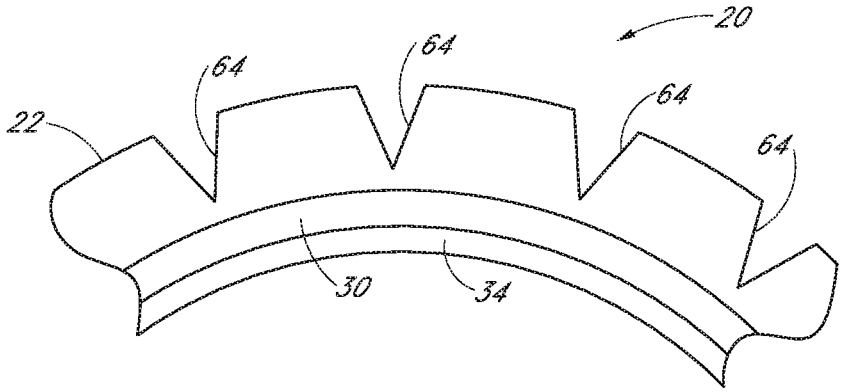
FIG. 16 is a top view of the fire-rated angle piece of FIG. 15 in a bent configuration.

FIGS. 15 and 16 illustrate an angle 20 similar or identical to the angle 20 described with reference to FIG. 6 and which includes multiple slots, cut-outs or notches 64, which are in the form of V-Cuts, extending from the free end of the upper horizontal leg 22 toward the intersection between the horizontal leg 22 and the vertical leg 24. The V-Cuts 64 can vary in spacing and size. A purpose of the V-Cuts 64 is to allow the angle to be used on a radius wall. The V-Cuts 64 allow the angle 20 to be bent inward or outward. FIG. 16 shows the V-cuts 64 in an open position which will happen as the angle 20 is bent. However, advantageously, the intumescent strip 30 will stay intact as the cuts 64 preferably are only on a portion of the upper horizontal attachment leg 22. Thus, the intumescent strip 30 will still protect against fire and smoke passage. The V-Cuts 64 (or other types of slots, cut-outs or notches) may also accommodate/avoid interference with fasteners 52 used to secure the header track 42 to the ceiling 44.

The illustrated angles 20 are intended for use in combination with header tracks 42 that are coupled to an overhead structure 44 and receive upper ends of a plurality of wall studs 46. However, the angles 20 can also be used with other types of tracks or other structural components to create a fire-rated joint. For example, the angles 20 could be used with a bottom track or a wall stud. Although not shown herein, as is known, a stud wall commonly includes a bottom track (which may be the same as or similar to the illustrated header tracks 42) that receives the bottom ends of the wall studs 46 and is secured to the floor. With respect to the disclosed header tracks 42, these can be of a solid leg variety or can be slotted header tracks, in which each of the first side flange and the second side flange includes a plurality of elongated slots that extend in a vertical direction, or in a direction from a free end of the flange toward the web and perpendicular to a length direction of the track. The centerlines of adjacent slots are spaced from one another along a length of the track by a distance, such as one inch, in one embodiment. However, other offset distances could be provided, depending on the desired application. Preferably, the slots are linear in shape and sized to receive and guide a fastener (e.g., fastener 48) that couples a stud to the header track. The slots allow relative movement between the header track and the studs. The linear shape of the slots constrains the fasteners to substantially vertical movement.

As discussed, preferably, the free end of the side flange of the angles forms a kick-out (e.g., kick-out 34). The kick-out extends outwardly from the remainder of the side flange in a direction away from the top flange (and away from the header track when assembled). One type of kick-out is an outwardly-bent end portion of the side flange which is oriented at an oblique angle relative to the remaining, preferably planar, portion of the side flange. As described herein, the use of the term side flange (vertical leg or wall portion) can include the kick-out or, in some contexts, can refer to the portion of the side flange excluding the kick-out. As described herein, the kick-out functions as a lead-in surface for the fasteners that pass through the slots of the header track when the heads of the fasteners move toward the top of the slots and in between the side flange of the angle and the flange of the header track. However, the kick-out can be otherwise shaped if desired, depending on the intended application and/or desired functionality. For example, the kick-out can be configured to contact the wallboard of an associated wall assembly to assist in creating a seal between the angle and the wallboard or to inhibit damage to the fire-resistant material on the angle, as described. Preferred kick-outs can satisfy one or more of these functions. In one arrangement, the kick-out extends outwardly less than about ¼ inch, less than about ⅛ inch or less than about 1/16 inch.

The illustrated angles are fire-rated components and include a fire-resistant material arranged to seal the head-of-wall gap at which the angle is installed. Preferably, the fire-resistant material is an intumescent material strip, such as an adhesive intumescent tape. The intumescent strip is made with a material that expands in response to elevated heat or fire to create a fire-blocking char. The kick-out can extend outwardly a distance greater than the thickness of the intumescent strip, a distance approximately equal to the thickness of the intumescent strip, or a distance less than the thickness of the intumescent strip. The size of the kick-out can be selected based on whether it is desirable for the wall board material to contact the kick-out (e.g., to create a seal or protect the intumescent strip), the intumescent strip, or both the kick-out and the intumescent strip.

The intumescent strip preferably is positioned on one or both of the side flange and the top flange. Thus, one embodiment of an angle includes an intumescent strip only on the top flange and another embodiment of an angle includes an intumescent strip only on the side flange. However, in the illustrated arrangements, the intumescent strip is attached on both the side flange and the top flange of the angle. Preferably, the intumescent strip covers a substantial entirety of the side flange and also extends beyond the top flange. That is, the intumescent strip preferably extends from the kick-out of the side flange to the top flange and beyond the top flange. Such an arrangement permits the intumescent strip to contact the ceiling or other overhead support structure to create an air seal at the head-of-wall. Preferably, the upper edge of the intumescent strip wraps around the corner of the angle and is attached to the top flange. Such an arrangement causes the intumescent strip to be pinched between the angle and the ceiling or other overhead support structure to assist in keeping the intumescent strip in place when exposed to elevated heat, which may cause failure of an adhesive that secures the intumescent strip to the angle, as described above. However, although less preferred, the upper edge of the intumescent strip could simply extend beyond (above, in the illustrated arrangement) the top flange without being attached to the top flange.

Preferably, a relatively small amount of the intumescent strip is positioned on the top flange relative to the amount positioned on the side flange. For example, the intumescent strip has a width, which in cross-section can be viewed as a length. Preferably, a length of the intumescent strip on the side flange is at least about 3 times the length of the intumescent strip on the top flange. In one arrangement, the length of the intumescent strip on the side flange is at least about 5 times the length of the intumescent strip on the top flange. In another arrangement, the length of the intumescent strip on the side flange is at least about 10 times the length of the intumescent strip on the top flange. Preferably, the length of the intumescent strip on the side flange is between about ½ inches and 1½ inches and the length of the intumescent strip on the top flange is between about ⅛ inches and ½ inches. In one preferred arrangement, the length of the intumescent strip on the side flange is about ¾ inches and the length of the intumescent strip on the top flange is about ¼ inches.

In the illustrated arrangements, the side flange of the angle is shorter than the flanges of the header track. The side flange of the angle can cover an upper portion of the slots of the header track. Preferably, at least a lower portion of the slots are exposed or left uncovered by the side flange of the angle. In one arrangement, the length of the side flange of the angle is about one-half of the length of the flanges of the header track. The side flange of the angle can have a length of between about ¾ inches and 3 inches, or between about 1 and 2 inches. In one arrangement, the side flange of the angle has a length of about 1½ inches or 1¼ inches. The flanges of the header track can be any suitable length. For example, the flanges can be between about 2 and 4 inches in length, with specific lengths of about 2½ inches, 3 inches, 3¼ inches and 3½ inches, among others.

The web of the header track can be any suitable width. For example, the web can have a width between about 2½ and 10 inches, with specific lengths of about 3.5 inches, 4 inches, 5.5 inches, 6 inches and 7.5 inches, among others. Preferably, the top flange of the angle is not wider than the web of the header track and, more preferably, is less than about ½ the width of the header track. If desired, a thermal break material can be positioned between any or all corresponding surfaces of the angle and the header track. The thermal break material can be applied to the inner surfaces of the angle. The thermal break material can be a liquid applied material, or an adhesively applied sheet membrane material to provide thermal break insulation to slow down heat passage during a fire. Any suitable insulating materials can be used.

The header track and the angle can be constructed of any suitable material by any suitable manufacturing process. For example, the header track and angle can be constructed from a rigid, deformable sheet of material, such as a galvanized light-gauge steel. However, other suitable materials can also be used. The header track and the angle can be formed by a roll-forming process. However, other suitable processes, such as bending (e.g., with a press brake machine), can also be used. Alternatively, the angle could be made from an extruded piece of material. Preferably, the intumescent strip is applied during the manufacturing process. However, in some applications, the intumescent strip could be applied after manufacturing (e.g., at the worksite).

As is known, in the wall assembly, one or more pieces of wallboard are attached to one or both sides of the studs by a plurality of suitable fasteners, such as drywall screws.

Preferably, the uppermost drywall screws are positioned close to the header track but spaced sufficiently therefrom so as to not inhibit complete upward movement of the studs relative to the header track.

Preferably, in a neutral or unloaded condition, the heads of the fasteners securing the studs to the header track are positioned below the lowermost ends, or free ends, of the side flanges of the angle. Preferably, in such a position, an upper end of the wallboard rests against the intumescent strip and/or the kick-out. When the wall is deflected such that the studs move upwardly towards or to a closed position of the deflection gap, the heads of the fasteners may enter in between the flanges of the header track and the side flanges of the angles. If the gap between the flanges is less than the width of the head of the fastener, the side flanges of the angle may flex or deflect outwardly to accommodate the heads of the fasteners. The shape and/or angle of the kick-out can facilitate the entry of the heads of the fasteners in between the flanges without getting hung up on the flanges.

FIGS. 17-20 illustrate an alternative angle piece 200 (FIGS. 17 and 18) and a head-of-wall assembly (FIGS. 19 and 20) incorporating the angle piece 200. The angle piece 200 possesses characteristics that are advantageous in certain applications relative to the above-described angle pieces 20 and the prior art arrangements. For example, the above-described angle pieces 20 position the intumescent strip 30 on an exterior surface of the angle piece 20 such that the intumescent strip 30 faces the wall board 50 in an assembled state. In such arrangements, it is usually beneficial for the intumescent strip 30 to cover a substantial portion of the vertical leg and/or a portion roughly equal to or greater than the maximum possible head-of-wall gap between the upper end of the wall board 50 and the ceiling 44. Such arrangements assist in maintaining a sealed head-of-wall gap in all deflection positions between the maximum head-of-wall gap (fully open position) and the minimum head-of-wall gap (fully closed position) and avoids damage to the intumescent strip 30 from the upper end of the wall board 50. That is, the upper end of the wall board 50 remains in contact with the outer surface of the intumescent strip 30 at all positions between the minimum and maximum head-of-wall gaps.

However, although such angles 20 and corresponding assemblies provide exemplary performance, the intumescent material used to construct the intumescent strips 30 is an expensive component of the angle piece assembly. Thus, it would be advantageous from a cost standpoint to reduce the amount of intumescent material used, while maintaining adequate performance or even improving performance. In addition, in some applications, it is often desirable to utilize a method other than the intumescent strip 30 to create or supplement the seal between the header track 42 and the ceiling 44. For example, the assembly of FIGS. 12 and 13 illustrates such an arrangement in which a fire spray material 112 is applied over an upper portion of the angle piece 20. Accordingly, in some such arrangements, it has been discovered by the present inventor(s) that the portion of the intumescent strip 30 on the horizontal leg 22 could be omitted. The angle piece 200 and corresponding assemblies of FIG. 17-20 advantageously reduce the amount of intumescent material employed while at the same time providing adequate or improved performance relative to the above-described angle pieces 20 and corresponding assemblies, as well as the prior art arrangements.

Figure 17:
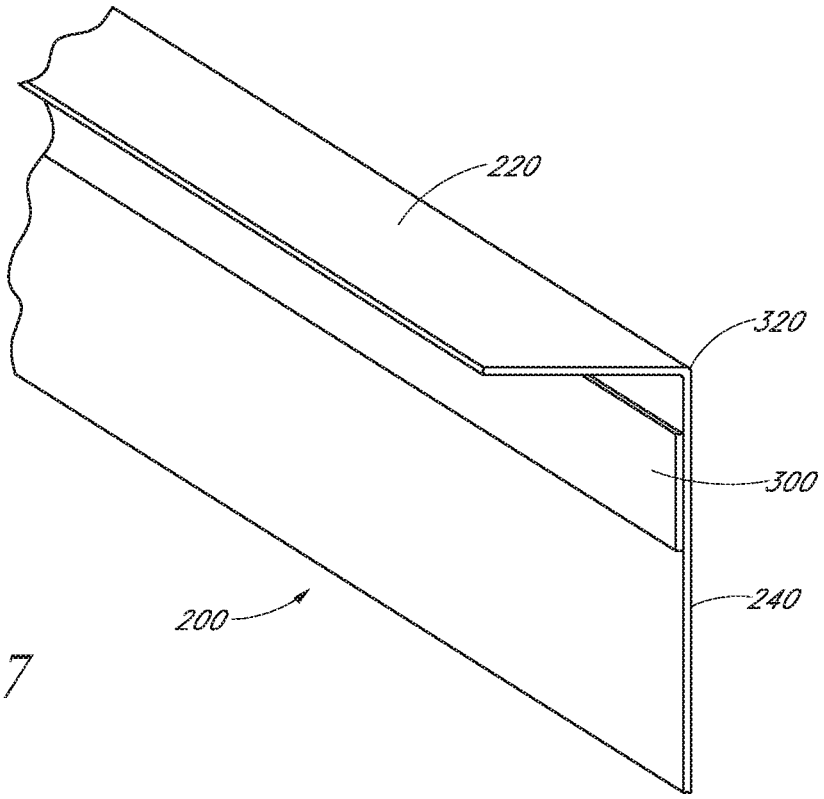
FIG. 17 is a perspective view of an alternative fire-rated angle piece in which the fire-retardant or intumescent material strip is positioned on the inside surface of the angle.
Figure 18:
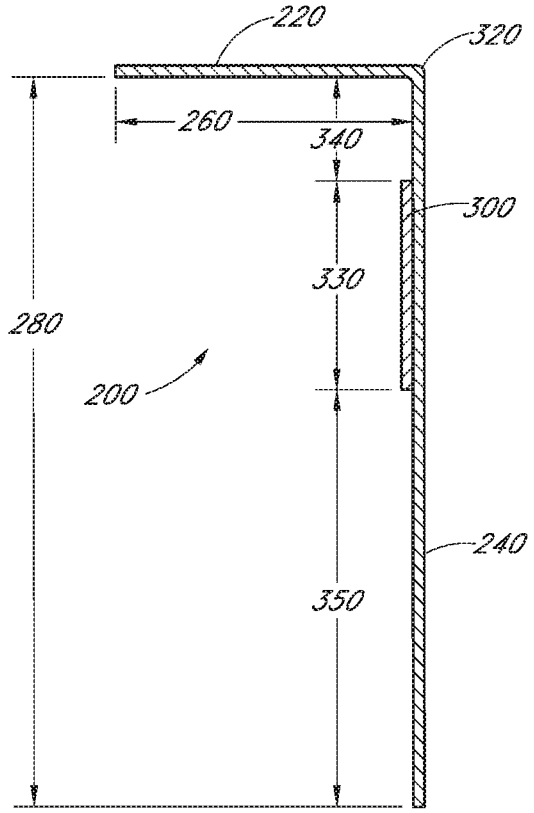
FIG. 18 is a cross-sectional view of the angle piece of FIG. 17.
Figure 19:
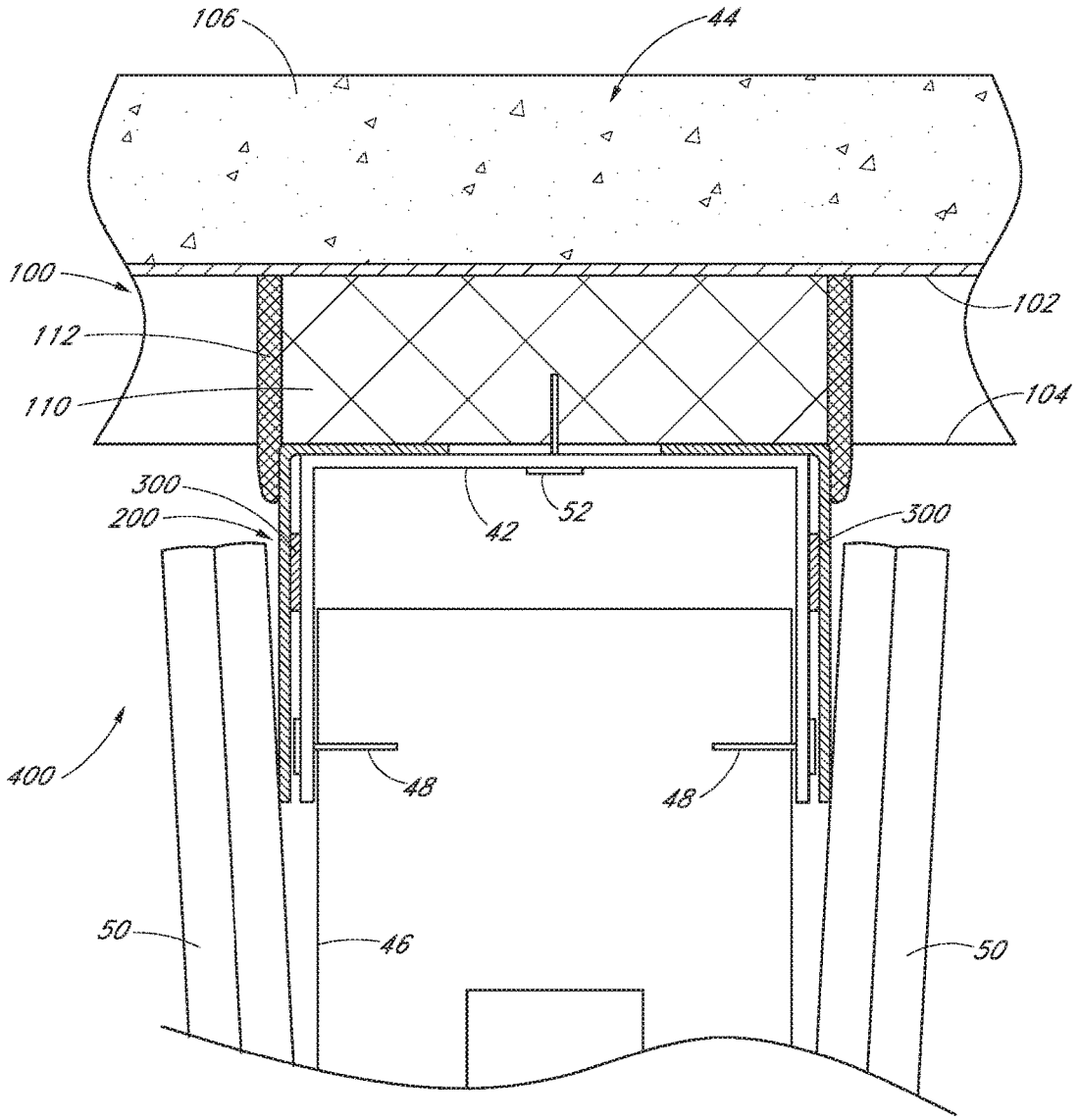
FIG. 19 is a cross-sectional view of a head-of-wall assembly incorporating the angle piece of FIG. 17.
Figure 20:
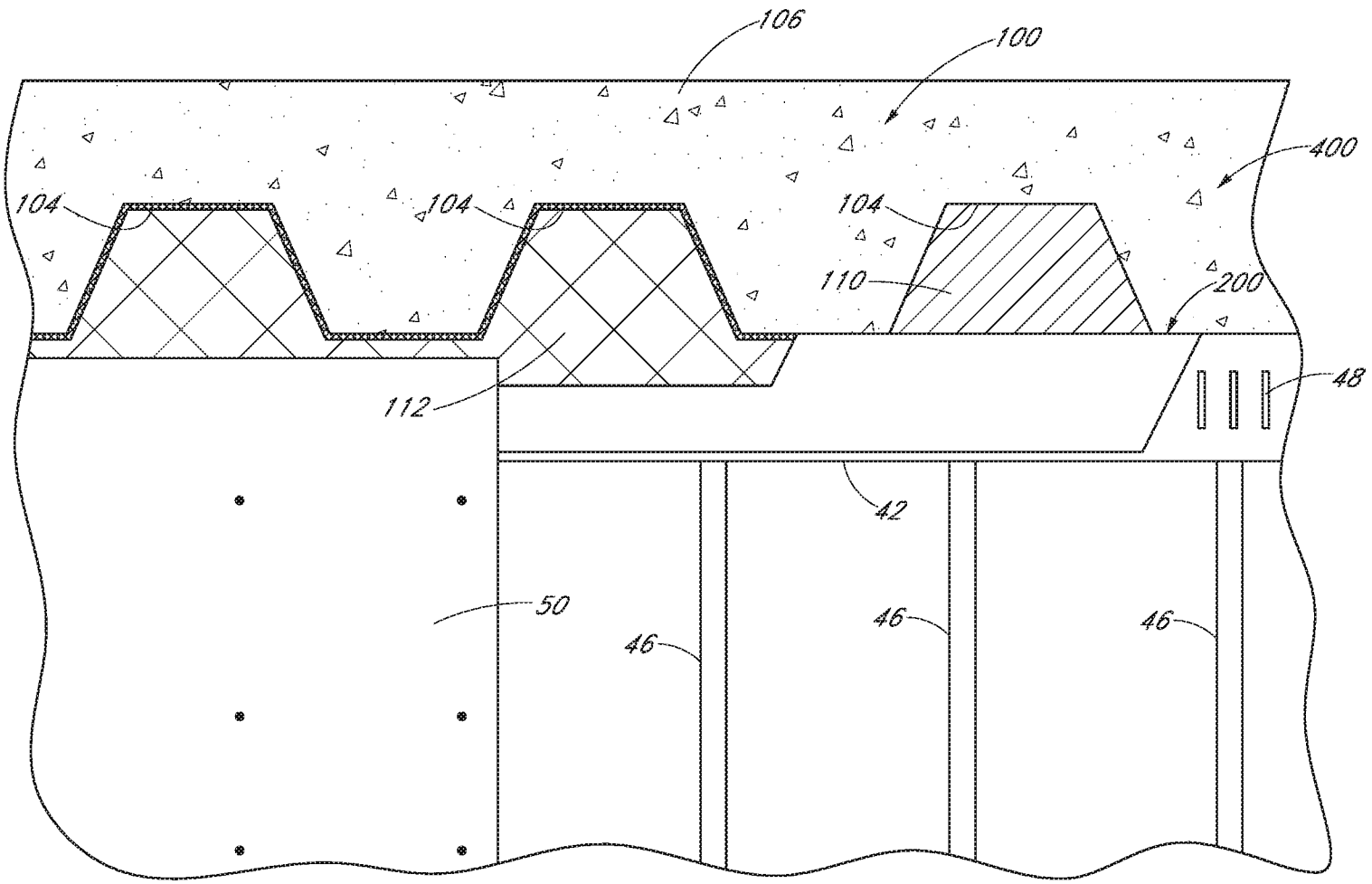
FIG. 20 is an elevation view of the head-of-wall assembly of FIG. 19, with several portions broken away to reveal underlying portions.

FIGS. 17-20 illustrate an embodiment of a fire-rated profile or angle piece 200, which is also referred to herein simply as an angle 200, alone (FIGS. 17 and 18) and incorporated into a head-of-wall assembly (FIGS. 19 and 20). The angle 200 preferably is formed from a light gauge steel material by any suitable process, such as roll forming or bending (such as on a press brake), for example. Preferably, the angle 200 is an elongated member having a consistent or substantially consistent cross-sectional shape throughout its length. One or more preferred embodiments of the angle 200 are generally or substantially L-shaped in cross-section. In one embodiment, the angle 200 may be between about 5 feet and 25 feet in length. The angle 200 can be between about 10 and 20 feet in length. Preferably, the angle 200 is about 10-12 feet in length to facilitate shipping and storage. Desirably, the angle 200 is sufficiently long to allow installation along a wall with a relatively small number of pieces. However, the length of the angle 200 should be short enough that shipping and material handling is relatively convenient. Accordingly, the above-recited lengths are presently preferred. However, other lengths may also be used in other situations.

Preferably, the angle 200 includes a top or upper wall portion or top or upper leg or flange 220. The upper wall portion 220 is also referred to herein as a horizontal leg because it is typically oriented in a horizontal or substantially horizontal plane when installed in a head-of-wall assembly, as described herein. The angle 200 also includes a side wall portion 240, which is also referred to herein as a vertical leg or flange because it is typically oriented in a vertical or substantially vertical plane when the angle 200 is installed in a head-of-wall assembly. The illustrated vertical leg 240 is unitarily formed with the horizontal leg 220. That is, the horizontal leg 220 and the vertical leg 240 are constructed from a single piece of material. As described above, typically, the single piece of material is a flat piece of light gauge steel, which is then deformed into the shape of the angle 200, such as through a roll-forming, bending (such as on a press brake) or other suitable process. However, in other embodiments, the angle 200 could initially be formed in the L-shape or other shape, such as by an extrusion process, for example. Preferably, both the horizontal leg 220 and the vertical leg 240 are substantially planar and define an angle therebetween of about 90 degrees. Although 90 degrees is preferred, in some arrangements, the angle could also be somewhat more or somewhat less than 90 degrees. For example, the legs 220 and 240 could define an angle of between about 80 degrees and about 90 degrees, between about 85 degrees and 90 degrees or about 87 degrees. This can assist in providing a gap at the upper end of the vertical leg 240 to accommodate a fastener head, as is described in greater detail below. Such dimensions of the angle between the legs 220 and 240 assume that the angle 200 is to be used with a header track (or other structure) that defines a generally 90 degree angle between the surfaces adjacent a corner (e.g., the web and flange). In alternative arrangements, the angle between the legs 220 and 240 can generally match the angle between the surfaces that will be adjacent the angle 200 once installed.

In one embodiment of the light gauge steel angle 200, the horizontal leg 220 can define a width 260 (i.e., horizontal cross-sectional dimension) of about ¾ inch or less, 1 inch or less, or 1½ inches or less. In one embodiment, the vertical leg 240 can define a width or height 280 (i.e., vertical cross-sectional dimension) between about 1 inch and about 4 inches or more depending on amount of fire and smoke protection desired and/or based on deflection requirements. Preferably, the height 280 is between about 2½ to about 3¼ inches. The dimension of the width of the horizontal leg 220 preferably is selected such that two angles 200 can be employed in a head-of-wall assembly (FIG. 19) with one angle 200 on each side of the wall. Preferably, the width of the horizontal leg 220 is selected such that the legs 220 of the two angles 200 do not overlap one another when assembled into the head-of-wall assembly. Accordingly, if the angle 200 is configured for use with a wall assembly that is wider than standard width, the width of the horizontal leg 220 can be increased to, for example, about 1½ inches to about 3 inches, or more. The width or height of the vertical leg 240 is selected such that the leg 240 fills the entire head-of-wall gap, or gap between the ceiling and upper end surfaces of the wall board, in an open-most position of the head-of-wall joint (assuming a dynamic joint). In addition, preferably, the width or height of the vertical leg 240 is selected to cover a substantial portion of the corresponding leg of the header track. For use with a dynamic joint, it is preferred that the leg 240 cover the fastener 48 (if any) in all positions between the open-most and the closed positions of the joint. Preferably, when used with a slotted header track, the leg 240 covers an entirety or a substantial entirety of the slots of the header track such that the head of the fastener 48 remains underneath the vertical leg 240 in all positions of the joint. In view of the above, the actual width or height of the vertical leg 240 can vary from the exemplary widths or heights described herein.

Preferably, a fire retardant material or a fire retardant material strip, such as an intumescent tape or intumescent strip 300, is adhesively (or otherwise) applied to the full length of the fire-rated angle 200. In a preferred arrangement, the intumescent strip 300 is positioned on an interior surface of the angle 200. Preferably, the intumescent strip 300 is positioned on an interior surface of the vertical leg 240 of the angle 200. In the illustrated arrangement, the intumescent strip 300 is spaced from a corner 320 of the angle 200 and also spaced from a free end of the vertical leg 240. That is, the intumescent strip 300 preferably is positioned in an intermediate portion of the interior surface of the vertical leg 240. In other arrangements, however, the intumescent tape 30 can extend along the entire height of the vertical leg 240. However, such an arrangement would require a large amount of intumescent material and would be more costly to manufacture.

The intumescent strip 300 has a strip width, which is a height or vertical dimension 330 as oriented in FIGS. 17-20. As discussed, preferably, the height 330 of the intumescent strip 300 is less than the height 280 of the vertical leg 240. Preferably, the height 330 of the intumescent strip 300 is less than one-half or, more preferably, is less than about one-third of the height 280 of the vertical leg 240. In one arrangement, the height 330 can be about one-seventh of the height 280. As described above, preferably, the intumescent strip 300 is spaced below the corner 320 of the angle 200 to define a spaced distance 340 between the upper end of the intumescent strip 300 and an upper end of the interior surface of the vertical leg 240. Furthermore, the intumescent strip 300 is also spaced above the free end of the vertical leg 240 to define a spaced distance 350 between the lower end of the intumescent strip and a lower end of the interior surface of the vertical leg 240. In the illustrated arrangement, the distance 340 is less than the distance 350. In other words, the intumescent strip 300 is positioned closer to the upper end of the vertical leg 240 than the lower end of the vertical leg 240. Such an arrangement advantageously permits expansion of the intumescent strip 300 in both upward and downward directions, while also avoiding contact between the fastener 48 and the intumescent strip 300 during at least a significant portion of the movement of the dynamic joint and, possibly, during the entire movement of the dynamic joint.

Preferably, the height 330 of the intumescent strip 300 is generally related to and can be varied with the amount of movement provided by the dynamic joint. That is, the larger the maximum movement allowed by the dynamic joint, the greater the height 330. For example, in some arrangements, the height 330 of the intumescent strip 300 is about one-half or less of the maximum movement allowed by the dynamic deflection joint. In some arrangements, the height 330 is approximately or exactly one-half of the maximum movement allowed by the dynamic joint. For a 1½ inch dynamic joint, the height of the intumescent strip 300 can be approximately ¾ inch. The distance 340 can be about one-half the height 330 of the intumescent strip 300 (e.g., ⅜ inch) and the distance 350 can be about twice the height 330 (e.g., 1½ inch). For larger or smaller dynamic joints, these dimensions can be scaled appropriately or the distance 340 can remain ⅜ inch or about one-half the height 330 and the other dimensions can vary as necessary. Thus, as described above, the angles 20 generally include an intumescent strip 30 that is at least as wide as the maximum dynamic joint movement; however, the preferred angles 200 can employ generally one-half the amount of intumescent material for the same dynamic joint thereby significantly lowering the manufacturing costs.

Preferably, as described above, the intumescent tape or strip 300 is constructed with a material that expands in response to elevated heat or fire to create a fire-blocking char. One suitable material is marketed as BlazeSeal™ from Rectorseal of Houston, Tex. Other suitable intumescent materials are available from 3M Corporation, Hilti Corporation, Specified Technologies, Inc., or Grace Construction Products. The intumescent material expands to many times its original size (e.g., up to 35 times or more) when exposed to sufficient heat (e.g., 350 degrees Fahrenheit). Thus, intumescent materials are commonly used as a fire block because the expanding material tends to fill gaps. Once expanded, the intumescent material is resistant to smoke, heat and fire and inhibits fire from passing through the head-of-wall joint or other wall joint. Thus, intumescent materials are preferred for many applications. However, other fire retardant materials can also be used. Therefore, the term intumescent strip 300 is used for convenience in the present specification and that the term is to be interpreted to cover other expandable or non-expandable fire-resistant materials as well, such as intumescent paints (e.g., spray-on), fiberglass wool (preferably with a binder, such as cured urea-phenolic resin) or fire-rated dry mix products, unless otherwise indicated. The intumescent strip 300 can have any suitable thickness that provides a sufficient volume of intumescent material to create an effective fire block for the particular application, while having small enough dimensions to be accommodated in a wall assembly. That is, preferably, the intumescent material strips 300 do not cause unsightly protrusions or humps in the wall from excessive build-up of material. In one arrangement, the thickness of the intumescent strip 300 is between about 1/16 (0.0625) inches and ⅛ (0.125) inches, or between about 0.065 inches and 0.090 inches. One preferred thickness is about 0.075 inches.

FIGS. 19 and 20 illustrate a wall assembly 400 similar to that shown in and described with reference to FIGS. 12 and 13, except the angle 20 is replaced by the angle 200 of FIGS. 17 and 18. Accordingly, the same reference numbers are used to describe the same or corresponding components of the wall assembly other than the angle 200. The wall assembly 400 can be constructed in the same manner as the wall assemblies 40 described above. In FIGS. 19 and 20, a metal stud framed wall assembly 400 is attached to a ceiling 44 in the form of a fluted pan deck 100. The fluted pan deck 100 includes a pan 102, which defines downwardly-opening spaces, voids or flutes 104, and a layer of concrete 106 supported by the pan 102. In the illustrated arrangement, the wall assembly 400 is oriented perpendicular or substantially perpendicular to the flutes 102 of the fluted pan deck 100. As described above, a fire-resistant material, such as mineral wool 110, typically is installed within the voids 104 of the fluted pan deck 100 when the wall assembly 400 is running perpendicular to the flutes 104. The voids or flutes 104 of a fluted pan deck 100 vary in size but generally are about 7½ inches by 3 inches. Mineral wool 110 is compressed and placed into these voids 104. The mineral wool 110 can be a mineral wool pillow marketed by Rectorseal or a mineral wool plug marketed under the trade name Delta Plug. The mineral wool pillow includes an intumescent material coating over the mineral wool material core and the entire pillow is encapsulated in a plastic outer lining.

A fire spray material 112 (e.g., a fire-resistant elastomeric material that can be applied with a sprayer) is then sprayed over the top of the mineral wool 110 to protect against smoke passage. The fire spray 112 will generally have elastomeric qualities to it for flexibility and in some cases may even have intumescent qualities. In traditional stuff and spray assemblies, the fire spray 112 will go over the mineral wool 110 and lap over the top edge of the wall board 50, for example, by about ½ inch. However, as described above, because the fire spray 112 extends over two dissimilar materials, i.e., the mineral wool 110 which is compressible and wall board (e.g., drywall) 50 which is rigid, a great deal of stress is created in the fire spray 112 covering the deflection gap as both materials will act differently as they are cycled up and down. The mineral wool 110 is flexible and will be more forgiving as it cycles, but the drywall 50 is rigid and will pull away from the mineral wool 110 and fire spray 112. Therefore, as these assemblies go through the movement cycle test of UL 2079, the fire spray tends to rip or tear along the joint between the drywall and the mineral wool. However, in the arrangement illustrated in FIGS. 19 and 20, it is apparent that the fire spray 112 only laps on the intumescent angle 200. The wall board (e.g., drywall) 50 is able to cycle unencumbered against intumescent angle 200 without stress cracks to the fire rated deflection joint. Such an arrangement is capable of providing a Class III Seismic movement joint according to UL 2079. FIG. 19 illustrates the wall in a position in which the upper edges of the wall board 50 are below the fire spray 112 and FIG. 20 shows a relatively more upward position of the wall board 50 in which the upper edge of the wall board 50 partially covers the fire spray 112. In FIG. 20, a portion of the wall board 50, fire spray 112 and angle 200 is removed to show the other components of the wall.

Advantageously, in the illustrated arrangement, the fire spray 112 (along with the mineral wool 110 in the flutes 104) creates a seal between the ceiling 44 and the angle 200. In addition, contact between an inner surface of the wall board 50 and the angle 200 creates a seal that inhibits or prevents the passage of air or smoke between the header track 42 and the wall board 50. That is, the vertical leg 240, as in the prior arrangements, is adjacent the header track 42. In this context, adjacent means that the wall board 50 is not interposed between the vertical leg 240 and the header track 42. However, in some arrangements, other materials or components may be positioned between the vertical leg 240 and the header track 42. In the illustrated arrangement, because the vertical leg 240 extends along a substantial length of the leg of the header track 42, there is a substantial distance of overlap between the wall board 50 and the angle 200, thereby enhancing the seal therebetween. In addition, preferably, the head portions of the fasteners 48 that secure the studs 46 to the header track 42 remain underneath the vertical leg 240 of the angle 200 in all positions between the minimum and maximum deflection joint positions. Thus, no kick-outs or other structures are necessary to allow entry of the fastener heads into the space between the angle 200 and the header track 42. Advantageously, this simplifies the construction of the angle 200 and, if desired, permits a brake press machine to be used in the place of a roll forming process thereby reducing tooling costs and, thus, reducing the final cost of the angle 200. As described above, with the illustrated arrangement, it is not necessary for the intumescent strip 300 to extend the entire height of the maximum deflection joint gap. Thus, less intumescent material can be used to further reduce the cost of the angle 200. Moreover, because contact is between the wall board 50 and the angle 200 (instead of the header track 42), the header track 42 can be configured for drift movement (e.g., movement in a longitudinal direction of the track 42) without a reduction in the performance of the head-of-wall seal.

Figure 22:
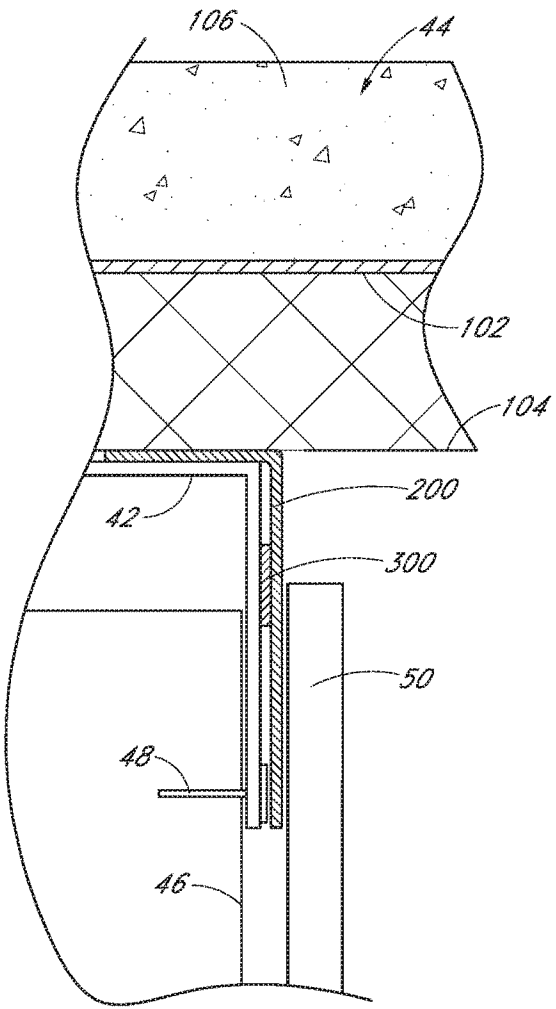
FIG. 22 is a cross-sectional partial representation of the head-of-wall assembly of FIG. 21 in an open position of the head-of-wall gap.
Figure 21:
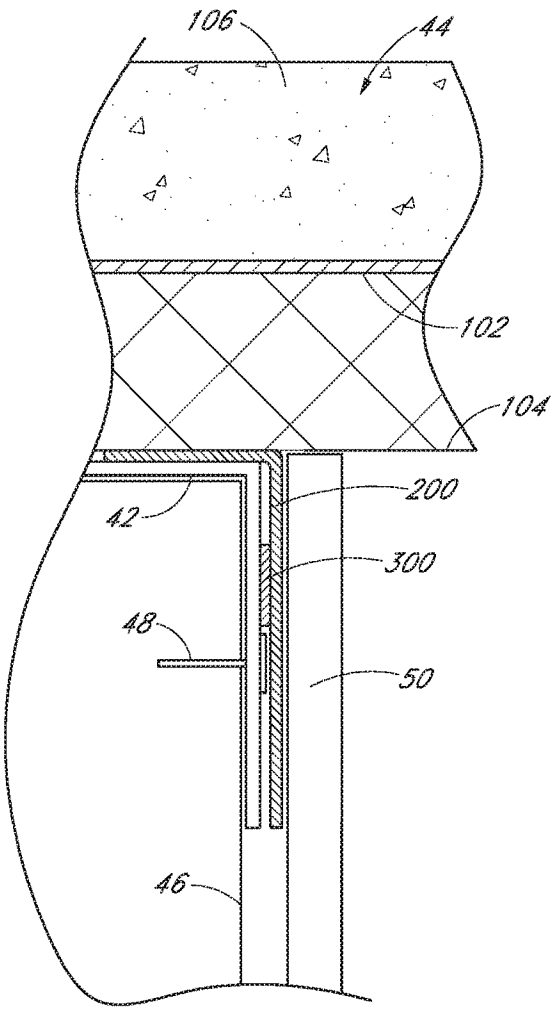
FIG. 21 is a cross-sectional partial representation of a head-of-wall assembly similar to that of FIGS. 19 and 20 in a closed position of the head-of-wall gap.

FIGS. 21 and 22 are schematic illustrations of the wall assembly 400 in two different positions of the deflection gap. FIG. 21 illustrates the wall assembly 400 in a relatively more closed position (i.e., smaller gap) compared to the relatively more open position (i.e., larger gap) shown in FIG. 22. Preferably, in each position, the head of the stud fastener 48 is underneath the vertical leg 240 of the angle 200. With respect to the positioning of the intumescent strip 300 on the angle 200, it is not necessary that the intumescent strip 300 is positioned high enough to avoid all contact with the head of the fasteners 48 in a closed position of the deflection joint (FIG. 21). The intumescent strip 300 is not relied upon for air/smoke sealing purposes, so even if minor damage is sustained at the location of each fastener head, performance will not be significantly impacted. In addition, under typical conditions, full closure of the dynamic deflection joint does not occur with great frequency.

Figure 23:
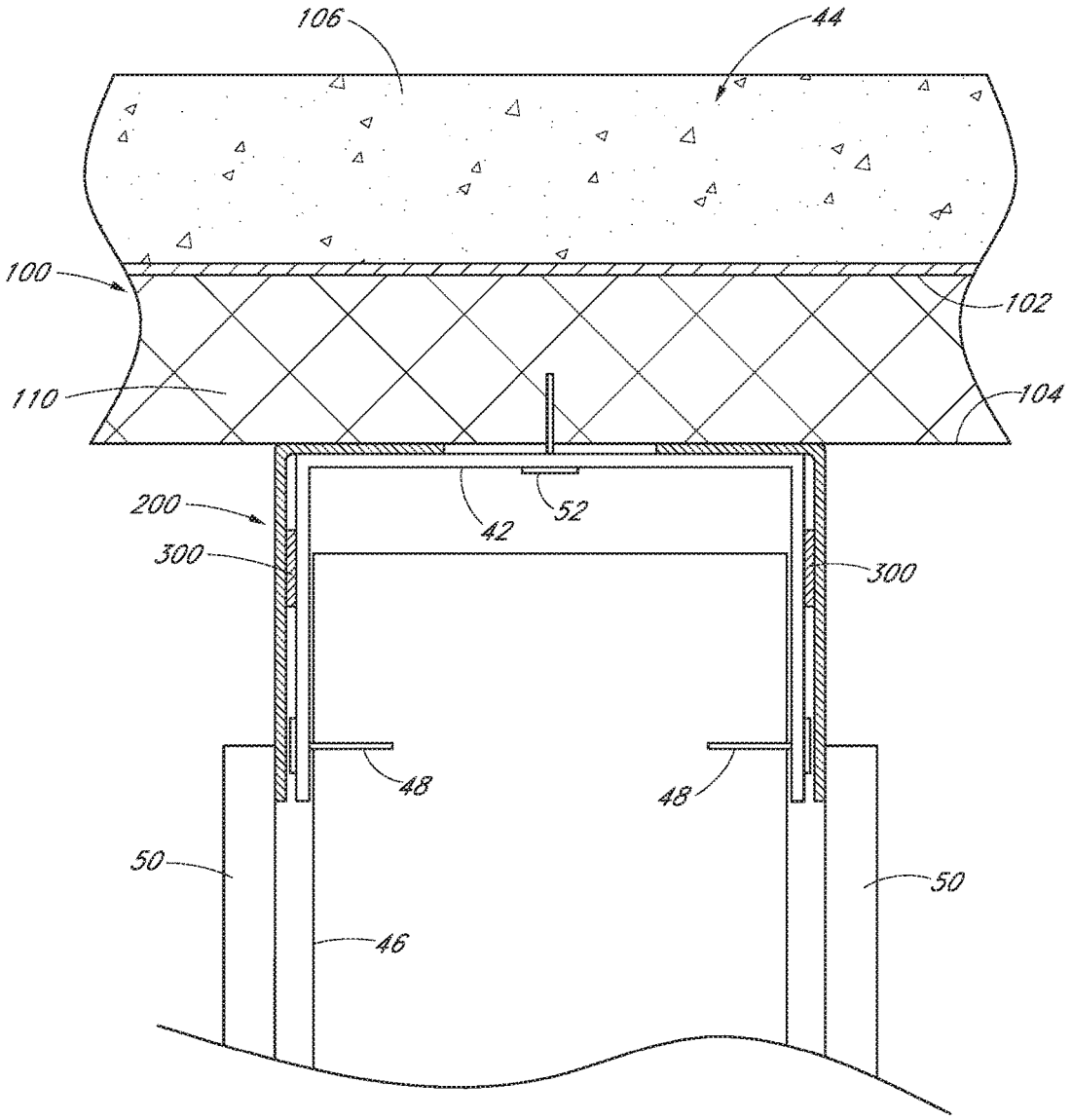
FIG. 23 is a cross-sectional partial representation of a head-of-wall assembly similar to that of FIGS. 19 and 20 prior to any significant expansion of the intumescent material.
Figure 24:
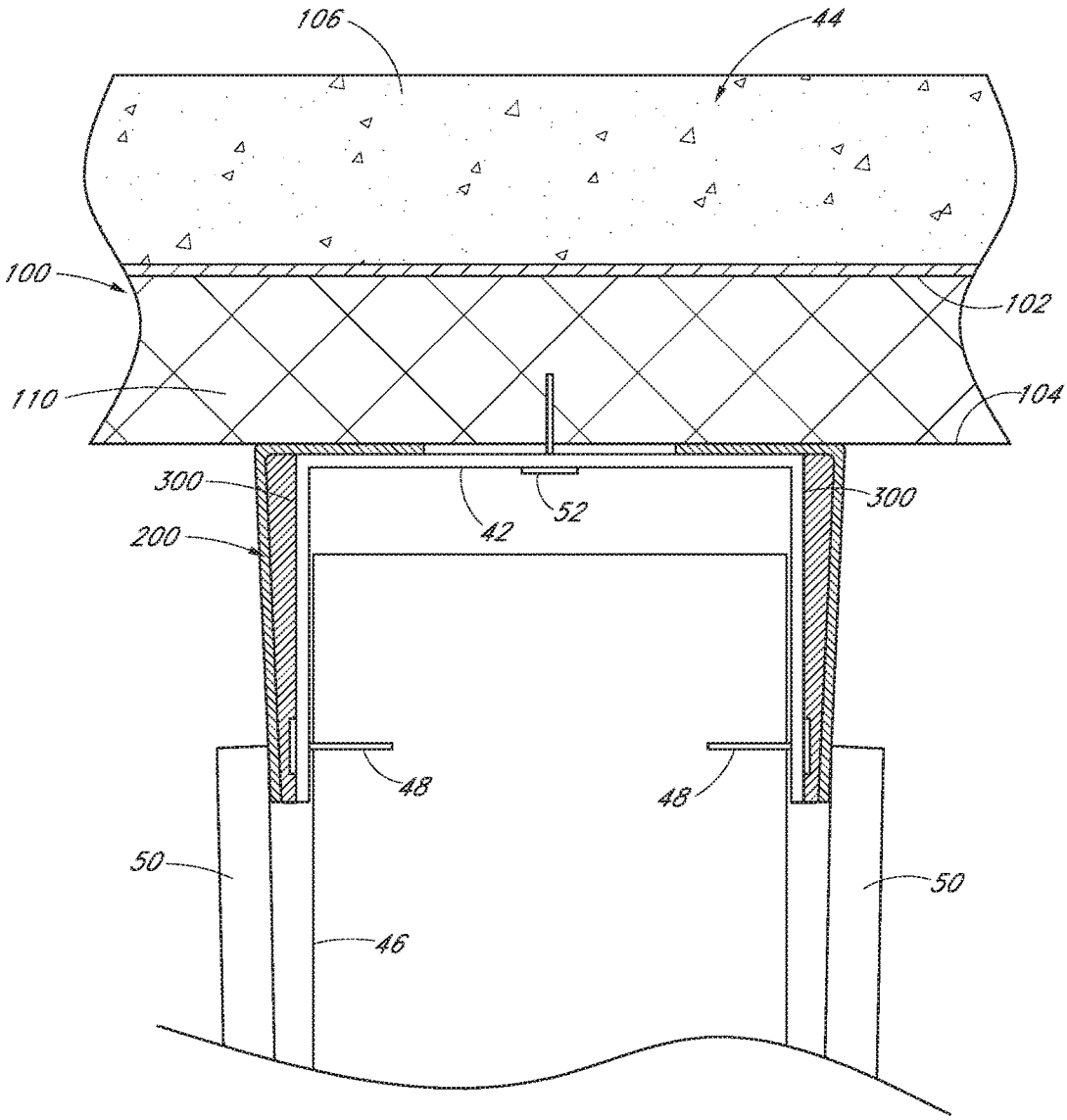
FIG. 24 is cross-sectional partial representation of the head-of-wall assembly of FIG. 23 after expansion of the intumescent material.

FIGS. 23 and 24 are schematic illustrations of the wall assembly 400 before and after expansion of the intumescent material strip 300, respectively. As illustrated, in FIG. 23, prior to any significant expansion of the intumescent material strip 300, the strip 300 is relatively thin and, preferably, positioned toward the upper end of the vertical leg 240 of the angle 200. Accordingly, the presence of the intumescent strip 300 does not cause unsightly bulging of the angle 200 or upper end of the wall board 50. In addition, preferably, the intumescent strip 300 is positioned out of the way of (e.g., above) the head portion of the stud fasteners 48 in many positions of the dynamic deflection joint such that relatively free movement of the deflection joint is permitted. FIG. 24 illustrates the wall assembly 400 after at least partial expansion of the intumescent strip 300. The intumescent strip 300 expands in a vertical direction to partially or completely fill the space between the vertical leg 240 of the angle and the header track 42. The expanded intumescent strip 300 may push the vertical leg 240 of the angle outwardly against the wall board 50 to assist in maintaining a seal between the wall board 50 and the angle 200. Preferably, the horizontal leg 220 is captured between the header track 42 and the ceiling 44 to, along with the fire spray 112 and the wall board 50 holding the lower end of the vertical leg 240, inhibit or prevent separation of the angle 200 from the header track 42 in response to the expansion of the intumescent strip 300. The expanded intumescent material 300 slows the transfer of heat through the head-of-wall gap or deflection joint.

Figure 25:
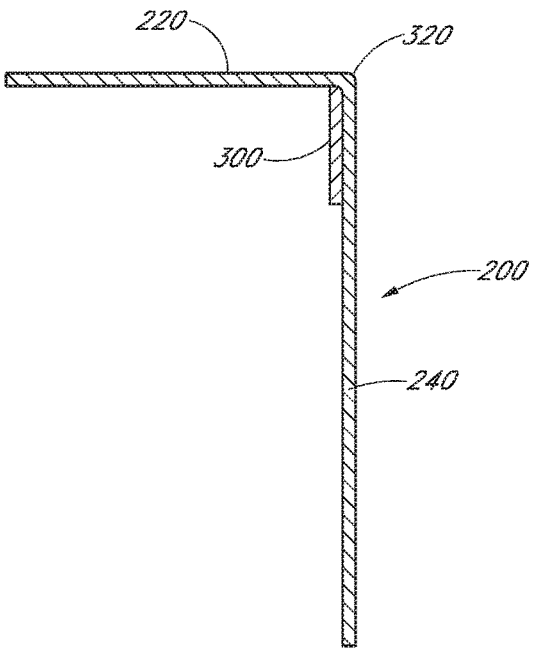
FIG. 25 is a cross-sectional view of an alternative angle piece that is similar to the angle piece of FIGS. 17 and 18.
Figure 26:
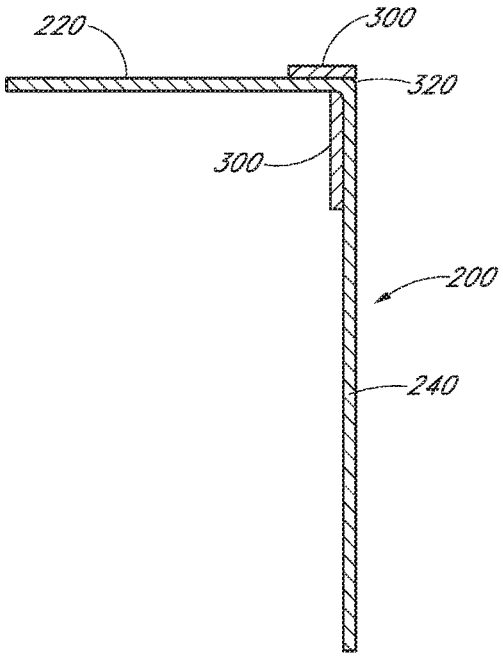
FIG. 26 is a cross-sectional view of another alternative angle piece that is similar to the angle piece of FIGS. 17 and 18.
Figure 27:
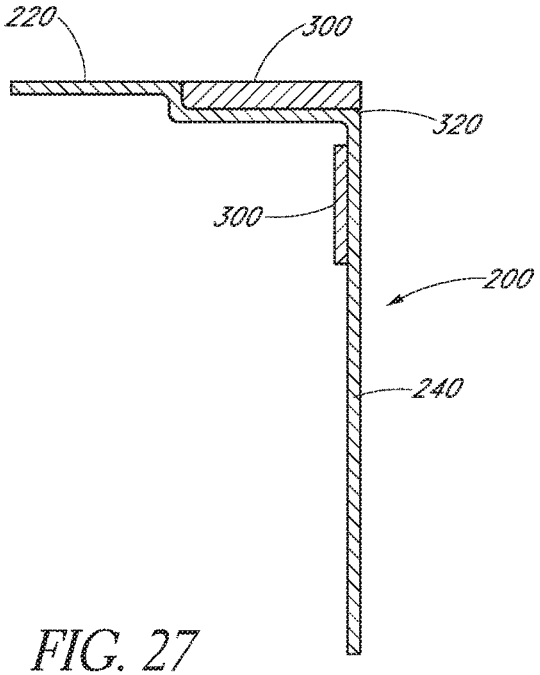
FIG. 27 is a cross-sectional view of yet another alternative angle piece that is similar to the angle piece of FIGS. 17 and 18.

FIGS. 25-27 illustrate alternative embodiments of the angle 200, which are similar to the angle 200 of FIGS. 17-24. Accordingly, the same reference numbers are utilized to indicate the same or corresponding components. In addition, for the sake of convenience, only the differences relative to the angle 200 are discussed. The angle 200 of FIG. 25 positions the intumescent strip 300 closer to the upper end of the vertical leg 240 and, in some arrangements, positions the intumescent strip 300 at the upper end of the vertical leg 240 such that the upper end of the intumescent strip 300 is adjacent the corner 320. In such an arrangement, the intumescent strip 300 is less likely to interfere with the movement of the stud fasteners 48. However, expansion of the intumescent strip 300 generally occurs only in the downward direction. Accordingly, the angle 200 of FIG. 25 is well-suited for use in smaller deflection joint applications. The angle 200 of FIG. 26 is similar to the angle 200 of FIG. 25 except that a second intumescent strip 300 is positioned on an exterior surface of the angle 200, preferably on an exterior surface of the horizontal leg 220. In the illustrated arrangement, the second intumescent strip 300 is positioned adjacent the corner 320 and has a width that is less than the width of the horizontal leg 220. However, in other arrangements, the second intumescent strip could extend the entire width of the horizontal leg 220 or could be positioned away from the corner 320, such as in an intermediate location or adjacent the free end of the horizontal leg 220. The second intumescent strip 300 can provide a seal or assist in providing a seal with the ceiling 44 and is especially well-suited for flat concrete deck applications or other applications where additional sealing or additional intumescent 300 is desired. The angle 200 of FIG. 27 is similar to the angle 200 of FIG. 26, except that the second intumescent strip 300 is positioned in a recess defined along an edge of the horizontal leg 220 near or adjacent the corner 320. Such an arrangement can facilitate insertion of the horizontal leg 220 between the header track 42 and the ceiling 44.

Figure 28:
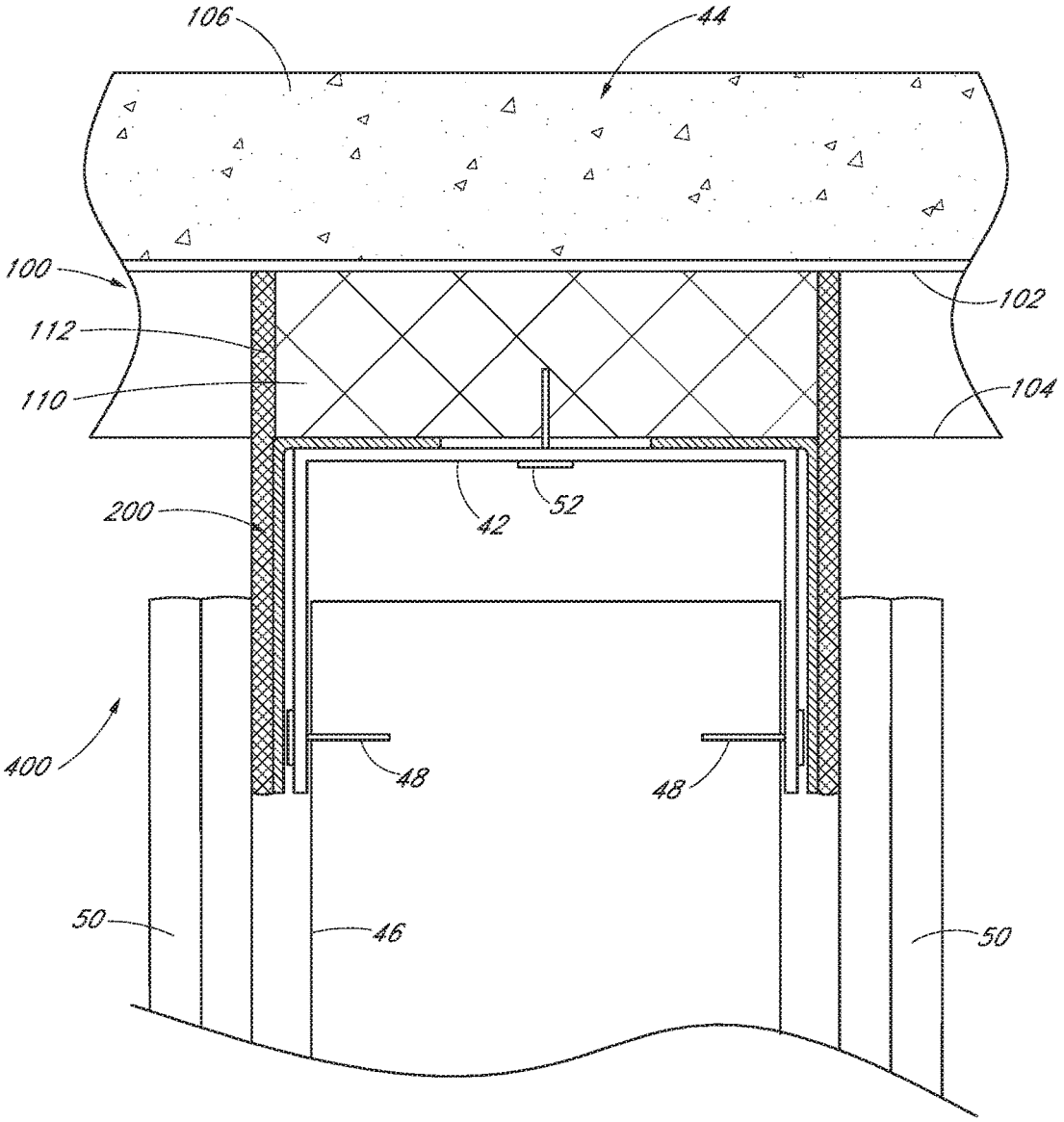
FIG. 28 is a cross-sectional view of a head-of-wall assembly incorporating an alternative angle piece that utilizes other fire-retardant materials in the place of an intumescent material strip secured directly to the angle piece.

FIG. 28 illustrates a wall assembly 400 similar to the wall assembly 400 of FIGS. 19-24. Accordingly, the same reference numbers are utilized to indicate the same or corresponding components. In addition, only differences relative to the wall assembly 400 of FIGS. 19-24 are discussed in detail. In the wall assembly 400 of FIG. 28, the angle 200 preferably does not incorporate an intumescent material strip 300. Rather, the wall assembly of FIG. 28 utilizes the concepts of creating an air/smoke seal with the angle 200 and fire spray 112. In the illustrated arrangement, the fire spray 112 extends along a substantial portion or along the entirety of the vertical leg 240 of the angle 200. However, the fire spray 112 could also extend only along the upper portion of the vertical leg 240. Preferably, a fire-retardant material, such as mineral wool, is positioned within the header track 42 and above the studs 46 to slow the transfer of heat through the deflection gap in a manner similar to the intumescent strip 30, 300 utilized in the above-described wall assemblies 40, 400. In an alternative arrangement, the angle 200 could be omitted and the fire spray 112 could be applied directly to the leg of the header track 42. Preferably, in such an arrangement, the side flange or leg of the header track 42 would incorporate a sealing structure, such as an elongated protrusion, to create a seal between the wall board 50 and the header track 42.

Figure 29:
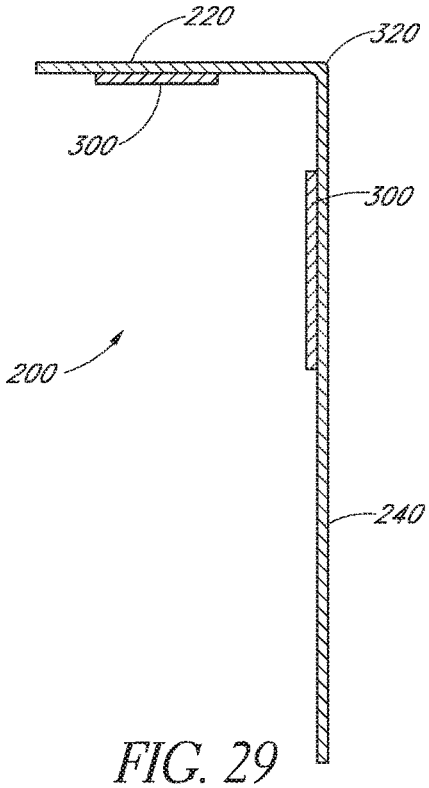
FIG. 29 is a cross-sectional view of yet another alternative angle piece that is similar to the angle piece of FIGS. 17 and 18.

FIG. 29 illustrates an alternative embodiment of the angle 200, which is similar to the angle 200 shown in FIGS. 17-27. Accordingly, the same reference numbers are utilized to indicate the same or corresponding components. In addition, for the sake of convenience, only the differences relative to the angle 200 are discussed. The angle 200 of FIG. 29 positions a first intumescent strip 300 on the vertical leg 240 and a second intumescent strip 300 on the horizontal leg 220. In such an arrangement, the intumescent strips 300 keep the entire angle 200 spaced away from the track 42 to further reduce heat transfer between the metal components. Additionally, using only strips of intumescent material instead of fully lining the inside surfaces of the angle 200 with intumescent material achieve the desired result at a low cost because the intumescent material is very expensive compared to metal. If desired, additional intumescent material or strips could be provided. For example, an intumescent material strip 300 could be positioned on an upper surface of the web 220, as shown in FIGS. 26 and 27. Such a strip 300 can provide a gasket function to seal a gap between the angle 200 and the ceiling 44, which can be caused by imperfections or irregularities of the ceiling 44 surface. That is, the ceiling 44 surface may not be completely flat or planar, as can be the case with poured concrete decks, for example. In addition, if only a sealing function is desired, the strip 300 may not be intumescent or expandable material. Moreover, other intumescent materials (e.g., paint) can be used in the place of the illustrated strips 300.

Figure 30:
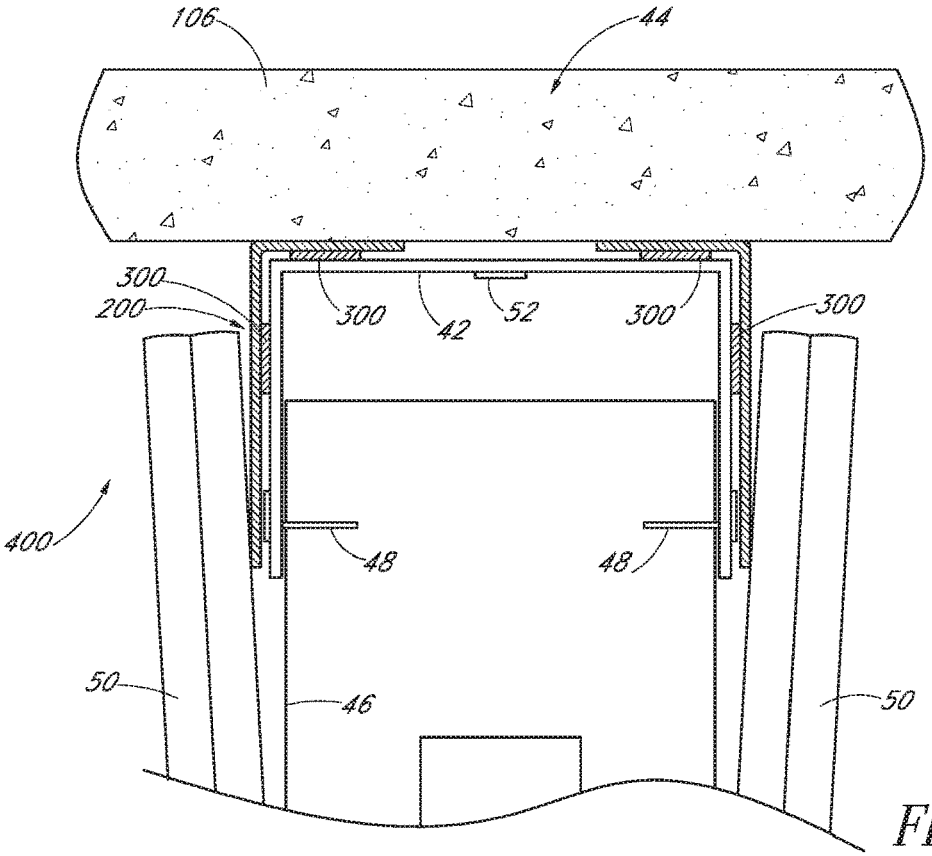
FIG. 30 is a cross-sectional view of a head-of-wall assembly incorporating an alternative angle piece that utilizes two strips of an intumescent material strip secured directly to the angle piece.

FIG. 30 illustrates a wall assembly 400 similar to the wall assembly 400 of FIGS. 19-24 and 28. Accordingly, the same reference numbers are utilized to indicate the same or corresponding components. In addition, only differences relative to the wall assembly 400 of FIGS. 19-24 and 28 are discussed in detail. In the wall assembly 400 of FIG. 30, the angle 200 incorporates two intumescent material strips 300, which preferably space the angle 200 from the header track 42 to create an insulation space (e.g., air space) therebetween.

As illustrated, the wall assembly 400 includes two angles 200. In some embodiments, the wall assembly 400 may include one angle 200 such as when the header track 42 is not a slotted header track.

Fire-Block Expansion Joint

Figure 31:
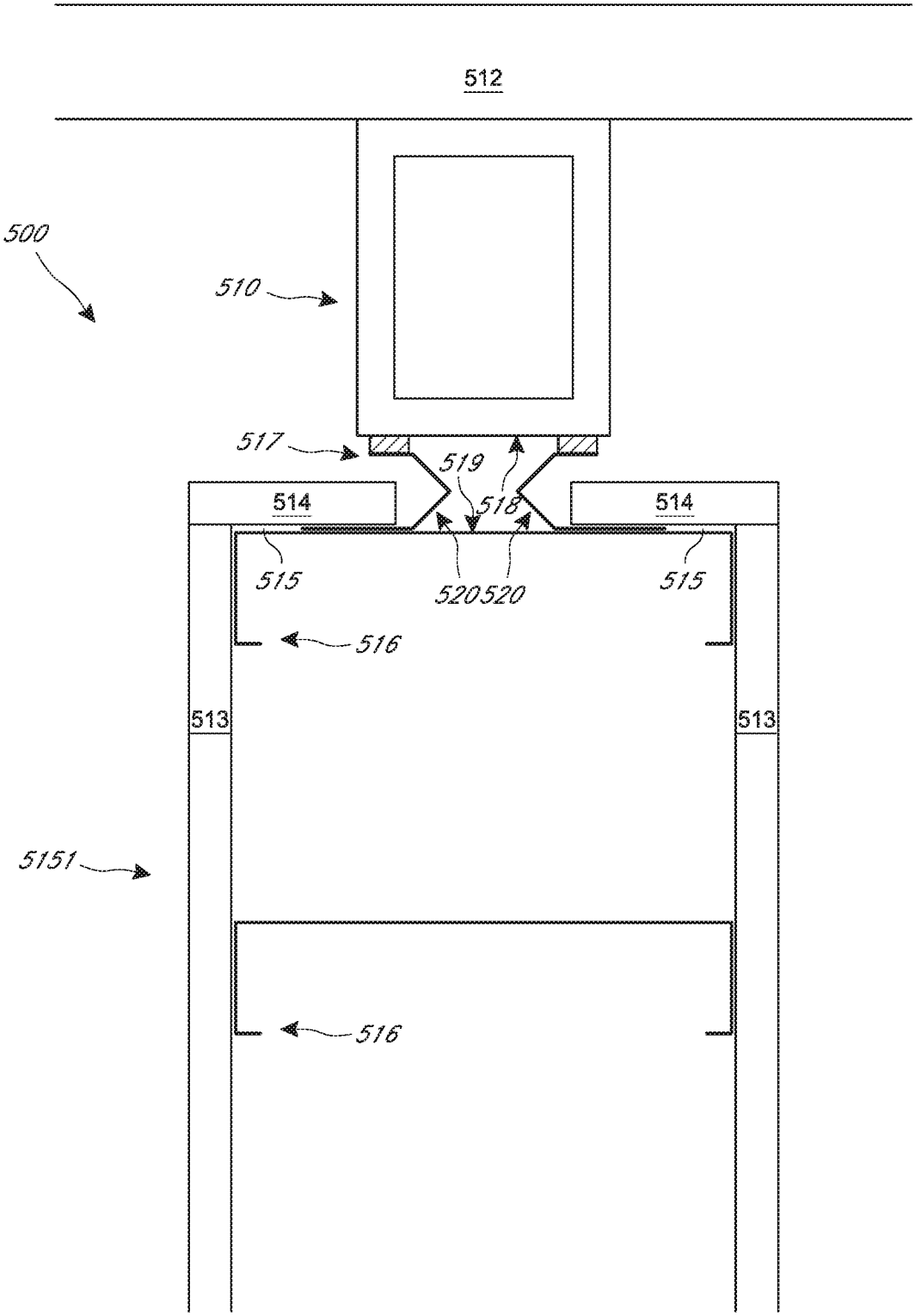
FIG. 31 is a top view of a fire-blocking drift joint assembly installed between a wall and a window mullion having certain features aspects and advantages of the present invention.

FIG. 31 illustrates a wall and window assembly incorporating an embodiment of a fire-blocking drift joint assembly 500 extending lengthwise in a vertical gap between a window mullion 510 and wall assembly 511. The fire-blocking drift joint assembly 500 may include a pair of fire-blocking drift elongate members or joints 520 installed between the window mullion 510 and the wall assembly 511. The drift joint assembly 500 is illustrative of one of the various possible applications of a fire-blocking drift joint. It can be appreciated by one of skill the art that many other types of architectural joints besides those between window mullions and walls could benefit from the advantages of the fire-blocking drift joints described herein. In the embodiment shown in FIG. 31, the wall assembly 511 comprises metal studs 516, footer and header tracks (not shown), and drywall panels 513 and 514. In some embodiments, wall assembly 511 could also be a wood-studded wall. In the embodiment shown in FIG. 31, the wall assembly 511 is wider than window mullion 510. The fire-blocking drift joints 520 may be used to create a fire-seal partition across the interface or gap 517 between the wall assembly 511 and the window mullion 510 despite the differences in width between the mullion 510 and the wall assembly 511.

Figure 32:
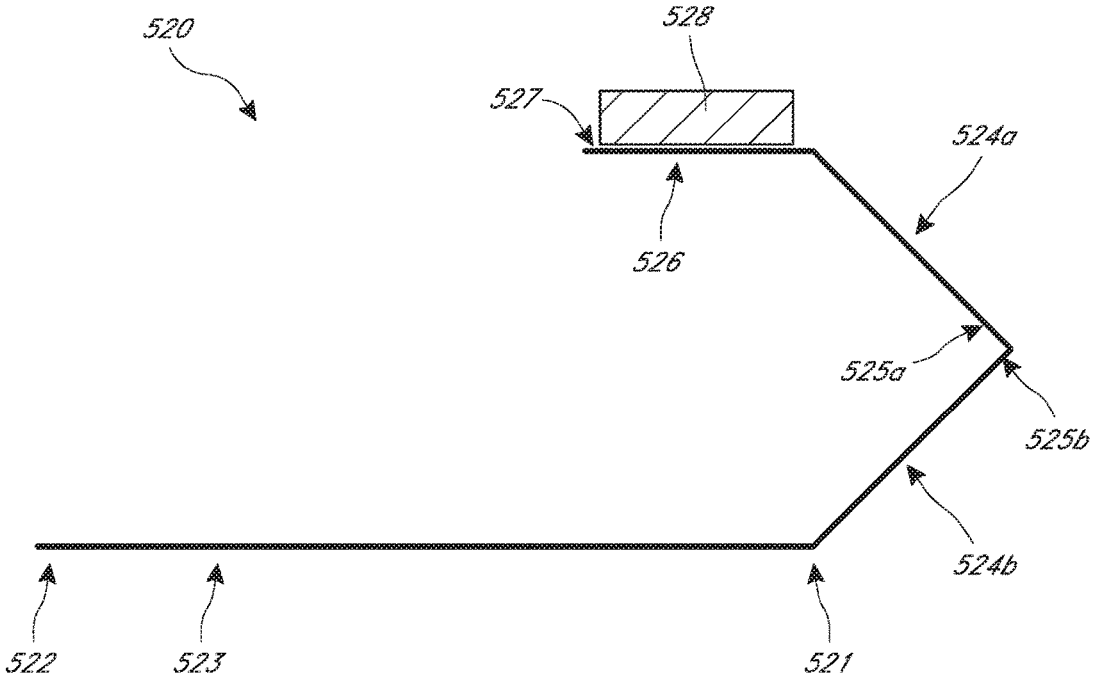
FIG. 32 is a profile view of a fire-blocking drift joint.

Additionally, window mullion 510 may be designed to allow for lateral, horizontal, or vertical drift movement or some combination of all three of these movements relative to the wall assembly 511. As discussed above, it is desirable to maintain a fire-seal partition from one side of the wall assembly 511 to the other side of the wall assembly 511. In order to maintain a cohesive fire-seal partition, the interface 517 should maintain the same fire-seal partition as the rest of the wall assembly 511 and the window mullion 510. Use of a fire-blocking drift joint 520, as described herein, can allow for movement between the window mullion 510 and the wall assembly 511 while maintaining a cohesive fire-seal partition across the interface 517. As illustrated in FIG. 31, window mullion 510 acts as an interface between the wall assembly 511 and a glass curtain 512. Because of the differences in movement between the wall assembly 511 and the window mullion 510 which is connected to the glass curtain 512, it is advantageous to allow for an interface 517 between the window mullion 510 and the wall assembly 511. However, to maintain a fire-seal partition from one side of wall assembly 511 to the opposite side of wall assembly 511 including the interface 517, one or more fire-blocking drift joints 520 may be used FIG. 32 illustrates an embodiment of the fire-blocking drift joint 520 of FIG. 31 shown in profile view. As illustrated, the fire-blocking drift joint 520 is comprised of a central body 521 having first end 522 and a second end 526. The central body 521 may be made from a light gauge flat piece of sheet steel, or other suitable metal or other material as described above. Alternatively, the central body 521 may be made from two pieces of light gauge flat sheet steel that are mechanically fastened together between the first end 522 and the second end 526, such as by Snap-On connections, interlocking hems, tongue and groove joints, or welding or by any other mechanical fastening means familiar to one of ordinary skill in the art.

With continued reference to FIG. 32, fire-blocking drift joint 520 further comprises a compressible section 524 between the ends 522 and 526. Compressible section 524 is designed as an elastic unit that may be compressed or extended and can exert a force to return to its neutral state. As described above, in some embodiments, the compressible section 524 may comprise legs 524*a* and 524*b* that come together to form an angle that may be V-shaped or U-shaped or any other profile that one of ordinary skill in the art would recognize as having the desirable elastic compressible properties. Compressible section 24 further has an exterior side 525*b* and interior side 525*a*. In some embodiments a fire retardant material (not shown) may be attached to either the exterior side 525*b* or the interior side 525*a* or both sides of compressible section 524. This fire retardant material may partially or completely cover one or both sides of the compressible section 524.

In some embodiments, the first end 522 and second end 526 of the fire-blocking drift joint 520 further includes an attachment flange 523 and a non-attachment flange 527, respectively. In the illustrated embodiment, the attachment flange 523 may be about 1½ inches long but the length of this flange can vary widely depending on the joint interface application. In some embodiments, flanges 523 and 527 are flat sections of sheet metal, but in other embodiments the flanges may be curved or bent to accommodate the geometry of prospective attachment surfaces. In some embodiments, the non-attachment flange 527 has a strip of compressible fire retardant material 528 facing outward so that the fire retardant material 528 can press against or contact non-attachment surfaces to maintain the fire partition seal. The fire retardant material 528 may be any type of fire retardant material, such as an intumescent tape or strip or intumescent paint or others as described herein.

With references to FIGS. 31 and 32, it can be seen that the drift joint 520 may be inserted into the interface 517. Drift joint 520 may be inserted into interface 517 in a compressed state with compressible section 524 in a compressed state. Alternatively, the drift joint 520 may be inserted in a neutral elastic state. Preferably, drift joint 520 is held in place in interface 517 in a compressed state. To this end, drift joint 520 may be sized to be placed into interface 517 in a compressed state whereby intumescent strip 528 and non-attachment flange 527 are pressed tightly against drift surface 518 of window mullion 510. The tight fit of the drift joint 520 within the interface 517 helps maintain the fire-seal partition. The drift joint 520 is then held in place by securing attachment flange 523 to the metal stud 16 of the wall assembly 511. In some installations, the first end 522 of the drift joint 520 is inserted into the gap 515 between the drywall 514 and the metal stud 516 and coupled via mechanical or adhesive fasteners to attachment surface 519 of metal stud 516. In this manner, the drift joint 520 may be secured to the wall assembly 511 while the non-attachment flange 527 is pressed tightly against drift surface 518 of window mullion 510. In some embodiments, when the mullion 510 moves laterally, the compressive force provided by the compressible section 524 presses the non-attachment flange 527 against the drift surface 518 of the mullion 510, even as the mullion 510 moves. In some embodiments, when the mullion 510 drifts vertically or horizontally relative to the wall assembly 511, the compressible section 524 presses the non-attachment flange 527 against the drift surface 518 and the end 526 slidingly engages drift surface 518. The fire-seal partition may thus be maintained across interface 517, despite the relative movement of the first and second structures.

In some embodiments, the intumescent strip 528 is on an exterior surface of the non-attachment flange 527 such that it is located between the drift surface 518 and the non-attachment flange 527 when installed. In other embodiments, the intumescent strip 528 may be attached to the end 526 but not directly in contact with drift surface 518 because of the curvature or bends in central body 521 optionally included in non-attachment flange 527.

Figure 33:
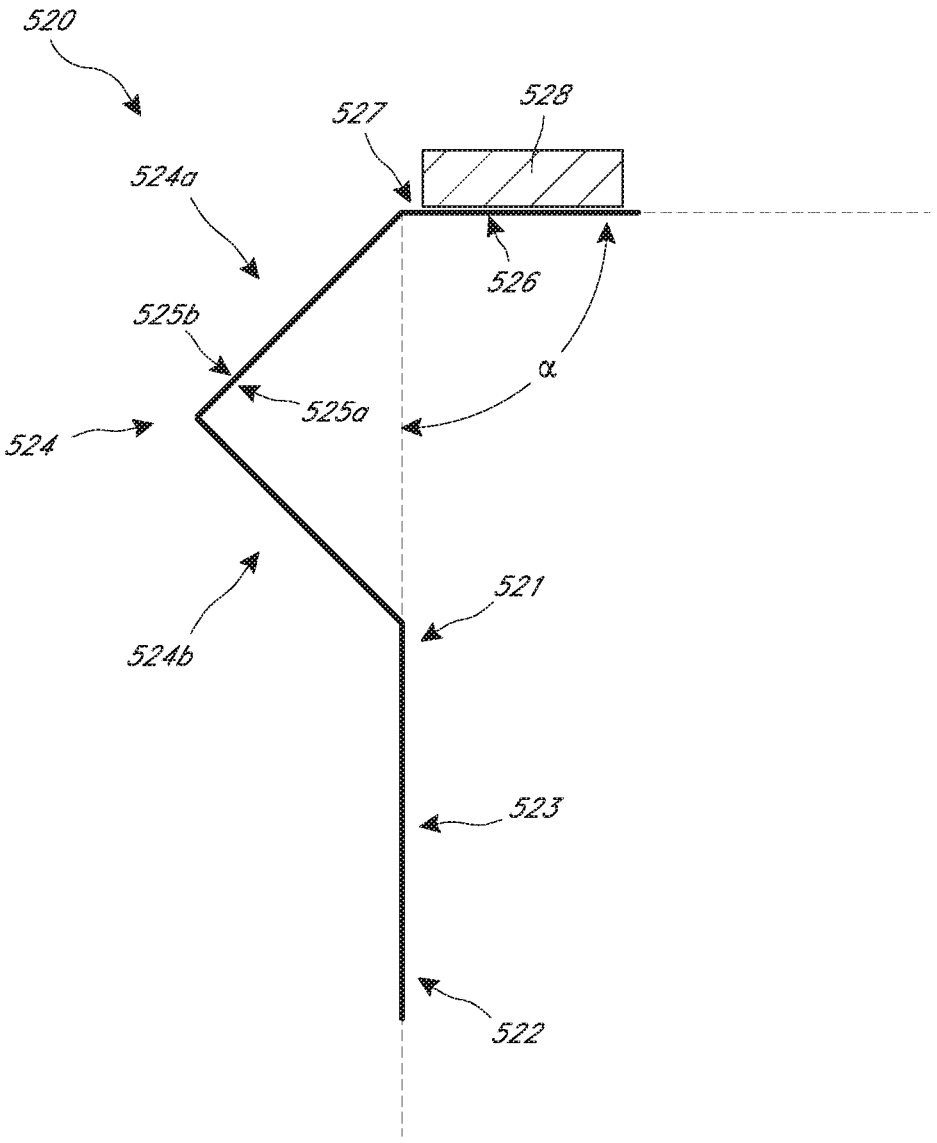
FIG. 33 is a profile view of a single-ply fire-blocking drift joint with attachment flange and non-attachment flange oriented 90° from each other.
Figure 34:
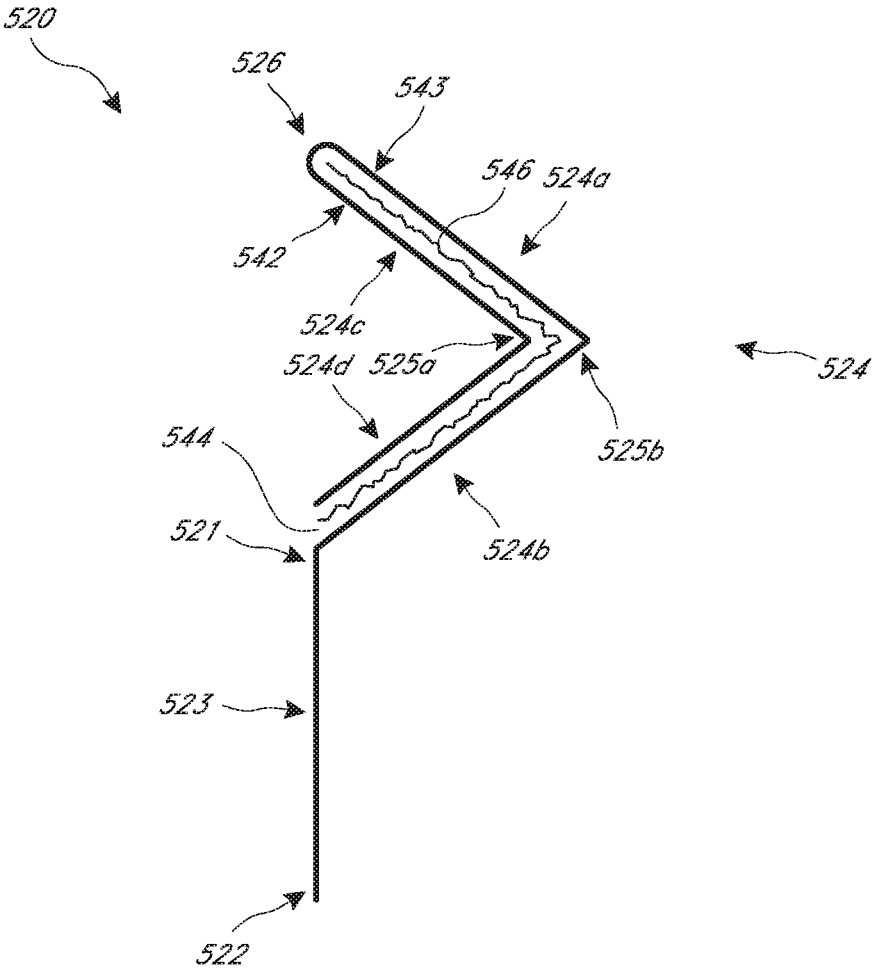
FIG. 34 is a profile view of a double-ply fire-blocking drift joint without a non-attachment flange.

FIG. 33 illustrates a profile view of another embodiment of a fire-blocking drift joint having an angle $\alpha$ between the non-attachment flange 527 and the attachment flange 523. FIG. 33 illustrates a fire blocking drift joint similar to that shown in and described with reference to FIG. 32. Accordingly, the same reference numbers are used to describe the same or corresponding components. This embodiment is designed to accommodate the geometry of different joint structures. In the embodiment shown in FIG. 33, the angle $\alpha$ is approximately 90°. Alternatively, angle $\alpha$ may be approximately 45°, approximately 60°, approximately 135°, approximately 180°, or any angle between 0° and 360°. One of ordinary skill in the art can appreciate that angle $\alpha$ is defined by the geometries of the surfaces of the first structure and the second structure. Attachment flange 523 or 527 may be set at any angle to accommodate the geometry of the joint interface. As an example, in FIG. 31, attachment flange 523 is parallel to attachment surface 519 to make mechanical attachment simple and non-attachment flange 527 is parallel to drift surface 518 to ensure that the intumescent strip 528 is pressed firmly against the drift surface 518 of the mullion 510 to maintain the fire-seal partition across interface 517. As another example, non-attachment flange 527 and attachment flange 523 may be approximately parallel as shown in FIG. 32. In other embodiments, as shown in FIG. 34, the second end 526 may not include a flat non-attachment flange. Attachment flange 523 may be set at any angle relative to the non-attachment flange 527 to accommodate the geometry of the joint interface.

FIG. 34 illustrates a profile view of an embodiment of a fire-blocking drift joint in the form of a double ply drift joint. FIG. 34 illustrates a fire blocking drift joint similar to that shown in and described with reference to FIG. 32. Accordingly, the same reference numbers are used to describe the same or corresponding components. In this embodiment, the central body 521 is bent back against itself and doubled over to create a double ply compressible section 524 having an interior-facing wall or layer 542 and an exterior-facing wall or layer 543 separated by a space 544. In this embodiment, the compressible section may have four legs 524*a*-524*d* that come together in pairs to form angles that may be V-shaped or U-shaped, or even a combination of the two different shapes. In some embodiments, the space 544 may be filled with a fire-retardant material 546, such as intumescent strips or other fire-retardant materials. Alternatively, fire retardant material 546 may be attached to sheet 542 on interior-facing surface 525*a* of the compressible section 524 or sheet 543 on exterior-facing surface 525*b* of the compressible section 524.

Furthermore, in the embodiment shown in FIG. 34, the second end 526 does not include a flat non-attachment flange 527 as shown in FIGS. 31-33. In this embodiment, second end 526 is pressed against or contacts a moving surface, such as drift surface 518 in FIG. 31, to allow vertical, horizontal and lateral movement between a first structure and a second structure. Alternatively, the fire-blocking drift joint 520 in FIG. 34 can optionally include a flat non-attachment flange similar to non-attachment flange 527 as shown in FIGS. 31-33 and FIG. 35.

Figure 35:
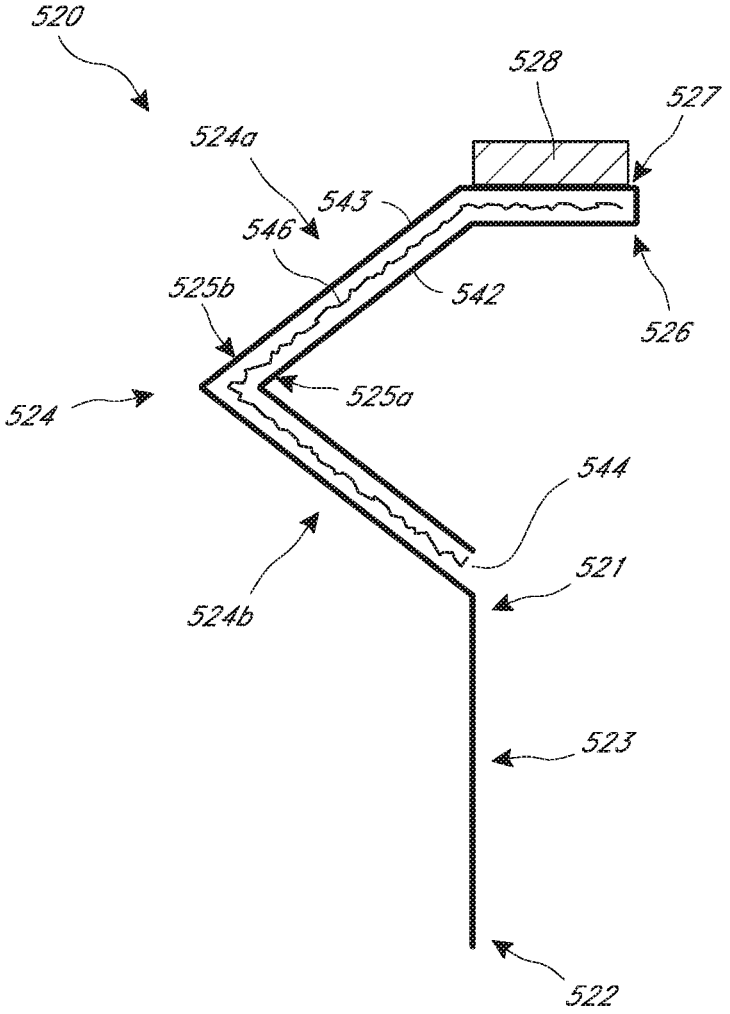
FIG. 35 is a profile view of a double-ply fire-blocking drift joint with an intumescent strip and fire retardant material attached to the compressible section.

FIG. 35 illustrates an embodiment of a fire-blocking drift joint in the form of a double ply fire-blocking drift joint with second end 26 and a non-attachment flange 27. FIG. 35 illustrates a fire blocking drift joint similar to that shown in and described with reference to FIG. 32. Accordingly, the same reference numbers are used to describe the same or corresponding components. In this embodiment, the central body 521 is bent back against itself and doubled over to create a double ply compressible section 524 having an interior-facing sheet 542 and an exterior-facing sheet 543 separated by a space 544. In some embodiments, the space 544 may be filled with a fire-retardant material 546, such as intumescent strips or other fire-retardant materials. Alternatively, fire retardant material 546 may be attached to sheet 542 on interior-facing surface 525*a* of the compressible section 524 or sheet 543 on exterior-facing surface 525*b* of the compressible section 524. Alternatively, in some embodiments, central body 521 may consist of two sheets of light gauge steel that are mechanically attached either at second end 526 or elsewhere between second end 526 and first end 522. This attachment may be by any suitable mechanical means such as those discussed above.

Figure 36:
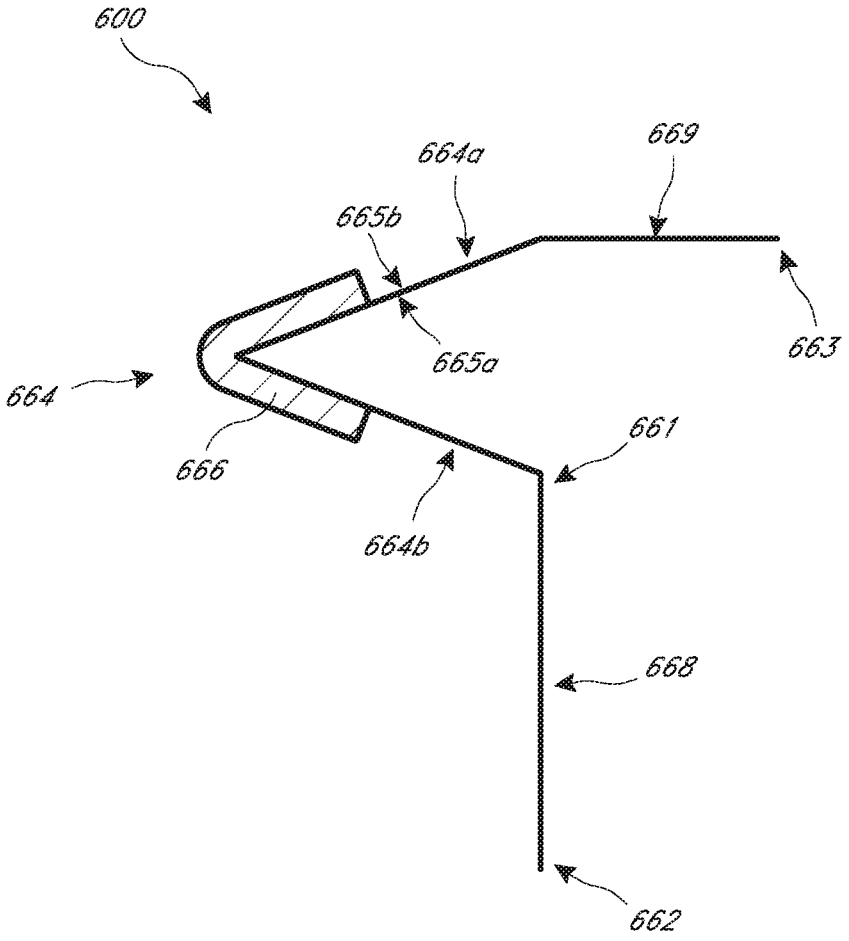
FIG. 36 is a profile view of a fire-block expansion joint having two attachment flanges.

FIG. 36 illustrates an embodiment of a profile view of an fire-block expansion joint 600 having a central body 661 and first and second ends 662 and 663, attachment flanges 668 and 669, and compressible section 664. Each of the elements described in the foregoing embodiments of the fire-blocking drift joints shown in FIGS. 31-35 may be also be optionally incorporated into the embodiments of the fire-block expansion joints illustrated in FIGS. 36-38 and described herein. As shown in FIG. 36, attachment flanges 668 and 669 are preferably flat and 1½ to 3 inches long, but the length of this flange can vary depending on the joint interface application. Alternatively, attachment flanges 668 and 669 may be curved or otherwise bent to accommodate the geometry of the prospective mounting surfaces to first and second structures as would be understood by one of ordinary skill in the art. Attachment flanges 668 and 669 may also be prepared to receive mechanical fasteners as herein described by being pre-slotted or punctured. In some embodiments, attachment flanges 668 and 669 include a strip of compressible fire retardant material, such as intumescent strips or tape. The fire-retardant material preferably faces outward so that the fire retardant material can press against or contact the attachment surfaces to maintain the fire partition seal. The central body 661 is preferably made from a single sheet of a light gauge flat piece of sheet steel or other suitable metal or other material as described above.

With continued reference to FIG. 36, the fire-blocking expansion joint 600 further comprises a compressible section 664 between the ends 663 and 662. Compressible section 664 is designed as an elastic unit that may be compressed or extended and can exert a force to return to its neutral state. As described above, in some embodiments, the compressible section 664 may comprise legs 664*a* and 664*b* that come together to form an angle that may be either V-shaped or U-shaped or any other profile that one of ordinary skill in the art would recognize as having the desirable elastic compressible properties.

In some embodiments, fire retardant material 666 may be attached to expansion joint 600 as an additional fire-blocking mechanism. As illustrated in FIG. 36, fire retardant material 666 is mounted to the exterior surface 665*b* of compressible section 664. Alternatively, the fire retardant material 666 may be mounted to the interior surface 665*a* of compressible section 664, or to both interior and exterior surfaces 665*a* and 665*b*. In some embodiments, fire retardant material 666 may extend to cover the length of both legs forming the compressible section 664, or, as shown in the embodiment of FIG. 36, may cover only a portion of compressible section 664.

Figure 37:
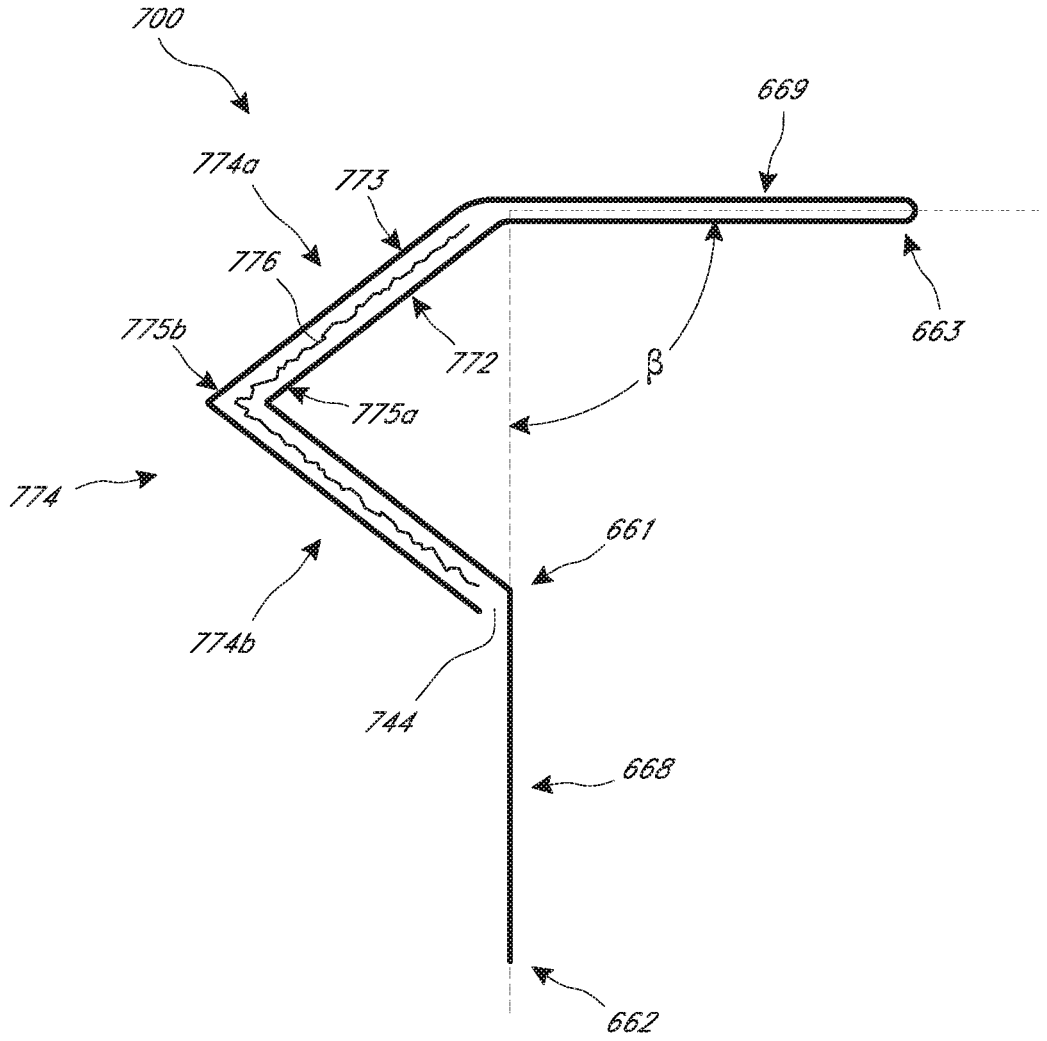
FIG. 37 is a profile view of a double-ply fire-block expansion joint having two attachment flanges.

FIG. 37 illustrates a profile view of a double ply fire-block expansion joint 70 with two ends 662 and 663 and two attachment flanges 668 and 669. FIG. 37 illustrates a fire blocking drift joint similar to that shown in and described with reference to FIG. 36. Accordingly, the same reference numbers are used to describe the same or corresponding components. The double ply compressible section 774 is made from a single sheet of light gauge steel bent over itself to form an exterior layer 773 and an interior layer 772. Alternatively, as described above with respect to central body 521, central body 661 may similarly comprise two pieces of metal mechanically fastened together. In the embodiment shown in FIG. 37, the exterior layer 773 extends the length of compressible section 774. The exterior layer 773 may optionally extend the full length of the joint 700 to the end 662. Alternatively, exterior layer 773 may extend partially through the length of compressible section 774. A space 744 may be created between exterior layer 773 and interior layer 772. Fire retardant material 776 may optionally be used to fill the space 744. In the embodiment shown in FIG. 37, the entirety of space 744 within compressible section 774 is filled with fire retardant material 776. Optionally, fire retardant material 776 may partially fill space 744. Alternatively, fire retardant material can be used in space 744 between exterior layer 773 and interior layer 772 and may also be applied within the space between the two layers forming the attachment flange 669 or at any point between exterior layer 773 and interior layer 772 depending on the length of the two-ply section of the joint 70.

With continuing reference to FIG. 37, the fire retardant material 776 may be any type of intumescent material such as intumescent tape or strips or intumescent paint. The fire retardant material 776 may be installed on the interior surface 775*a* of the compressible section 774 or may be installed on the exterior surface 775*b*, or on both surfaces 775*a* and 775*b*.

In some embodiments, attachment flanges 668 and 669 can be flat metal extensions. They may also be bent or curved to more closely match surfaces of the first and second structures to which they will be mounted. Additionally, attachment flanges 668 and 669 may optionally be prepared to receive mechanical fasteners such as those described above.

As shown in FIG. 37, attachment flange 668 is single ply or a single layer. Alternatively, the central body 661 may be bent such that exterior layer 773 extends partially onto or across attachment flange 668, thus making it a double ply attachment flange similar to the attachment flange 669 shown in FIG. 37. Alternatively, attachment flange 669 may be single ply and attachment flange 668 may be double ply.

With continuing reference to FIG. 37, fire-blocking expansion joint 700 may include an angle β between attachment flanges 668 and 669. As shown in FIG. 37 the angle β is approximately 90°. However one of ordinary skill in the art could also appreciate that this angle can be varied to accommodate diverse geometries of prospective mounting surfaces on different first and second structures as described above with respect to FIGS. 31-35. As an example, attachment flange 668 may be approximately parallel to attachment flange 669.

Figure 38:
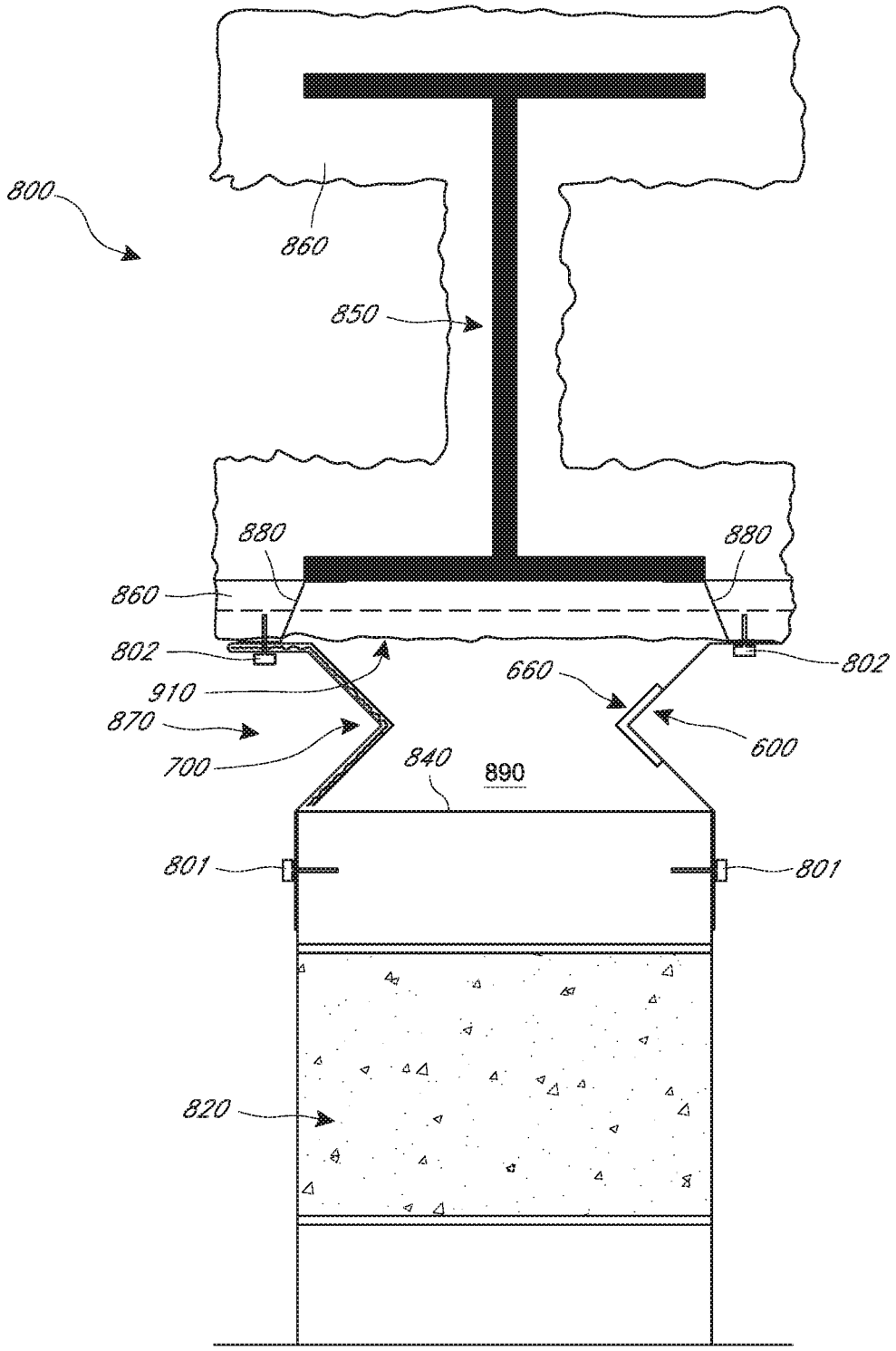
FIG. 38 is an side header block assembly view of a fire-block expansion joint installed between a CMU concrete block wall and an I-beam sprayed with fireproofing material.

FIG. 38 illustrates a header block assembly 800 including two fire-block expansion joints 600, 700 installed within a horizontal head-of-wall gap between a CMU concrete block wall 820 and a ceiling I-beam 850 sprayed with fireproofing material 860. As shown in FIG. 38, fire-block expansion joints 600 and 700 are installed across interface 870 between header block 840 attached to the CMU concrete block wall 820 and I-beam 850. The illustrated assembly allows for lateral movement between the concrete block wall 820 and I-beam 850 while maintaining a fire seal partition across interface 870. The fire-block expansion joints may be any of the embodiments discussed above in FIGS. 31-37. As illustrated joint 700 may be similar to the two-ply joint shown in FIG. 37 and the joint 600 may be similar to the joint shown in FIG. 36. In other embodiments, two of the same fire-blocking joints may be used to seal the interface 870.

On the CMU side, fire-block expansion joints 600 and 700 may be mechanically fastened, such as by fastening units 801, to header 840 through the attachment flange 668. On the I-beam side, I-beam 850 is covered in fireproofing insulation 860. In this illustrative embodiment, to connect fire-block expansion joints 600 and 700 at their second ends through the attachment flanges, Z furring 880 is installed on I-beam 850 by means of mechanical fasteners such as clips or other fastener as is generally known by those of ordinary skill in the art. This allows I-beam 850 to be uniformly coated with fireproofing insulation 860 and still be connected to fire-block expansion joints 600 and 700. Alternatively, the attachment flange is either connected directly to I-beam 850 or to insulation 860 at surface 910 through mechanical means or adhesives as described herein.

As illustrated in the assembly view of FIG. 38, fire retardant material 660 may optionally be applied to the interior side of brackets facing interior space 890, as discussed above with reference to FIG. 36. The fire retardant material 660 may be factory installed or installed by hand onto the surface of expansion joint 600. In the header block assembly view shown in FIG. 38, the fire retardant material 660 would not be visible from the exterior side of the assembly. Alternatively fire retardant material 660 may be applied to the exterior side of expansion joint 600, or be applied to both the interior and exterior sides of the fire block expansion joints.

In some embodiments, expansion joints 700 and 600 may be sized such that when they are inserted into interface 870 they are, alternatively, already in compression, already in extended states, or in neutral states. As shown in FIG. 38, expansion joint 700 is mechanically attached on both ends to header block 840 and to I-beam 850. Similarly, expansion joint 600 is attached to header block 840 and I-beam 850 by attachment through the first and second ends. Installing expansion joint 600 or expansion joint 700 across interface 870 allows for independent lateral (compressive) movement between CMU concrete block 820 and I-beam 850. Any such lateral movement will either compress or extend the compressible sections of expansion joints 700 and 600. Despite this lateral movement, expansion joints 600 and 700 preferably maintain the fire-seal partition across interface 870 because each joint is mechanically fastened on each end to the I-beam 850 and the header block 840. Additionally, expansion joints 600 and 700 may also allow for small amount of drift motion (horizontal or vertical) between I-beam 850 and CMU concrete block 820. The compressible sections of both expansion joints 600 and 700 may be designed to allow for some amount of horizontal and vertical drift motion between I-beam 850 and concrete block wall 820 without the attachment flanges pulling away or detaching from their mounting surfaces.

Fire-Rated Angles and Straps

Figure 39:
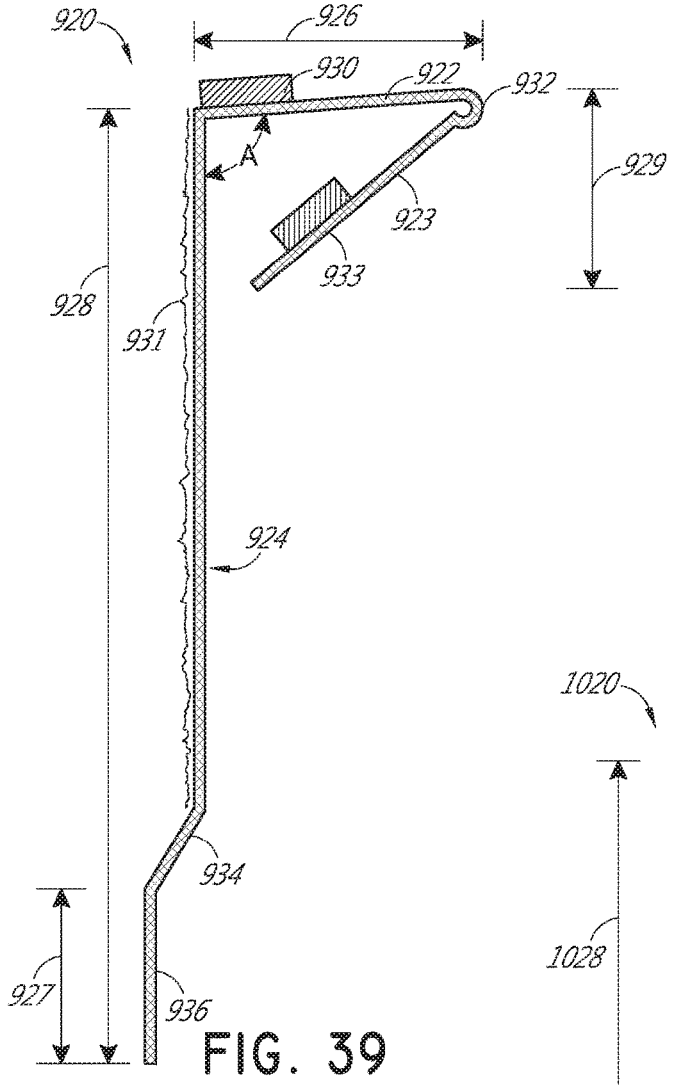
FIG. 39 is a cross-sectional view of a fire-rated angle piece, which incorporates a fire-resistant or intumescent strip.
Figure 41:
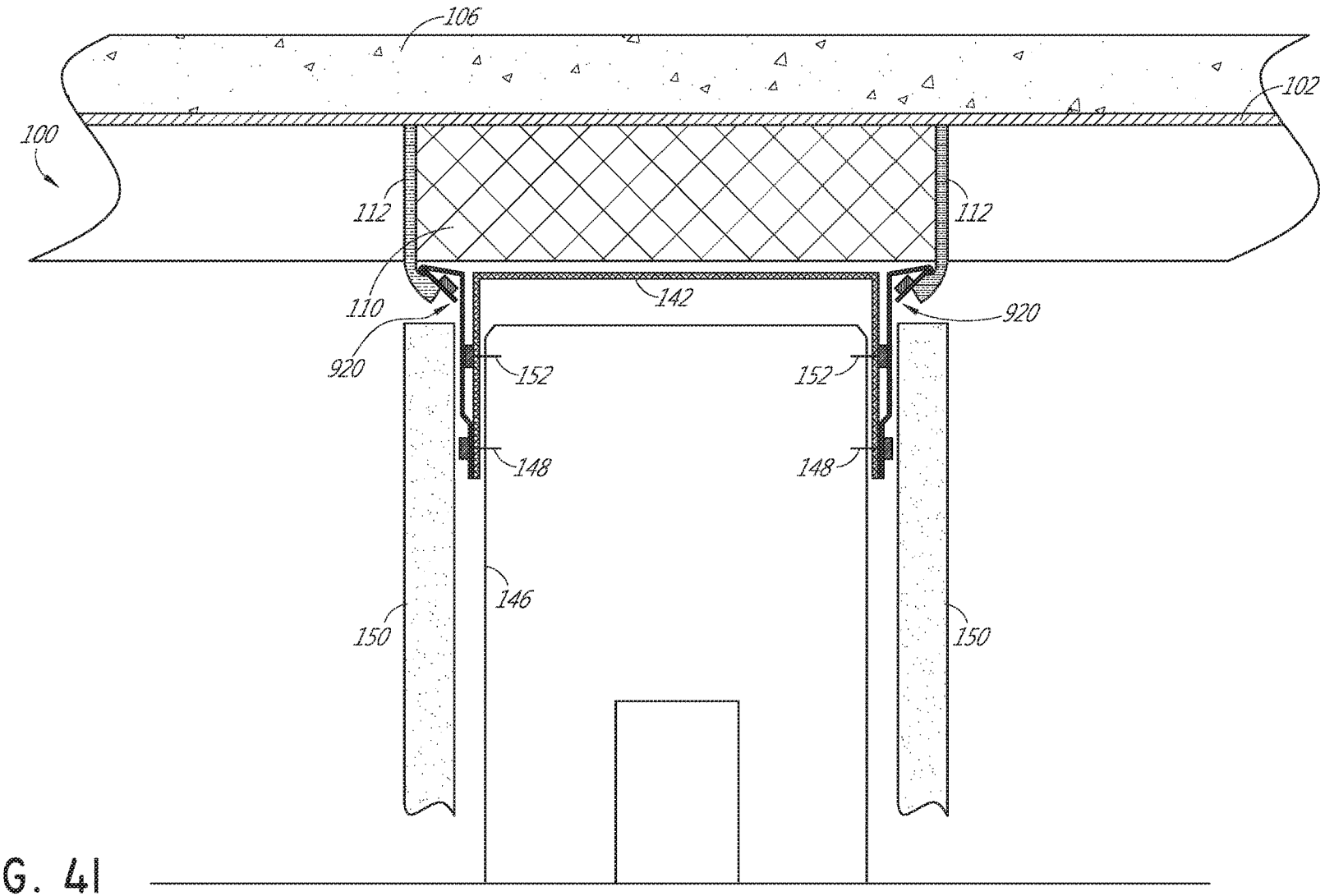
FIG. 41 is a cross-sectional view of a head-of-wall assembly incorporating another embodiment of the fire-rated angle piece.

FIG. 39 illustrates an embodiment of a fire-rated profile or angle piece 920, which is also referred to herein simply as an angle 920, alone (FIG. 39) and incorporated into a head-of-wall assembly (FIG. 41). The angle 920 preferably is formed from a light gauge steel material by any suitable process, such as roll forming, for example. Preferably, the angle 920 is an elongated member having a consistent or substantially consistent cross-sectional shape throughout its length. In some embodiments, the angle 920 may be made from vinyl or other material. One or more preferred embodiments of the angle 920 are generally or substantially L-shaped in cross-section. In one embodiment, the angle 920 may be between about 5 feet and 25 feet in length. The angle 920 can be between about 10 and 20 feet in length. Preferably, the angle 920 is about 10-12 feet in length to facilitate shipping and storage. Desirably, the angle 920 is sufficiently long to allow installation along a wall with a relatively small number of pieces. However, the length of the angle 920 should be short enough that shipping and material handling is relatively convenient. Accordingly, the above-recited lengths are presently preferred. However, other lengths may also be used in other situations.

Preferably, the angle 920 includes a top or upper wall portion or top or upper leg or flange 922. The upper all portion 922 is also referred to herein as a horizontal leg because it is typically oriented in a horizontal or substantially horizontal plane when installed in a head-of-wall assembly, as described herein. The angle 920 also includes a side wall portion 924, which is also referred to herein as a vertical leg or flange because it is typically oriented in a vertical or substantially vertical plane when the angle 920 is installed in a head-of-wall assembly. The illustrated vertical leg 924 is unitarily formed with the horizontal leg 922. That is, the horizontal leg 922 and the vertical leg 924 are constructed from a single piece of material. As described above, typically, the single piece of material is a flat piece of light gauge steel, which is then deformed into the shape of the angle 920, such as through a roll-forming, bending (such as on a press brake) or other suitable process. Preferably, both the horizontal leg 922 and the vertical leg 924 are substantially planar and define an angle A therebetween of about 90 degrees or, in some arrangements, slightly more than 90 degrees. For example, the legs 922 and 924 may define an angle of between about 80 degrees and about 100 degrees, between about 85 degrees and 97 degrees or about 95 degrees. This can assist in providing a gap at the upper end of the vertical leg 924 to accommodate a fastener head, as is described in greater detail below.

In one embodiment of the angle 920, the horizontal leg 922 can define a width 926 (i.e., horizontal cross-sectional dimension) of about ½ inch or less, ¾ inch or less, or 1 inch or less. Preferably, the horizontal leg 922 is about ½ inch wide. The vertical leg 924 can define a width or height 928 (i.e., vertical cross-sectional dimension) between about ½ inch and about 3 inches or more depending on amount of fire and smoke protection desired and/or based on deflection requirements. In some embodiments, the width 928 is approximately 2½ inches. The dimensions of the width of the horizontal leg 922 preferably are selected such that two angles 920 can be employed in a head-of-wall assembly (illustrated in FIG. 41) with one angle 920 on each side of the wall. Preferably, the width of the horizontal leg 922 is selected such that the legs 922 of the two angles 920 do not overlap one another when assembled into the head-of-wall assembly. Accordingly, if the angle 920 is configured for use with a wall assembly that is wider than standard width, the width of the horizontal leg 922 can be increased to, for example, about 1½ inches to about 3 inches, or more. The width or height of the vertical leg 924 is selected such that the leg 924 fills the entire head-of-wall gap, or gap between the ceiling and upper end surfaces of the wall board, in an open-most position of the head-of-wall joint (assuming a dynamic joint). Alternatively, the width or height of the vertical leg 924 is selected to cover a substantial portion, such as ⅓ to ½ or more, of the corresponding leg of the header track. Thus, the actual width or height of the vertical leg 924 can vary from the exemplary widths or heights described herein.

In one embodiment of the angle 920, the horizontal leg 922 may include a rounded bend 932. A flap 923 extends from the rounded bend 932. The flap 923 can open and close with the movement of the drywall, and along with the rounded bend 932, can help to maintain the position of the angle 920 during movement of the drywall. In some embodiments, the flap 923 extends at an angle from the rounded bend 932 such that the flap 923 has a vertical height 929 of approximately ½ inch. In some embodiments, a fire retardant material 933 (such as intumescent paint or tape) may be applied to the backside or interior-facing portion of the flap 923 (that is, the side of the flap 923 facing the drywall) to provide additional fire protection within a deflection gap or the space above the drywall in a dynamic head of wall assembly.

In one embodiment of the angle 920, the vertical leg 924 may include an angled or kickout portion 934 that is bent outwardly (that is, in the opposite direction from the horizontal leg 922). The angled portion 934 may be approximately ⅛ inch long starting approximately ½ inch from the bottom of the vertical leg 924. The purpose of this bend is to provide an attachment flange that will allow the 2½ inch vertical leg 924 to align tight against a header track without being obstructed by a framing screw that passes through the center of a slotted header track into the framing stud. The remainder portion 936 of the vertical leg 924 extends downward generally parallel to the upper portion of the vertical leg 924. In some embodiments, the portion 936 has a width 927 of approximately ½ inch. At least a portion of the vertical leg 924 may be covered or coated with a fire retardant material 931 or have factory-applied intumescent material or tape installed over a portion of the leg 924. In some embodiments, an optional separate piece of fire retardant material 930 such as intumescent tape may be applied over a portion of the horizontal leg 922. Although heat-resistant adhesive preferably is used to affix the intumescent tape 930 to the angle 920, the adhesive can still fail at temperatures lower than that required to cause expansion of the intumescent tape 930. By pinching the intumescent tape 30 between the ceiling and the angle 920, the intumescent tape 930 is held in place even if the adhesive fails.

Preferably, as described above, the intumescent tape or strip 930 is constructed with a material that expands in response to elevated heat or fire to create a fire-blocking char. One suitable material is marketed as BlazeSeal™ from Rectorseal of Houston, Tex. Other suitable intumescent materials are available from 3M Corporation, Hilti Corporation, Specified Technologies, Inc., or Grace Construction Products. The intumescent material expands to many times (e.g., up to 35 times or more) its original size when exposed to sufficient heat (e.g., 350 degrees Fahrenheit). Thus, intumescent materials are commonly used as a fire block because the expanding material tends to fill gaps. Once expanded, the intumescent material is resistant to smoke, heat and fire and inhibits fire from passing through the head-of-wall joint or other wall joint. Thus, intumescent materials are preferred for many applications. However, other fire retardant materials can also be used. Therefore, the term intumescent strip is used for convenience in the present specification and that the term is to be interpreted to cover other expandable or non-expandable fire-resistant materials as well, such as intumescent paints (e.g., spray-on), fiberglass wool (preferably with a binder, such as cured urea-phenolic resin) or fire-rated dry mix products, unless otherwise indicated. The intumescent strip can have any suitable thickness that provides a sufficient volume of intumescent material to create an effective fire block for the particular application, while having small enough dimensions to be accommodated in a wall assembly. That is, preferably, the intumescent material strips do not cause unsightly protrusions or humps in the wall from excessive build-up of material. In one arrangement, the thickness of the intumescent strip 930 is between about 1/16 (0.0625) inches and ⅛ (0.125) inches, or between about 0.065 inches and 0.090 inches. One preferred thickness is about 0.075 inches.

Figure 40:
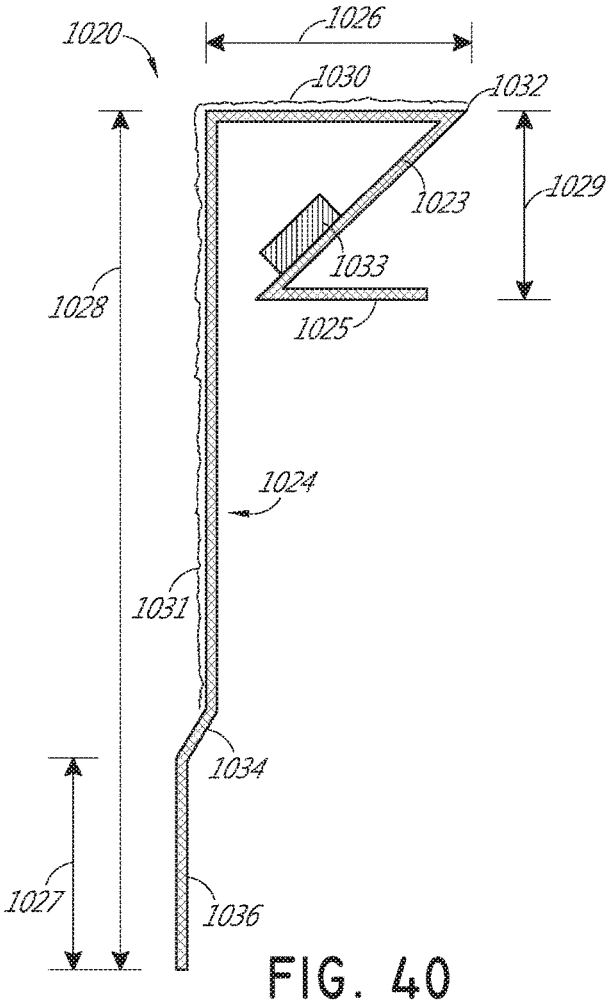
FIG. 40 is a cross-sectional view of another embodiment of a fire-rated angle piece, which incorporates a fire-resistant or intumescent strip.

FIG. 40 illustrates another embodiment of an angle 1020. Preferably, the angle 1020 includes a top or upper wall portion or top or upper leg or flange 1022. The upper wall portion 1022 is also referred to herein as a horizontal leg because it is typically oriented in a horizontal or substantially horizontal plane when installed in a head-of-wall assembly, as described herein. The angle 1020 also includes a side wall portion 1024, which is also referred to herein as a vertical leg or flange because it is typically oriented in a vertical or substantially vertical plane when the angle 1020 is installed in a head-of-wall assembly. The illustrated vertical leg 1024 is unitarily formed with the horizontal leg 1022. That is, the horizontal leg 1022 and the vertical leg 1024 are constructed from a single piece of material. Preferably, both the horizontal leg 1022 and the vertical leg 1024 are substantially planar and define an angle A therebetween of about 90 degrees or, in some arrangements, slightly more than 90 degrees. For example, the legs 1022 and 1024 may define an angle of between about 80 degrees and about 100 degrees, between about 85 degrees and 97 degrees or about 95 degrees. This can assist in providing a gap at the upper end of the vertical leg 1024 to accommodate a fastener head, as is described in greater detail below.

In the embodiment of the angle 1020 shown in FIG. 40, the horizontal leg 1022 may include a corner 1032 that forms part of a Z-shaped bend with angled portion 1023 and portion 1025. Similar to the flap discussed above, the Z-shaped bend is used to help maintain the position of the angle 1020 during movement of the drywall. In some embodiments, a fire retardant material 1033 (such as intumescent paint or tape) may be applied to the backside or interior-facing portion of the angled portion 1023 (that is, the side of the portion 1023 facing the drywall) to provide additional fire protection within a deflection gap or the space above the drywall in a dynamic head of wall assembly.

In one embodiment of the angle 1020, the vertical leg 1024 may include an angled portion 1034 that is bent outwardly (that is, in the opposite direction from the horizontal leg 122). The angled portion 1034 may be approximately ⅛ inch long starting approximately ½ inch from the bottom of the vertical leg 1024. The purpose of this bend is to provide an attachment flange that will allow the 2½ inch vertical leg 1024 to align tight against a header track without being obstructed by a framing screw that passes through the center of a slotted header track into the framing stud. The remainder portion 1036 of the vertical leg 1024 extends downward generally parallel to the upper portion of the vertical leg 1024. In some embodiments, the portion 1036 has a width 1027 of approximately ½ inch. At least a portion of the vertical leg 1024 may be covered or coated with a fire retardant material 1031 or have factory-applied intumescent material or tape installed over a portion of the leg 1024. In some embodiments, fire retardant material 1030 such as intumescent tape or paint, may be applied over a portion of the horizontal leg 1022. In some embodiments, the fire retardant material 1030 and 1031 may be continuous, that is, without any gaps, such that the fire retardant material covers at least a portion of the horizontal leg 1022 and wraps around the corner and covers at least a portion of the vertical leg 1024 to provide a fire retardant seal against the abutting surface.

FIG. 41 illustrates a wall assembly 140 (in particular, a fluted pan deck metal stud wall assembly) including an embodiment of the angle 120 installed on each side of a slotted header track 142. The fluted pan deck 100 includes a pan 102, which defines downwardly-opening spaces, voids or flutes 104, and a layer of concrete 106 supported by the pan 102. In the illustrated arrangement, the wall assembly 140 is oriented perpendicular or substantially perpendicular to the flutes 102 of the fluted pan deck 100. Fire-rated walls require fire-resistant material, such as mineral wool 110, to be installed within the voids 104 of the fluted pan deck 100 when the wall assembly 140 is running perpendicular to the flutes 104. The voids or flutes 104 of a fluted pan deck 100 vary in size but generally are about 7½ inches by 3 inches. Mineral wool 110 is compressed and placed into these voids 104. A fire spray material 112 (e.g., a fire-resistant elastomeric material that can be applied with a sprayer) is then sprayed over the top of the mineral wool 110 to protect against smoke passage. The fire spray 112 will generally have elastomeric qualities to it for flexibility and in some cases may even have intumescent qualities. In traditional stuff and spray assemblies, the fire spray 112 will go over the mineral wool 110 and lap over the top edge of the wall board 150, for example, by about ½ inch. Fasteners 152 secure a metal stud 146 to the slotted header track 142. Fasteners 148 secure the angle 920 to the metal stud 146 through a slot of the header track 142, preferably through the recessed flange portion 136 of the vertical leg 124 of the angle 920. The fasteners 148, 152 may be ½ inch framing screws. Drywall is installed over the frame studs 146, lapping over the vertical leg 124 of the angle 920 and leaving a deflection gap between the edge of the drywall 150 and the underside of the fluted pan deck 100.

An aspect of the present invention involves the realization that, in a conventional arrangement, because the fire spray 112 extends over two dissimilar materials, i.e., the mineral wool 110 which is compressible and wall board (e.g., drywall) 150 which is rigid, a great deal of stress is created in the fire spray 112 covering the deflection gap as both materials will act differently as they are cycled up and down. The mineral wool 110 is flexible and will be more forgiving as it cycles, but the drywall 150 is rigid and will pull away from the mineral wool 110 and fire spray 112. Therefore, as these assemblies go through the movement cycle test of UL 2079, the fire spray tends to rip or tear along the joint between the drywall and the mineral wool. Cracks, rips, or tears create a weak spot in the joint and it becomes very vulnerable to the air-leakage test and burn test that follow the movement cycle test according to UL 2079. However, in the arrangement illustrated in FIG. 41, it is apparent that the fire spray 112 only laps on the intumescent angle 120. The wall board (e.g., drywall) 150 is able to cycle unencumbered against intumescent angle 120 without stress cracks to the fire rated deflection joint. Such an arrangement is capable of providing a Class III Seismic movement joint according to UL 2079. Traditional stuff and spays typically are only capable of providing Class II Wind Movement according to UL 2079 because these types of joints are very vulnerable to cracking or tearing. FIG. 41 illustrates the wall in a position in which the upper edges of the wall board 150 are below the fire spray 112.

Figure 42:
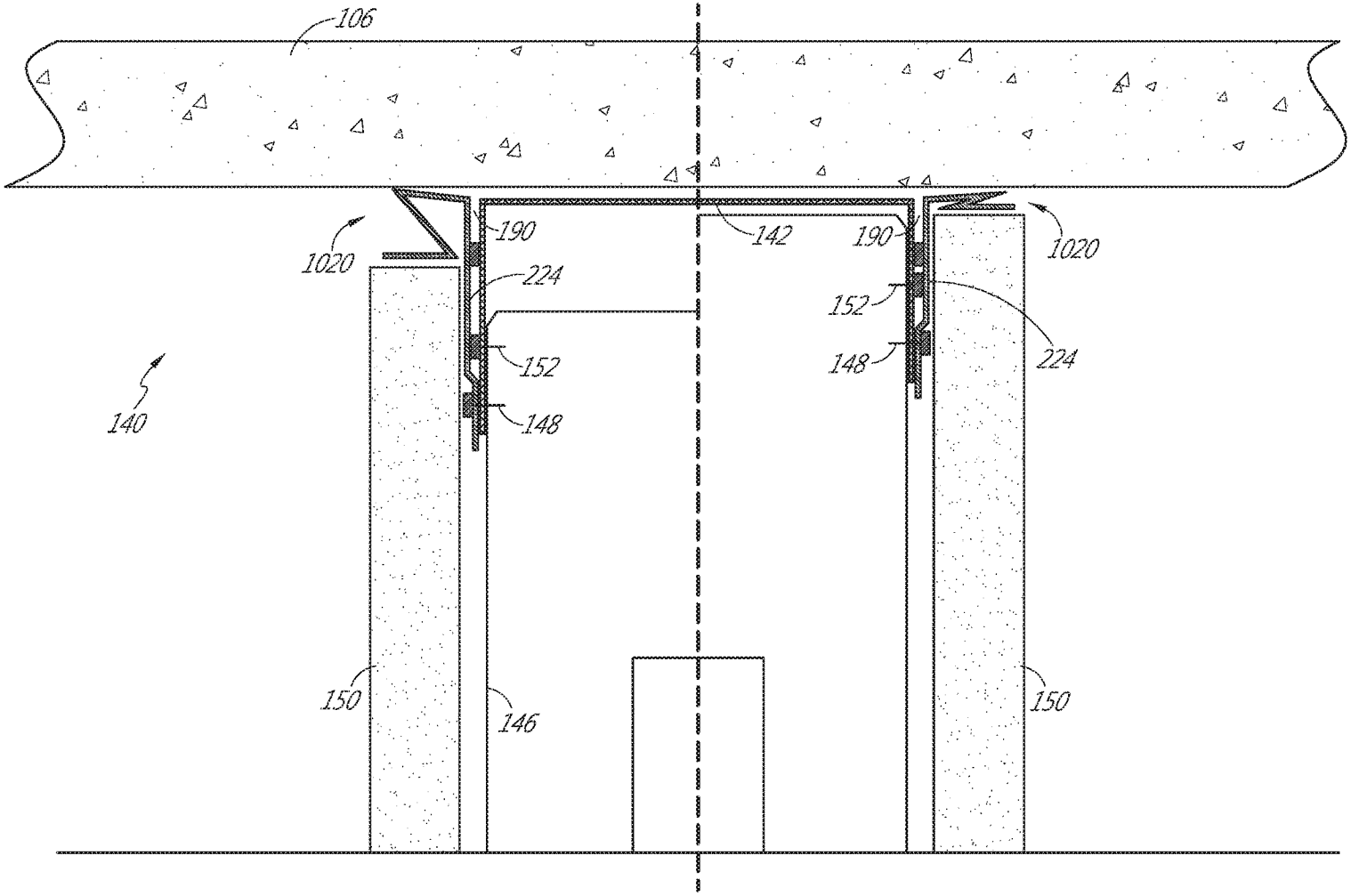
FIG. 42 is a cross-sectional view of a head-of-wall assembly incorporating another embodiment of the fire-rated angle piece.

FIG. 42 illustrates a wall assembly 140 similar to the wall assembly 140 shown above in FIG. 41 but with a solid concrete ceiling 106. Two Z-profile angles 1020, such as those described above with respect to FIG. 40, are installed on each side of the metal stud 146. The left side of the wall assembly 140 shows an open deflection joint with the angle 1020 in an open or uncompressed state. The right side of the wall assembly 140 shows a closed deflection joint with the angle 1020 in a compressed state and illustrates how the angle 1020 conforms to the movement of the drywall 150.

Preferably, the header track 142 is installed to the concrete slab/ceiling 106 prior to the angles 1020. As described, the angles 1020 can have additional fasteners 148 installed through the header track 142 and leg 124 of the angle 1020 in the spaces or bays between studs 146 to hold it in place or it can be a compression friction fit utilizing interference features. Additional fasteners 152 may be used to secure the header track 142 to the stud 146. FIG. 42 illustrates a gap or a space 190 between the outside leg surface of the header track 142 and the inside surface of the vertical leg 1024 of the angle 1020 at least at an upper end of the leg 1024 and, preferably, only at an upper end of the leg 1024. This gap 190 has a function and purpose as it allows the head portion of the framing screw 148 to fit between the outside leg surface of the header track 142 and the inside surface of the vertical leg 1024 of the angle 1020, as shown in FIG. 42. This allows the bottom portion of the angle leg 1024 to push up tight against the outside leg surface of the header track 142 without causing damage to the intumescent material 1031 or angle 1020 during the cycling of the wall assembly or the movement cycle test of the UL 2079 fire-rated wall joint testing protocol.

Figure 43:
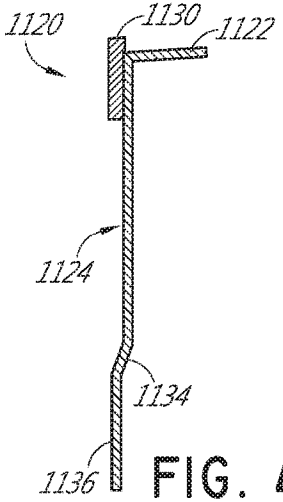
FIG. 43 is a cross-sectional view of another embodiment of a fire-rated angle piece.

Another embodiment of a deflection angle 1120 is shown in FIG. 43. In this embodiment, the angle 1120 includes a horizontal leg 1122 integrally formed with a vertical leg 1124 as discussed above with respect to the angles 920, 1020. A fire retardant material, such as intumescent tape 1130, extends vertically upward past the corner of the angle 1120 to assist with sealing the angle 1120 against uneven surfaces. The short horizontal leg 1124 can be bent at 85-95 degrees and tilt slightly downward away from or upward towards the overhead structure to further assist in sealing the angle 1120 against uneven surfaces. Similar to the angles 920, 1020 discussed above, the angle 1120 may include a ⅛ inch bend 1134 to allow the angle 1120 to have tight alignment against the header track and stud without interfering with the framing screw or fastener to passes through the slot of the slotted header track.

Figure 44A:
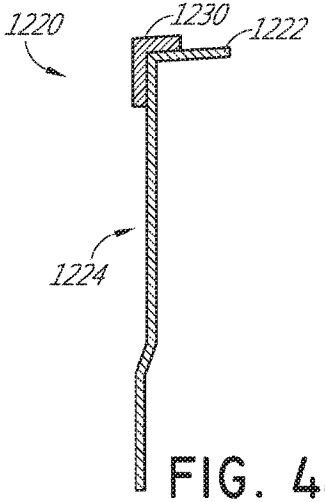
FIGS. 44A-C are cross-sectional views of three additional embodiments of a fire-rated angle piece with the intumescent material positioned on different locations of the fire-rated angle piece.
Figure 44B:
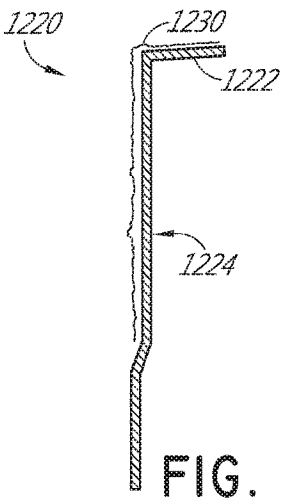
Figure 44C:
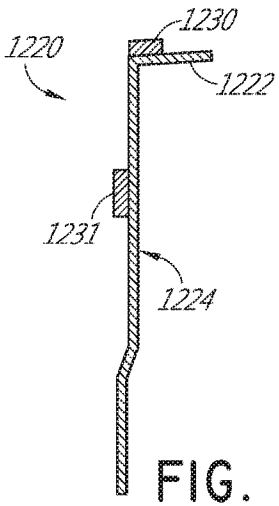

FIGS. 44A-C illustrate three options for the location of the fire retardant material, such as an intumescent paint or tape, on an angle 1220. As shown in FIG. 44A, the intumescent strip or tape 1230 can wrap around the corner joining the horizontal leg 1222 and the vertical leg 1224. In this configuration, the angle 1220 can provide fire protection along two different surfaces abutting each of the legs 1222, 1224. FIG. 44B illustrates another configuration in which a fire retardant material, such as intumescent paint, is applied along the header track-facing portion of the vertical leg 1224 above the kick out portion and also along the horizontal leg 1222. In FIG. 44C, the angle 1220 has one strip 1230 of intumescent material applied to the horizontal leg 1222 near the corner and a second strip 1231 of intumescent material applied approximately halfway along the length of the longer, vertical leg 1224.

Figure 45A:
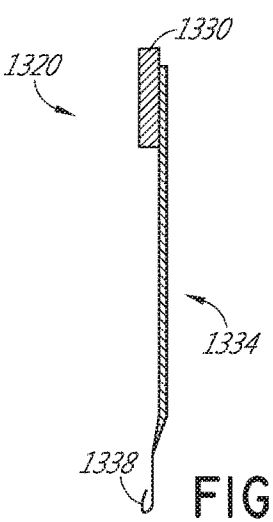
FIGS. 45A and B are cross-sectional views of other embodiments of a fire-rated angle piece.
Figure 45B:
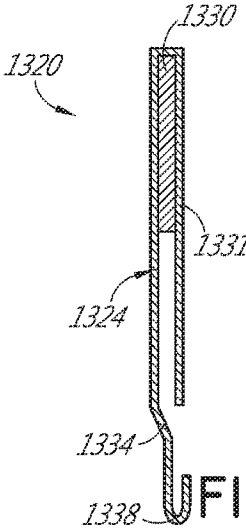

FIGS. 45A and B illustrate two embodiments of a strap 1320 that includes a hem 1338 extending from the lower end of the vertical leg 1324. In this embodiment, the strap 1320 is not bent to create an angle, as shown in FIGS. 39-44. In FIG. 45A, the intumescent material 1330 extends beyond the end of the vertical leg 1324 of the strap 1320. In FIG. 45B, the strap 1320 is formed from a single sheet of light gauge metal that is bent to form a two ply vertical leg 1324. In some embodiments, fire retardant material 1331 may be applied between the layers of steel forming the vertical leg 1324. In some embodiments, an intumescent strip 1330 is applied to the upper end of the vertical leg 1324 such that the strip 1330 extends above, or beyond the edge of, the vertical leg 1324. The strip 1330 is preferably compressible to assist with sealing the strap 1324 against an uneven surface. Similar to the embodiments shown in FIGS. 39-44, the strap 1324 includes a bent or kick out portion to allow room for framing screws that pass through the slot in the header track. In some embodiments, a hem 1338 provides additional structural stability for the strap 1320 since the strap 1320 lacks a horizontal leg to facilitate attachment to a wall assembly surface.

Figure 46:
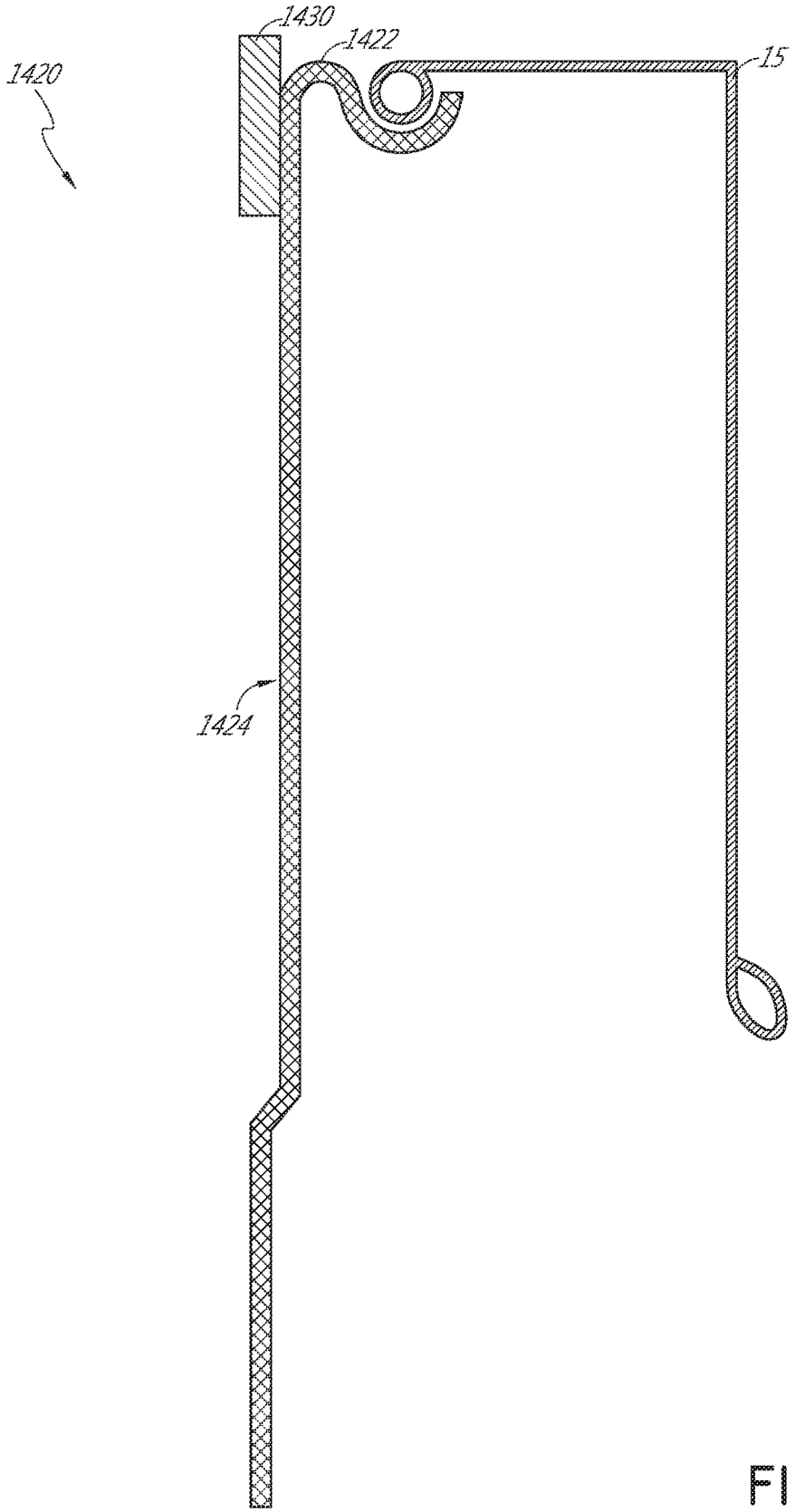
FIG. 46 is a cross-sectional view of another embodiment of a fire-rated angle piece.

FIG. 46 illustrates a profile view of another embodiment of a strap 1420 similar to the angles and straps discussed above with reference to FIGS. 39-45. Instead of a planar horizontal leg, the strap 1420 includes a curved portion 1422. The strap 1420 can be bent to form a curved hook that can mate with a piece of snap-in trim, such as trim piece 15. The trim piece 15 can be snapped into place with the strap 1420 after drywall has been installed. Other suitable interconnecting or interlocking arrangements could also be used. The snap-in cover trim 15 can made from any type of metal or other suitable material. Furthermore, although illustrated as a strap, an angle piece could be similarly configured to interact or engage with a snap-in trim piece. Similar to the embodiments shown in FIGS. 45A and 45B, the strap 1420 includes a fire-retardant material such as an intumescent strip 630 that extends beyond the end of the strap 1420 above the curved portion 1422.

Figure 47:
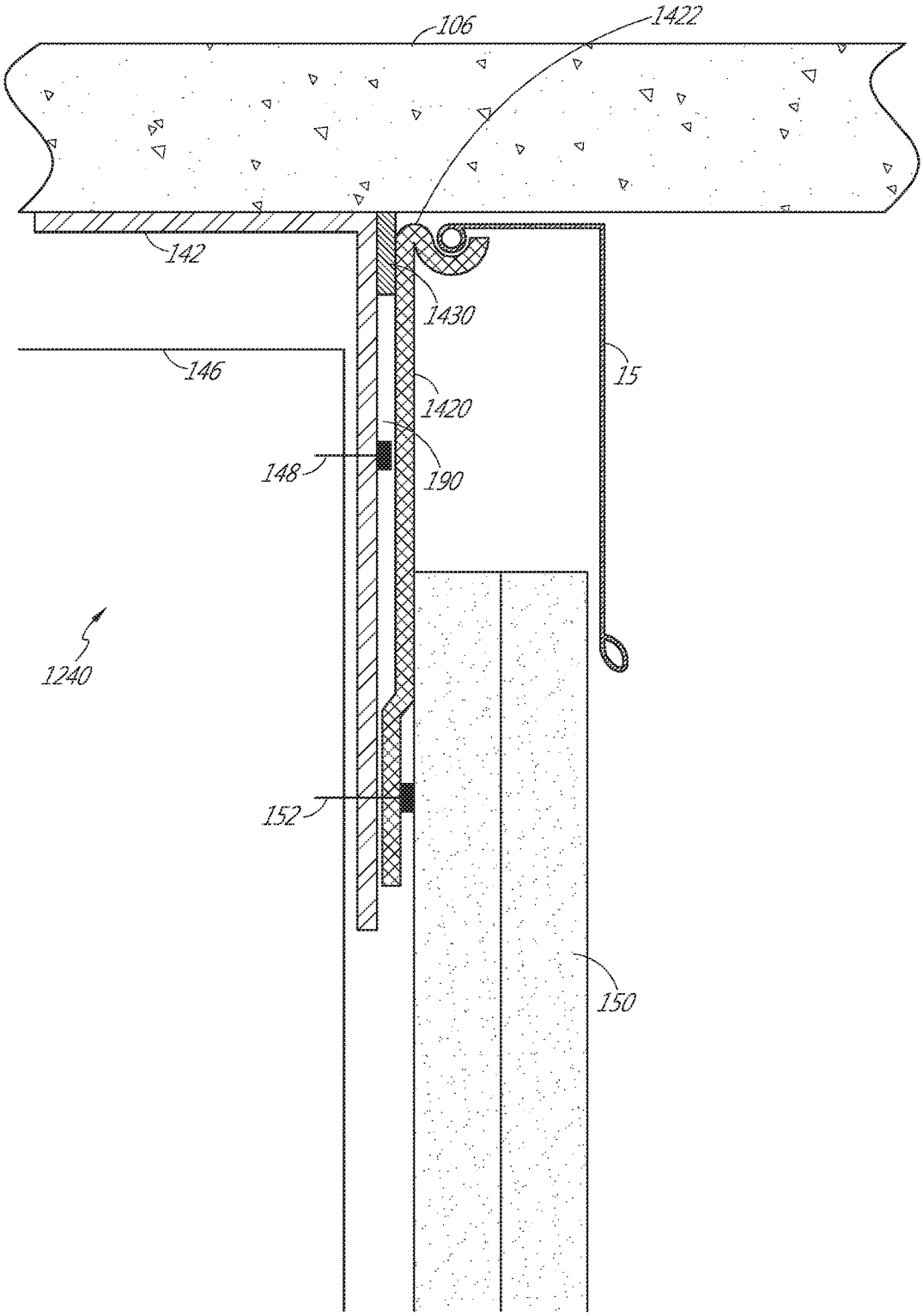
FIG. 47 is a partial cross-sectional view of another head-of-wall assembly incorporating the fire-rated angle piece of FIG. 46.

FIG. 47 illustrates a sectional view of a wall assembly and head-of-wall joint 1240 incorporating the strap 1420 illustrated in FIG. 46. The wall assembly 1240 is similar to that shown in and described with reference to FIG. 42 in which a metal stud framed wall is attached to a solid concrete deck. Accordingly, the same reference numbers are used to describe the same or corresponding components. The strap 1420 is installed, preferably after the header track 142, such that the intumescent strip 1430 contacts the solid concrete deck 106 to form a fire-block. The trim piece 15 can be snapped into place after installation of the drywall 150. Preferably, the snap-in trim piece 15 does not impede the unencumbered movement of the head-of-wall joint. The trim piece 15 preferably extends downwardly past the edge of the drywall such that the open deflection joint is not exposed even if in a fully open position.

Figure 48:
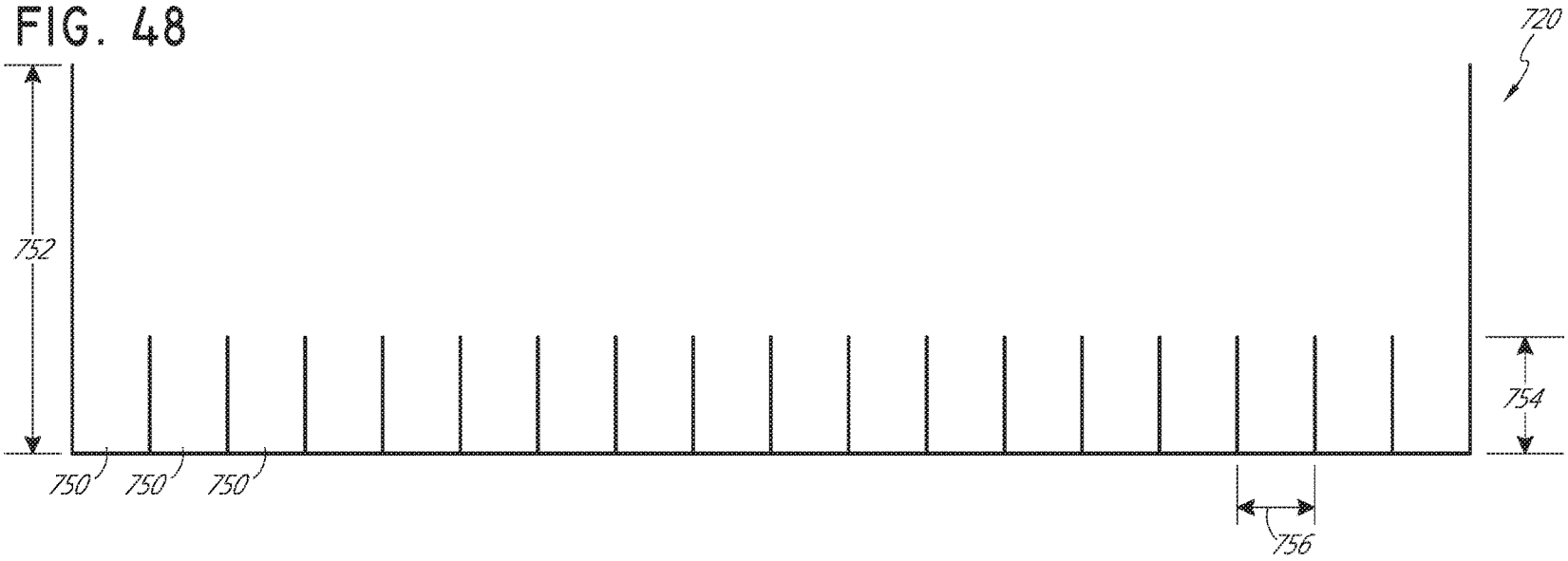
FIG. 48 is a front view of another embodiment of a fire-rated angle piece having a plurality of cuts or slits in the steel profile along the longer leg to create a plurality of bendable tabs.
Figure 49:
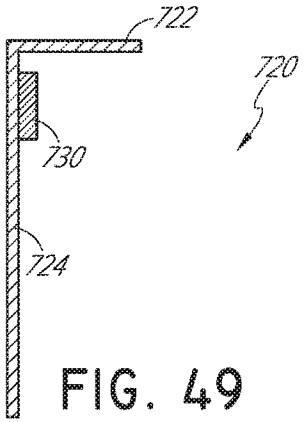
FIG. 49 is a side view of the fire-rated angle piece of FIG. 48.

FIG. 48 illustrates a front view of an angle piece 720 similar to the angle pieces shown in FIGS. 39-45 and discussed above. The angle 720 is preferably formed from light gauge steel with cuts or slits made on the long edge of the angle 720 to create bendable tabs 750. In one embodiment, the height or width 752 of the angle 720 is approximately 2½ inches. The height or width 754 of each tab 750 is approximately ¾ inch. Each tab 750 has a width 756 of approximately ½ inch and each tab 750 is approximately ¾ inch on center. The plurality of bendable tabs allows the angle 720 to be bent during installation to secure or lock in the stud, as discussed below. FIG. 49 illustrates the angle 720 in profile view to illustrate one possible location of an intumescent strip 730. Similar to the angle profiles discussed above, angle 720 includes a horizontal leg 722 and a vertical leg 724 that are preferably formed from a single sheet of light gauge steel that is bent to form the legs 722, 724. As shown, the intumescent strip 730 may be located on an interior-facing surface of the vertical leg 724 just below the corner between the vertical leg 724 and the horizontal leg 722.

Figure 50:
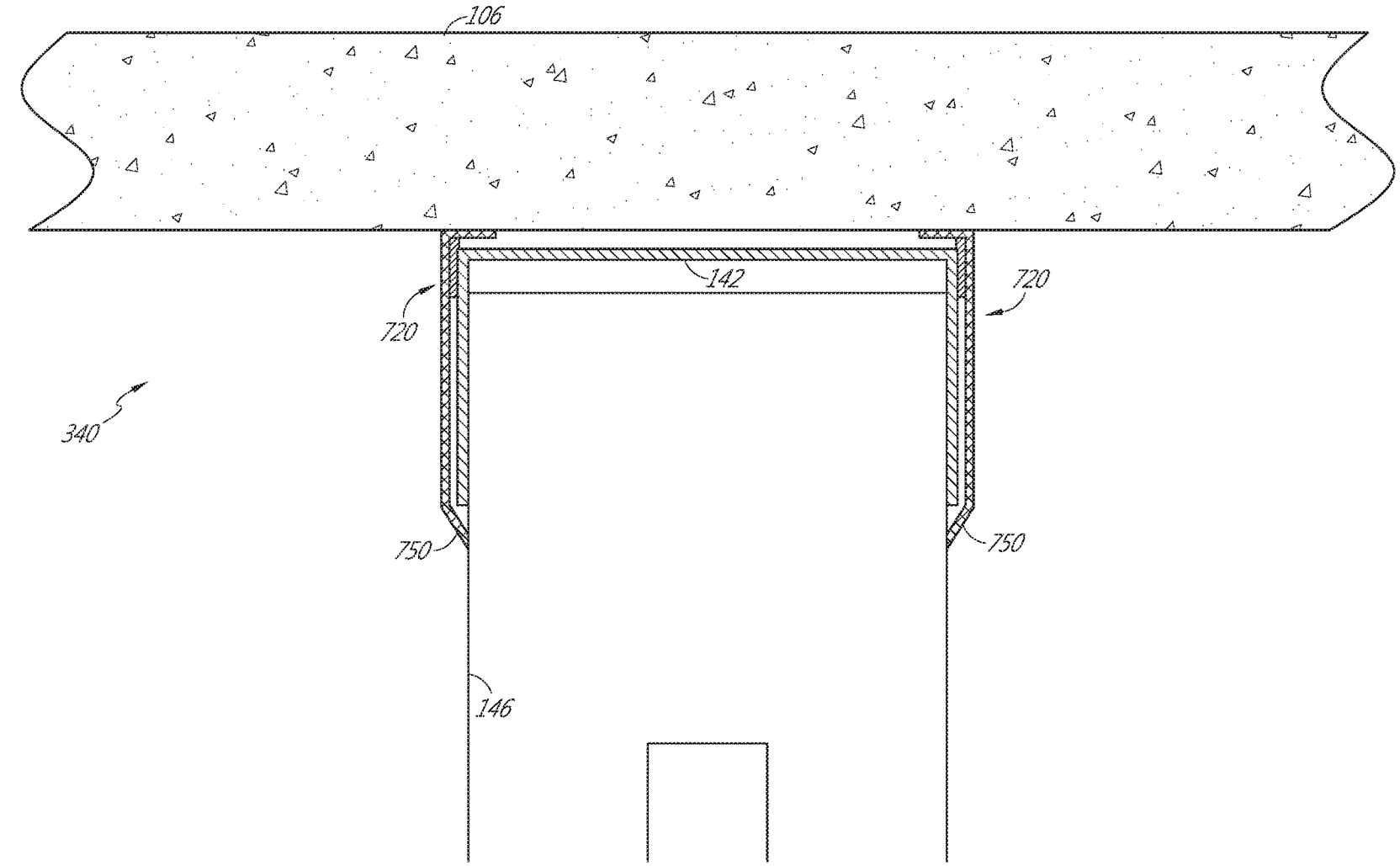
FIG. 50 is a cross-sectional view of a head-of-wall assembly incorporating the fire-rated angle piece of FIGS. 48 and 49 illustrating the tabs bent inward to hold vertical studs in place prior to drywall attachment.

FIG. 50 illustrates a wall assembly 340 that incorporates the angle 720 shown in FIGS. 48 and 49. The wall assembly 340 is similar to that shown in and described with reference to FIGS. 42 and 47 in which a metal stud framed wall is attached to a solid concrete deck. Accordingly, the same reference numbers are used to describe the same or corresponding components. In FIG. 50, the tabs 750 of each angle 720 are pushed in to lock in or secure the metal stud 146 relative to the header track such that, in some configurations, the use of a fastener is not necessary.

Figure 51:
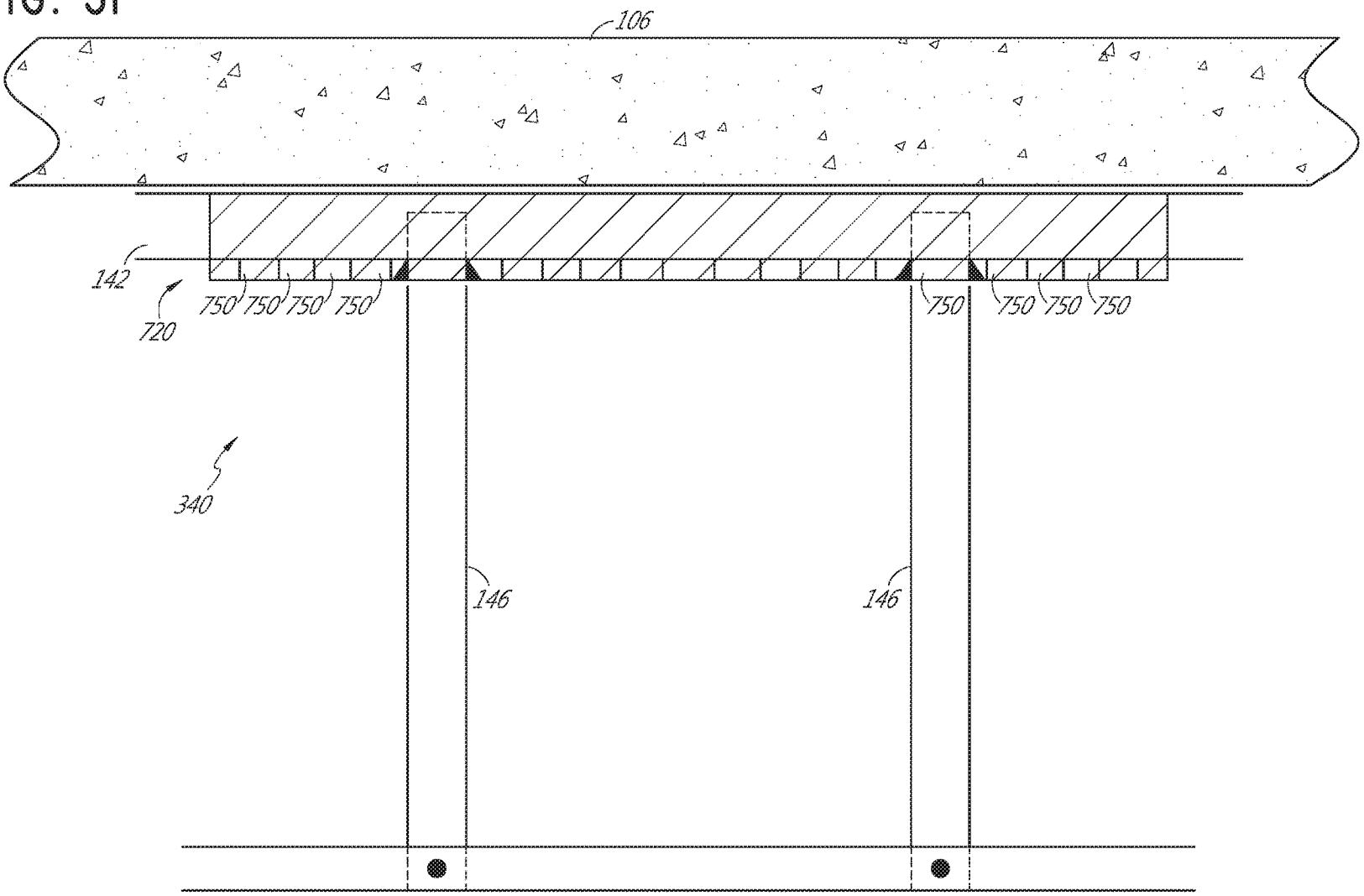
FIG. 51 is a front elevation view of the head-of-wall assembly of FIG. 50.

FIG. 51 is an elevation view of the wall assembly 340 of FIG. 42. The angle 720 with tabs 750 is installed over the header track 142. The studs 146 are nested into the header track 142 and the tabs 750 of the angle 720 are pushed in on either side of the stud 146 to prevent the stud 146 from moving side to side. While FIGS. 48-51 illustrate one embodiment of the angle 720, any of the tab and slit concepts discussed above may be used with any of the angles shown in FIGS. 39-46.

The above-described arrangements can also be utilized at a gap at the bottom of the wall assembly and at a gap at the side of the wall assembly. Preferably, each such assembly is similar to the head-of-wall assemblies described above. In particular, preferably, each such assembly creates a fire-resistant structure at the respective wall gap.

The described assemblies provide convenient and adaptable fire block structures for a variety of linear wall gap applications, which in at least some embodiments permit the creation of a fire rated joint according to UL 2079. In some arrangements, the separate angles include fire-retardant materials (e.g., intumescent material strips) secured (e.g., adhesively attached or bonded) to appropriate locations on the angles and can be used with a variety of headers, footers (bottom tracks or sill plates) and studs to create a customizable assembly. Thus, one particular type of angle can be combined with multiple sizes or types of base tracks, headers, sill plates or studs to result a large number of possible combinations. The angles can be configured for use with commonly-available tracks, headers, sill plates or studs, in addition to customized tracks, headers, sill plates or studs specifically designed for use with the angles. Thus, the advantages of the described systems can be applied to existing wall assemblies. Therefore, the angles can be stocked in bulk and used as needed with an appropriate framing component.

Non-Metal Fire-Rated Component

In some configurations, any of the above described fire-rated angles, straps and joints may be formed from a non-metal material. Non-metal materials may include plastics such as, but are not limited to, vinyl, polyvinyl chloride (PVC), polyethylene or the like. Preferably, the non-metal material has a melting temperature that is higher than the initiation temperature of intumescent material (e.g., greater than 350 degrees Fahrenheit) such that the intumescent material expands prior to the melting of the non-metal material in response to elevated heat or fire. Preferably, the non-metal material has a melting temperature of at least 400 degrees Fahrenheit. In addition, preferably the non-metal material is fire-resistant and/or self-extinguishing such that combustion ceases once a flame source is removed.

In contrast to fire-rated components (e.g., angles, straps, joints, etc.) that are formed from light gauge steel, non-metal materials may deform gradually when under the pressure of the expanding intumescent material. That is, non-metal materials will deform (but not melt) at a lower temperature than light gauge steel which allows greater deformation than light gauge steel but at a rate of deformation that is still slower than the expansion of the intumescent material. Accordingly, the gradual deformation of the non-metal material provides support for the expanding intumescent material such that the expansion of the intumescent material may be controlled and directed to fill the gaps between, for example, the head-of-wall joint or other wall joints thereby providing a seal along the joint at which the angle is installed. In some configurations, a non-metal angle or strap may be configured such that deformed portions of the non-metal angle or strap restrict expansion of the intumescent material in certain directions while allowing expansion in other directions such that the intumescent material swells and fills a wall gap instead of merely spilling out of the wall gap. That is, the deformed portions of the non-metal angle or strap may contain the expanding intumescent material within the wall gap such that the intumescent material expands within the wall gap. Put another way, the non-metal angle or strap retains a sufficient amount of rigidity while it deforms such that the expanding intumescent material is directed in a desired direction or constrained within a gap to be sealed by the intumescent material.

For example, in an exemplary embodiment, the fire-rated angle 200 of, for example, FIG. 18 may be formed from a non-metal material instead of a light gauge steel. In some configurations, the fire-rated angle 200 is formed from a non-metal material having a melting temperature that is higher than the initiation temperature of intumescent strip 300. FIG. 52A illustrates a wall assembly 1300 within which the non-metal angle 200 has a horizontal leg 220 positioned between the header track 42 and ceiling element 104. The non-metal angle 200 has a vertical leg 240 positioned between the header track 42 and the wall board 50. An intumescent strip 300 is positioned on an interior surface of the vertical leg 240 of the non-metal angle 200. The intumescent strip 300 is positioned between the vertical leg 240 and a vertical flange of the header track 42. A gap 1302 is defined by a top surface of the wall board 50, a bottom surface of the ceiling element 104 and a surface of the vertical leg 240 that is opposite the intumescent strip 300.

Figure 52B:
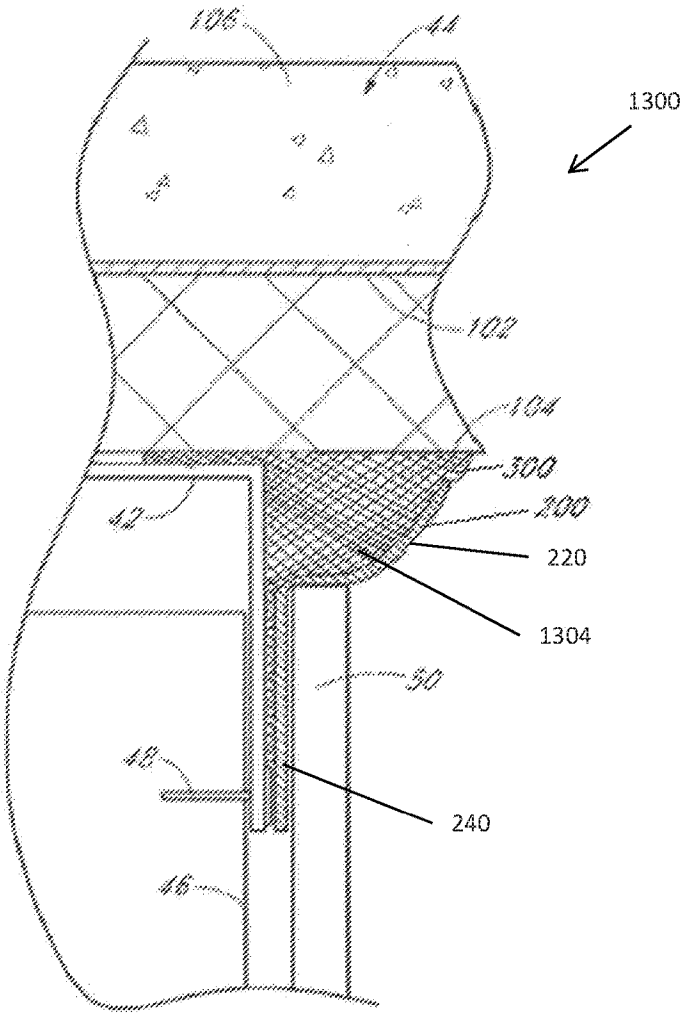
FIG. 52B is a cross-sectional partial representation of the head-of-wall assembly of FIG. 52A after applying heat to the non-metal angle piece.
Figure 52A:
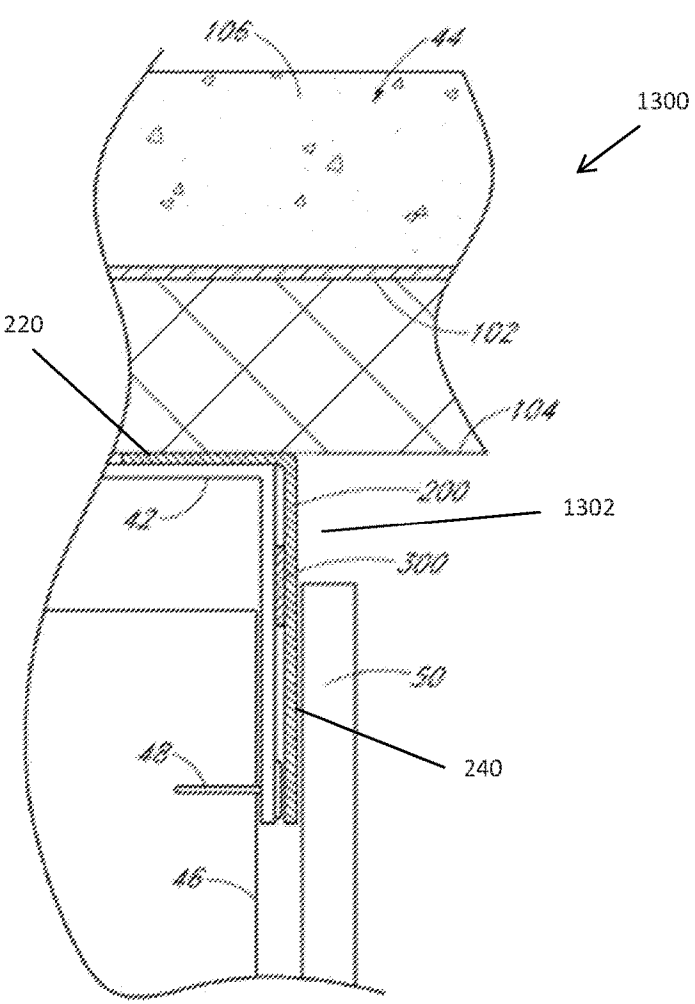
FIG. 52A is a cross-sectional partial representation of a head-of-wall assembly incorporating a non-metal angle piece.

FIG. 52B illustrates the non-metal angle 200 after the wall assembly 1300 has been exposed to a temperature greater than the initiation temperature of the intumescent strip 300. As shown, the non-metal angle 200 is deformed by the expansion of the intumescent strip 300. More specifically, the intumescent strip 300 has expanded between the header track 42 and the non-metal angle 200 such that a portion of the non-metal angle 200 is deformed away from the header track 42 and through the gap 1302. In some configurations, at least an unconstrained portion of the vertical leg 240 (i.e., unconstrained by the wall board 50) deforms in response to elevated temperature that approaches a melting point of the material of the non-metal angle 200 and/or the initiation temperature of the intumescent strip 300. In some configurations, the deformed portion of the non-metal angle 200 can include portions or entireties of one or both of the unconstrained portion of the vertical leg 240 and the horizontal leg 220. As shown, in some configurations, a deformed portion of the non-metal angle 200 can be bent over the top surface of the wall board 50 and can extend upward towards the ceiling element 104 to form a partially or fully enclosed cavity 1304 within which the intumescent material 300 is contained and directed to expand upwardly toward the ceiling element 104. That is, in at least some configurations, the non-metal angle 200 deforms and may even split, separate or rupture in one or more locations; however, the non-metal angle 200 retains sufficient structural integrity such that the cavity 1304 keeps the intumescent material 300 within the gap 1302. This can be accomplished by material selection, material thickness, coatings, combinations thereof or other suitable arrangements. The cavity 1304 also provides a protective covering over the expanded intumescent material 300 which partially or fully conceals the intumescent material 300 without negatively limiting its expansion. The cavity 1304 can also provide support to a bottom and lateral surface of the expanding intumescent material 300 such that it may expand upward and seal against the ceiling element 104. The expanded intumescent material 300 also protects the non-metal angle 200 from heat transmitted from the header track 42 such that the non-metal material of the angle 200 does not melt.

In some configurations, the non-metal angle 200 deforms outwardly through the gap 1302 a lateral distance of at least 1 inch away from the header track 42. Accordingly, providing a wider cavity 1304 within which the intumescent material 300 may expand may provide a wider region of expanded intumescent to provide greater heat protection, thereby, preventing or inhibiting heat from passing through the header track 42 and to the wall board 50, or vice versa.

It should be understood to one of ordinary skill in the art that the intumescent strip 300 is not limited to a position on the header-facing surface of the vertical leg 240. In other words, the angle 200 may have one or multiple intumescent strips positioned along any portion of the angle 200. Other suitable fire-retardant materials (expanding or non-expanding) may also be used, such as those described herein. In addition, the combination of intumescent material and non-metal material is not limited to only angles and depicted wall assemblies. Straps and other fire-rated wall assembly components may be formed from non-metal material such that the direction of the expanding intumescent material may be controlled.

Figure 54:
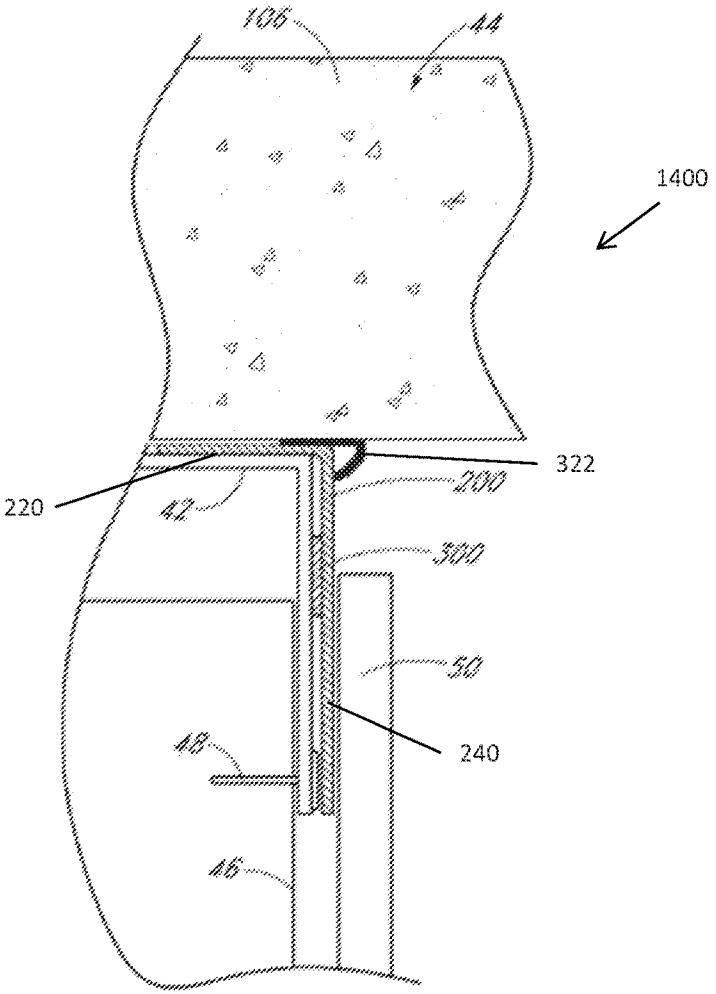
FIG. 54 is a cross-sectional partial representation of a head-of-wall assembly incorporating the angle piece of FIG. 53.
Figure 53:
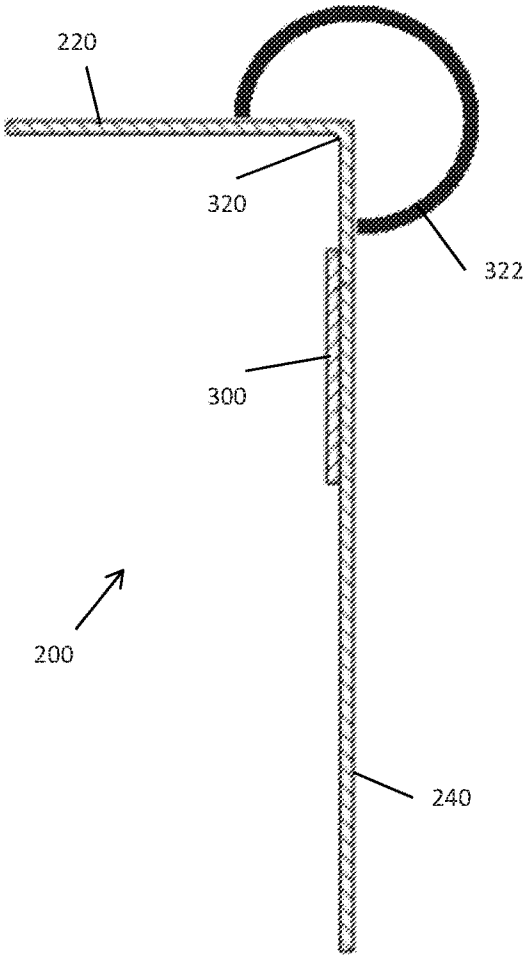
FIG. 53 is a cross-sectional view of an angle piece fitted with a gasket positioned over a corner of the angle piece.
Figure 56:
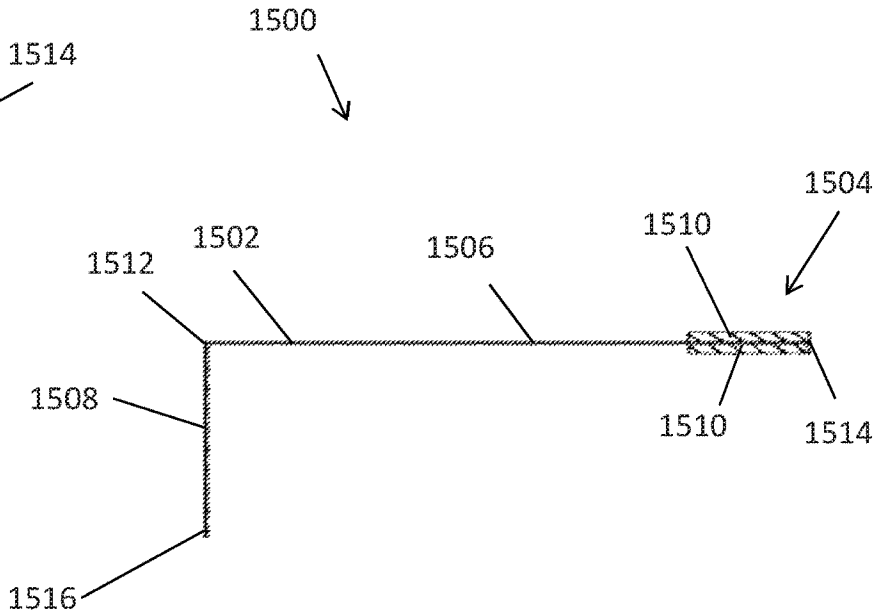
FIG. 56 is a cross-sectional top view of the fire-rated vertical drift joint of FIG. 55.
Figure 55:
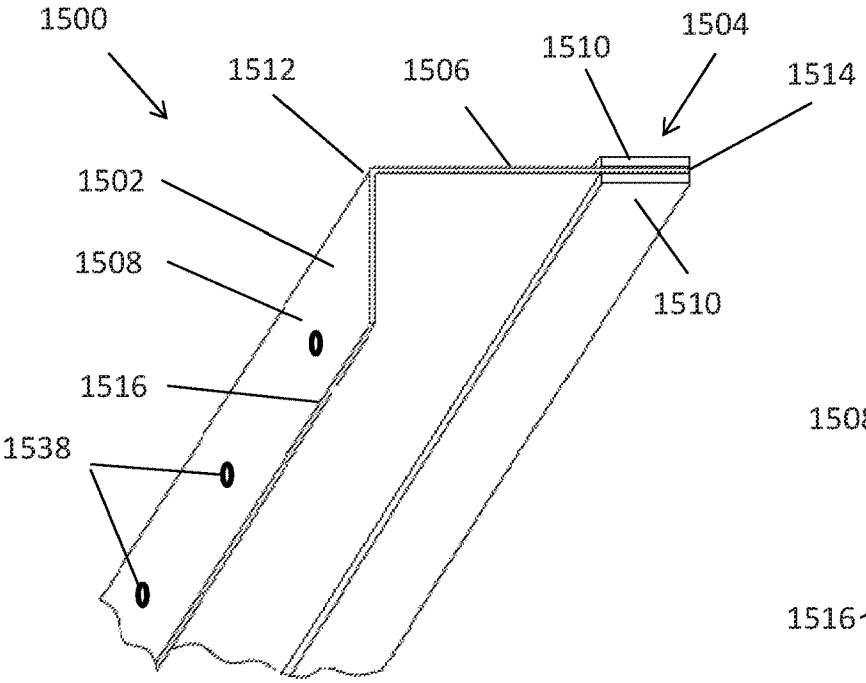
FIG. 55 is a perspective view of a fire-rated vertical drift joint, which incorporates a fire-resistant or intumescent material strip.

FIGS. 53 and 54 illustrate an alternative configuration of a fire-rated component (e.g., angles, straps, joints, etc.) for creating a seal against uneven or wavy concrete surfaces. Similar to previously described fire-rated components, the fire-rated angle 200 in FIGS. 53 and 54 may be formed from a metal or a non-metal material. However, in contrast, the fire-rated angle 200 includes a compressible gasket 322 positioned over the corner 320 of the angle 200 on an outwardly-facing side of the angle 200 along the length of the angle 200. That is, the gasket 322 is positioned on a side of the angle 200 that faces away from the header track 42. The gasket 322 has a first end attached to the horizontal flange 220 and a second end attached to the vertical flange 250 and, in at least some configurations, is not connected to the angle 200 in between the ends such that an interior space is formed. The space can be empty or filled with a filler material (e.g., foam).

As shown in FIG. 54, when the angle 200 is assembled as a component of a wall assembly 1400, the gasket 322 is compressed between the concrete slab/ceiling 44 and the horizontal leg 220. The gasket 322 provides an air seal to protect against smoke, fire and sound passing through the gap between the angle 200 and the concrete slab/ceiling 44. That is, the gasket functions to seal a gap between the angle 200 and the ceiling 44, which can be caused by imperfections or irregularities of the ceiling 44 surface. The ceiling 44 surface may not be completely flat or planar, as can be the case with poured concrete decks, for example. In some configurations, the intumescent strip 300 on the vertical leg 240 of the angle 200 may also be compressed between the vertical flange of the header track 42 and the angle 200 such that the gap between the header track 42 and the ceiling 44 is sealed.

As shown, the gasket 322 is illustrated as being circular in cross-section. However, the gasket 322 is not limited to any particular cross-sectional shape and may include curved, flat, and polygonal shapes or any combination thereof. The gasket 322 may be formed from a compressible material such as rubber, foam, plastic, vinyl, etc. In some configurations, the gasket 322 is formed from a fire-resistant compressible material such as Denver Foam®. The gasket 322 may be formed by molding the gasket directly onto the angle 200. Alternatively, the gasket 322 may be attached to the angle 200 by an adhesive or mechanical fastener. In addition, the gasket 322 is illustrated as having a tubular shape with a hollow center. However, in some configurations, the gasket 322 may have a solid center while maintaining elasticity and compressibility.

In some configurations, the gasket 322 may be attached to at least one of the horizontal flange 220 or the vertical flange 240. For example, in some configurations, the gasket 322 may be attached to only the horizontal flange 220. Similarly, one or more gaskets 322 may be positioned multiple portions of the angle 200 such that a seal is formed between the angle 200 and the concrete ceiling 44.

It should be understood to one of ordinary skill in the art that the gasket 322 may be utilized with a variety of wall components such as, but not limited to, straps, joint members, etc. That is, the gasket 322 may be attached to and positioned on wall components such that the gasket 322 provides a seal between the wall component and an adjacent member.

Modern high-rise building construction requires that fire-rated wall joints installed between wall assemblies provide movement capabilities. That is, fire-rated wall joints must accommodate wall assemblies that move in different directions. For example, the floors of a post tension slab high-rise building are designed to move vertically up and down between the floors with each floor being designed to move independently of the other floors based on load capacities and deflection requirements. Further, the external walls are designed to move laterally side-to-side based on wind load conditions (e.g., unencumber drift movement). Therefore, a fire-rated movement joint must provide a fire seal between wall assemblies that move both vertically and laterally.

Fire sealant has been used to provide a fire seal between wall assemblies, for example, within a wall-to-wall joint that connects the interior wall to the external wall. However, fire sealant is generally capable of accommodating movement in one direction at a time. Further, fire sealant generally lacks shear strength such that when the wall assemblies move laterally, the fire sealant tears and may not maintain the fire rating.

Figure 57:
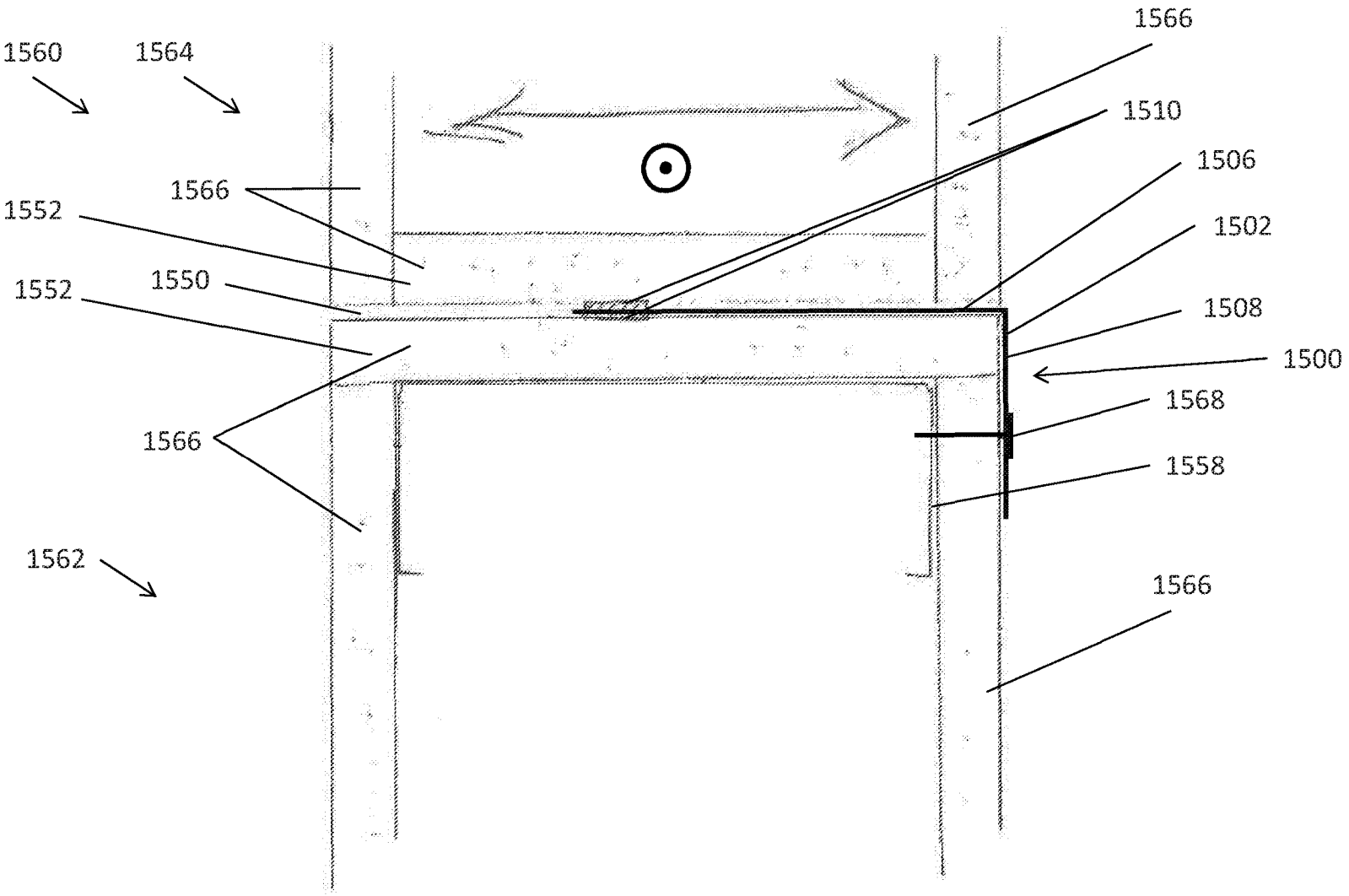
FIG. 57 is a cross-sectional top view of a wall-to-wall movement joint incorporating the fire-rated vertical drift joint of FIG. 55.

FIGS. 55-59 illustrate a Vertical Drift Joint (VDJ) 1500 comprised of an elongate angle 1502 with a fire seal 1504 that is applied along the length of the angle 1502. As shown in FIG. 57, the VDJ 1500 is installed within a vertical gap 1550 between the adjoining wall panels 1552 to provide a fire-rated wall joint that can maintain a fire-rated seal despite relative movement between the adjoining wall panels 1552 in more than one direction (e.g., vertically and laterally. That is, the fire seal 1504 seals a vertical gap 1550 between adjoining wall panels 1552 and provides an air seal to protect against smoke, fire and sound passing through the gap 1552. The fire seal 1504 is resilient such that the fire seal 1504 can elastically deform while maintaining the seal within the vertical gap 1550 despite relative movement between the adjoining wall panels 1552. For example, the fire seal 1504 can maintain an air and fire seal within the vertical gap 1550 if the adjoining wall panels 1552 move vertically and laterally relative to each other. When subject to relative movement, the fire seal 1504 may deform by expanding, compressing, shifting, etc. while maintaining contact with the adjoining wall panels 1552. Further, if a fire occurs and heat is applied to the VDJ 1500, the fire seal 1504 may comprise a fire retardant and/or intumescent material that expands and fills the vertical gap 1550.

The VDJ 1500 is comprised of a fire-rated profile or angle piece 1502, which is also referred to herein simply as an angle 1502. The angle 1502 preferably is formed from a light gauge steel material by any suitable process, such as roll forming, for example. Preferably, the angle 1502 is an elongated member having a consistent or substantially consistent cross-sectional shape throughout its length. One or more preferred embodiments of the angle 1502 are generally or substantially L-shaped in cross-section. In one embodiment, the angle 1502 may be between about 8 feet and 10 feet in length or between 4 feet and 8 feet. In other embodiments, the angle 1502 may have a length of 1 feet and 4 feet. Preferably, the angle 1502 is about 8-10 feet such that the angle 1502 spans the distance from the floor to the ceiling. Desirably, the angle 1502 is sufficiently long to allow installation within a vertical wall gap with a relatively few number of pieces. However, the length of the angle 1502 should be short enough that shipping and material handling is relatively convenient. Accordingly, the above-recited lengths are presently preferred. However, other lengths may also be used in other situations.

Preferably, the angle 1502 includes a first flange or leg 1506 and a second flange or leg 1508. In the illustrated embodiments, the first leg 1506 is positioned over an external surface of a wall panel while the second leg is positioned within the vertical wall gap 1550. In the illustrated embodiments, the first leg 1506 is shorter than the second leg 1508. The illustrated second leg 1508 is unitarily formed with the first leg 1506. That is, the first leg 1506 and the second leg 1508 are constructed from a single piece of material. As described above, typically, the single piece of material is a flat piece of light gauge steel, such as 25 gauge steel, which is then deformed into the shape of the angle 1502, such as through a roll-forming, extruding, molding, bending (such as on a press brake) or other suitable process. In other configurations, the angle may be formed from a composite fire-resistant material or a non-metal material such as plastic, vinyl, polyvinyl chloride (PVC) or the like.

Preferably, both the first leg 1506 and the second leg 1508 are substantially planar and define an angle therebetween of about 90 degrees or, in some arrangements, slightly less than 90 degrees. For example, the legs 1506 and 1508 may define an angle of between about 80 degrees and about 90 degrees, between about 85 degrees and 90 degrees or about 87 degrees. This can assist in providing a gap at the upper end of the second leg 1508 to accommodate a fastener head, as is described in greater detail below.

In one embodiment of the angle 1502, the first leg 1506 has a length (defined between the bend 1512 and a free end 1514 of the first leg 1506) of about 2½ inches or more, 2½ inches or less, and about 3 inches or more depending on amount of fire and smoke protection desired and/or based on deflection requirements. Preferably, the first leg 1506 has a length of about 2½ inches. The first leg 1506 may have a length such that the fire seal 1504, when positioned at an end 1514 of the angle 1502, is positioned substantially at the center or overlaps the center of one or both of the adjoining wall panels 1552. Positioning the intumescent strip 1510 at the center of the adjoining wall panels 1552 may ensure that the intumescent strip 1510 is in contact with the wall panels throughout their range of movement.

Put another way, the wall panels 1562, 1564 may define an overlapping region of the wall panels 1562, 1564 in which the adjoining wall panels 1552 of each of the wall panels 1562, 1564 overlap. Accordingly, the overlapping region defines the vertical wall gap 1550. The first leg 1506 may have a length such that the fire seal 1504 is positioned substantially at the center or midpoint of the overlapping region, as shown in FIG. 57. Such a position of the intumescent strip 1510 at the center of the adjoining wall panels 1552 may ensure that the intumescent strip 1510 is in contact with the wall panels 1562, 1564 throughout their range of movement. In other configurations, first leg 1506 may have a length such that the fire seal 1504 is positioned with in a range between ¼ to ¾, or between ⅓ to ⅔ of the length of the overlapping region.

The second leg 1508 has a length (defined between the bend 1512 and a free end 1516 of the second leg 1508) of about 1¼ inches or more, 1¼ inches or less, or between 1 inch and 2 inches. Preferably, the second leg 1508 has a length of about 1¼ inches. The second leg 1508 may have a length that is longer than the thickness of the wallboard 1566 of the adjoining wall panel 1552 on which the angle 1502 overlaps such that the fastener 1568 may fasten the angle 1502 to the stud 1558 of the wall panel 1562. Further, the second leg 1508 may have a sufficient length to be fastened to the stud 1558 when the wall panel 1562 comprises single or multiple layers of wallboard 1566.

The fire seal 1504 is comprised of a fire retardant material or a fire retardant material strip, such as an intumescent tape or intumescent strip 1510, that is adhesively (or otherwise) applied to the full length of the fire-rated angle 1502. The intumescent strip 1510 functions as a compression gasket between adjoining wall panels. In some configurations, the fire seal 1504 is comprised of a fire resistant gasket that may be used alone or in combination with a fire retardant/intumescent material or strip. The fire resistant gasket may be formed from a heat resistant and compressible material such as rubber, foam, plastic, vinyl, etc.

In the embodiment illustrated in FIGS. 55-59, the fire seal 1504 is comprised of a pair intumescent strips 1510 that are applied to both opposing planar horizontal surfaces of the first leg 1506. Each intumescent strip 1510 has substantially similar size and shape as the other intumescent strip 1510. In the illustrated embodiment, each intumescent strip 1510 is positioned opposite the other intumescent strip on the first leg 1506 such that the surfaces of the first leg 1506 are symmetrical. In other configurations, the intumescent strips 1510 may be asymmetrically positioned. Similarly, the intumescent strips 1510 may have asymmetrical size, shapes, configurations, etc.

The intumescent tape or strips 1510 are constructed with a material that expands in response to elevated heat or fire to create a fire-blocking char. One suitable material is marketed as BlazeSeal™ from Rectorseal of Houston, Tex. Other suitable intumescent materials are available from 3M Corporation, Hilti Corporation, Specified Technologies, Inc., or Grace Construction Products. The intumescent material expands up to many times (e.g., up to 35 times or more) its original size when exposed to sufficient heat (e.g., 350 degrees Fahrenheit). Thus, intumescent materials are commonly used as a fire block because the expanding material tends to fill gaps. Once expanded, the intumescent material is resistant to smoke, heat and fire and inhibits fire from passing through the head-of-wall joint or other wall joint. Thus, intumescent materials are preferred for many applications. However, other fire retardant materials can also be used. Therefore, the term intumescent strips 1510 are used for convenience in the present specification and that the term is to be interpreted to cover other expandable or non-expandable fire-resistant materials as well, such as intumescent paints (e.g., spray-on), fiberglass wool (preferably with a binder, such as cured urea-phenolic resin) or fire-rated dry mix products, unless otherwise indicated.

Preferably, each of the intumescent strips 1510 has a width of about ½ inch. In one arrangement, the width of the intumescent strips 1510 is between about ½ inches and 1 inch, or between about ¼ inches and ½ inches. Preferably, the each of the intumescent strips 1510 has a thickness of about 1.5 mm or 1/16 (0.0625) inches. In one arrangement, the thickness of the intumescent strips 1510 is between about ¼ (0.25) inches and ⅛ (0.125) inches, or between about 0.05 inches and 0.10 inches. However, the intumescent strip 1510 can have any suitable thickness that provides a sufficient volume of intumescent material to create an effective fire block for the particular application, while having small enough dimensions to be accommodated in a wall assembly. Further, preferably, the intumescent strips 1510 have a combined thickness such that the fire seal 1504 maintains sufficient contact with the adjoining wall panels 1552 and provides a fire-rated seal throughout the range of movement of the wall assembly. Even further, the intumescent strips 1510 can have any suitable thickness or width such that the intumescent strips 1510 can withstand the shear forces caused by relative movement of the adjoining wall panels 1552. That is, the intumescent strips 1510 may be sized such shear forces do not cause the intumescent strips 1510 to deform and unseal against the adjoining wall panels 1552.

The intumescent strips 1510 may be factory installed or installed by hand onto the surface of the first leg 1506. The intumescent strip 1510 may be applied to one or both sides of the second flange 1508. The intumescent strip 1510 can be substituted with fire sealant, sound sealant, or foam tape. In some configurations, multiple intumescent strips 1510 may be applied to one or both sides of the first leg 1506. The intumescent strips 1510 may be spaced apart across the length of the first leg 1506 between the bend 1512 and the free end 1514.

In some configurations, the fire seal 1504 (e.g., a single intumescent strip) may be applied to one surface of the first leg 1506. That is, in some configurations, the first leg 1506 may have a single intumescent strip 1510. In such a configuration, the intumescent strip 1510 is positioned on the side of the first leg 1506 that faces the opposing wall panel (i.e., the wall panel which the angle 1504 is not attached to).

The fire seal 1504 is positioned at, on, over or substantially near the free end 1514 of the first leg 1506. Positioning the intumescent strips 1510 at the free end 1514 of the first leg 1506 may reduce scrap material when forming the first leg 1506 since the length of the first leg 1506 may be minimized. In some configurations, the fire seal 1504 is positioned between the free end 1514 of the first leg 1506 and the bend 1512.

The ends of the pair intumescent strips 1510 may be substantially aligned with the free end 1514 of the first leg 1506 and extend toward the bend 1512. The intumescent strips 1510 extend less than halfway or about ⅕ of the way across the surfaces of the first leg 1506. In other arrangements, the intumescent strips 1510 may extend more than halfway or all the way across the first leg 1506 (i.e., between the free end 1514 and the bend 1512). In other arrangements, the intumescent strips 1510 may extend all the way across the first leg 1506 and onto the second leg 1508. However, preferably, at least a portion of the intumescent strips 1510 are located on the first leg 1506.

Figure 58:
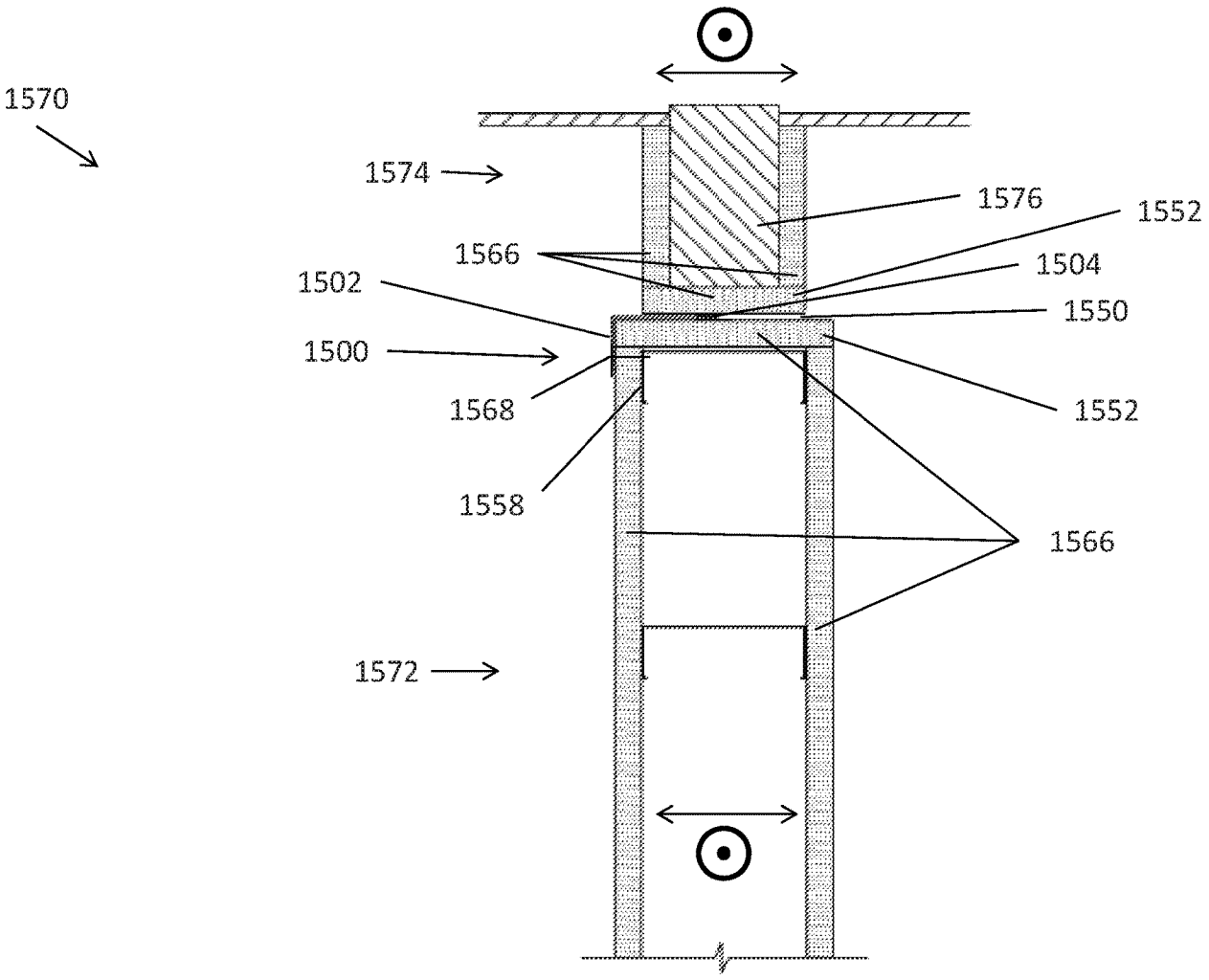
FIG. 58 is a cross-sectional top view of a window-to-wall movement joint incorporating the fire-rated vertical drift joint of FIG. 55.
Figure 59:
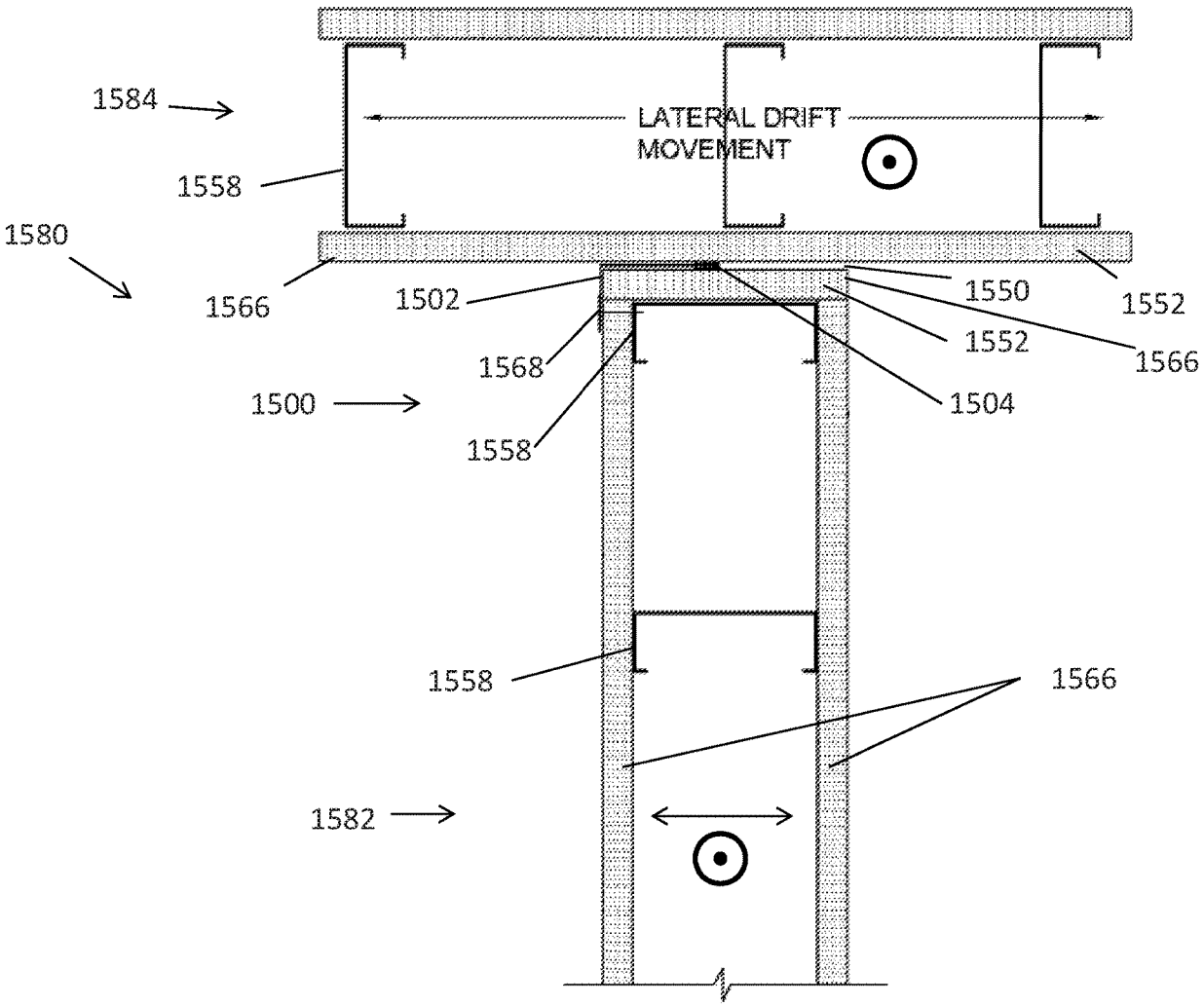
FIG. 59 is a cross-sectional top view of an external wall to interior wall movement joint incorporating the fire-rated vertical drift joint of FIG. 55.

FIGS. 57 to 59 illustrate various wall structures in which the VDJ 1500 may be installed to provide a movement joint with a fire-rated seal between adjoining wall panels that move relative to each other. The VDJ 1500 is not limited to a movement joint between only the wall structures disclosed. The VDJ 1500 may provide a fire-rated movement joint between a stud framed wall on which the VDJ 1500 is fastened and another vertical building component such as another wall panel, a mullion for a window, wall cladding, a structural beam or column, a concrete slab, a masonry wall, etc.

FIG. 57 is a cross-sectional top view of a wall-to-wall movement joint in which the VDJ 1500 is installed within a wall assembly 1560 comprised of a static panel 1562 and a movement panel 1564. The VDJ 1500 is installed with a vertical gap 1550 between adjoining wall panels 1552 of the static and movement panels 1562, 1564. In the illustrated embodiment, the static panel 1562 is a fixed structure while the movement panel 1564 is configured to move laterally relative to the static panel 1562 (as shown by the arrows in FIG. 57) and vertically (i.e., into and out of the page as shown by concentric circles in FIG. 57). The adjoining wall panels 1552 may comprise wallboard 1566 (e.g., fire rated gypsum drywall) or the like. The VDJ 1500 is fastened to the wallboard 1566 by fasteners 1568 that penetrate through the wallboard 1566 and into the metal stud 1558. The VDJ 1500 may be fastened to either the static panel 1562 or the movement panel 1564. In some configurations, a VDJ 1500 may be fastened to both the static panel 1562 and the movement panel 1564 if additional flexibility is required. The fasteners 1568 may comprise a drywall screw, staples, or the like. In some embodiments, the second leg 1508 may include fastener holes 1538 through which the fasteners 1568 may be inserted and used to attach the angle 1502 to the wall panel 1552. The fastener holes may be positioned in intervals along the length of the leg 1508.

As shown in FIG. 57, the VDJ 1500 is fastened to the wallboard 1566 such that the first leg 1506 is installed between the adjoining wall panels 1552 and the second leg 1508 is installed over the corner of the adjoining wall panel 1552. The angle 1502 is also used as a drywall corner bead that can be finished into the wall with joint compound. The second leg 1508 is exposed prior to the joint compound being applied. In some configurations, the second leg 1508 can be omitted if fastening attachment is not required. In other configurations, at least one intumescent strip 1510 can be applied directly to the adjoining drywall panels 1552 in order to negate the angle 1502 altogether.

In some configurations, the second leg 1508 may include a visual identifier such that a building inspector may visually recognize via the identifier that the wall-to-wall joint has the fire-rated Vertical Drift Joint installed therein. For example, the second leg 1508 may have inkjet markings, stickers and/or be formed from a particular color such that it may be visually identified. For example, the color of the PVC/Vinyl can be tinted to allow the Vertical Drift Joint to be recognized as a fire rated product and/or used to identify the proper fire rated accessory.

The intumescent strips 1510 are sandwiched, pinched or compressed between the adjoining wall panels 1552 which provides a fire-rated seal and prevents smoke, fire and sound from passing through the vertical gap 1550. The intumescent strips 1510 are compressible and resilient. In some configurations, movement of the movement panel 1562 may cause the intumescent strips 1510 to deform slightly while maintaining contact with the adjoining wall panels 1552. The intumescent strip 1510 adjacent the adjoining wall panel 1552 of the movement panel 1564 may slide against the adjoining wall panel 1552 when the movement panel 1564 moves vertically and laterally relative to the static panel 1562. The intumescent strip 1510 may be sized, shaped, positioned, formulated, etc. to provide sufficient shear strength such that the fire-rated seal provided by the intumescent strips 1510 is maintained throughout the range of vertical and lateral movement of the movement panel 1564. In some configurations, a friction reducing agent or device may be applied or provided to the fire seal 1504 and/or the adjoining wall panels 1552 such that the contact friction between intumescent strip 1510 and the adjoining wall panels 1552 is reduced. The reduction of friction between the fire seal 1504 and the adjoining wall panels 1552 may inhibit or prevent degradation of the fire seal 1504 due to rubbing against the adjoining wall panels 1552.

FIG. 58 is a cross-sectional top view of a window-to-wall movement joint in which the VDJ 1500 is installed within a wall assembly 1570 comprised of an internal wall panel 1572 and a window panel 1574. Both the internal wall panel 1572 and the window panel 1574 may move, at least, laterally and vertically relative to each other. The window panel 1574 may comprise a frame 1576 (e.g., formed from aluminum) that is wrapped with fire rated gypsum drywall to maintain the fire rating of the frame 1576. The internal wall panel 1572 comprises a metal stud framed wall that is wrapped in wallboard 1566. The VDJ 1500 is installed over the corner of the wallboard 1566 on the internal wall panel 1572 such that the first flange 1506 is positioned within the vertical gap 1550 between the adjoining wall panels 1552. A drywall screw 1568 is used to attach the VDJ 1500 to the metal stud 1558 of the internal wall panel 1572. The VDJ 1500 provides a movement joint that allows the internal wall panel 1572 and the window panel 1574 to move relative to each other while providing a fire-rated seal between the adjoining wall panels 1552.

FIG. 59 is a cross-sectional top view of a wall-to-wall movement joint in which the VDJ 1500 is installed within a wall assembly 1580 comprised of an internal wall panel 1582 and an external wall panel 1584. Both the internal wall panel 1582 and the external wall panel 1584 may move, at least, laterally and vertically relative to each other. The interior and external wall panels 1582, 1584 comprise a metal stud framed wall that is wrapped in wallboard 1566. The VDJ 1500 is installed over the corner of the wallboard 1566 on the internal wall panel 1582 such that the first flange 1506 is positioned within the vertical gap 1550 between the adjoining wall panels 1552. A drywall screw 1568 is used to attach the VDJ 1500 to the metal stud 1558 of the internal wall panel 1572. The VDJ 1500 provides a movement joint that allows the internal wall panel 1582 and the external wall panel 1584 to move relative to each other while providing a fire-rated seal between the adjoining drywall panels 1552.

Figure 60:
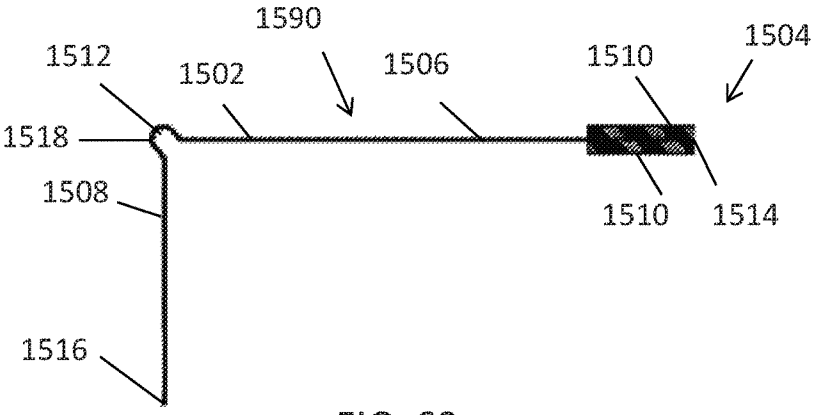
FIG. 60 is a cross-sectional top view of an alternative fire-rated vertical drift joint, which incorporates a corner bead.
Figure 61:
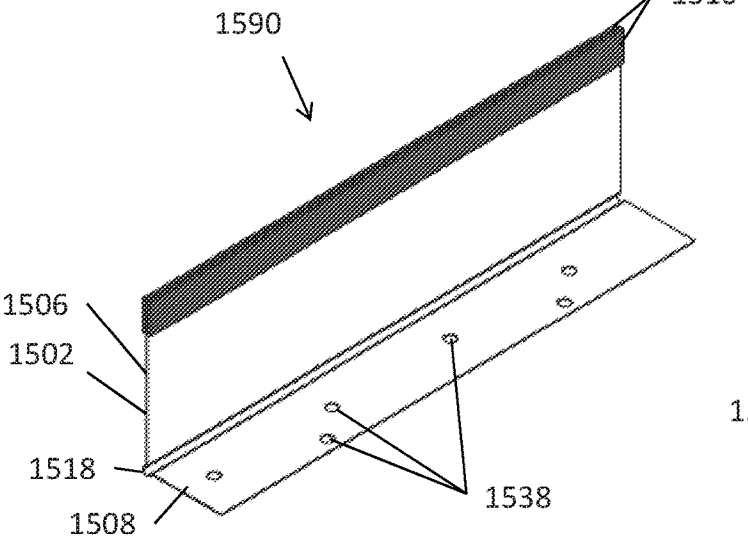
FIG. 61 is a perspective view of the fire-rated vertical drift joint of FIG. 60.

FIGS. 60 and 61 illustrate an alternative exemplary VDJ 1590 comprising an elongate angle 1502 with a drywall corner bead 1518 disposed at the bend 1512 between the first and second legs 1506, 1508. When the VDJ 1590 is installed onto a wall panel (for example, wall panel 1562 in FIG. 57), the corner bead 1518 is positioned over the corner of the wallboard 1566 which covers the vertical wall gap 1550. The corner bead 1518 may be finished into the wall panel with joint compound.

The corner bead 1518 covers the vertical wall gap 1550 to provide an aesthetically pleasing appearance without the need to install additional trim pieces to conceal the vertical wall gap 1550. The corner bead 1518 has a circular shape in cross-section and extends at a substantially a 45 degree angle from each of the first and second legs 1506, 1508. The corner bead 1518 is not limited to a circular shape, angle of extension, etc. and may have a shape and geometry to provide the desired wall finish.

Figure 62:
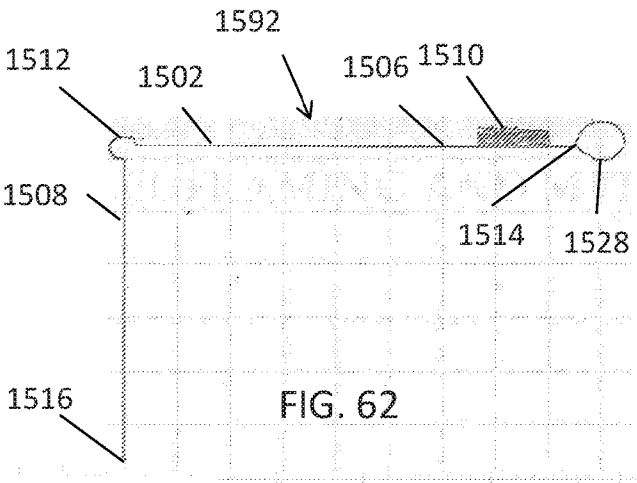
FIG. 62 is a cross-sectional top view of another alternative fire-rated vertical drift joint, which incorporates a corner bead and a compressible gasket.
Figure 63:
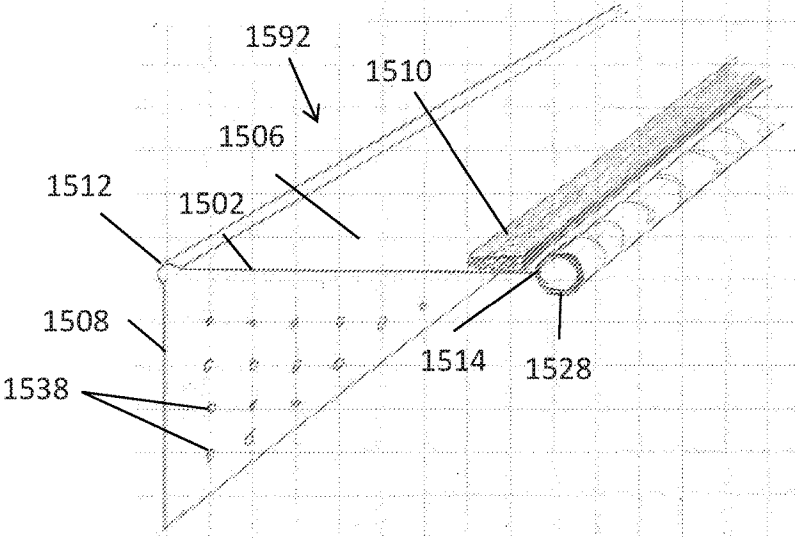
FIG. 63 is an isometric view of the fire-rated vertical drift joint of FIG. 62.

FIGS. 62 and 63 illustrate an alternative exemplary VDJ 1592 comprising an elongate angle 1502 with a compressible gasket 1594 positioned at a tip of the free end 1514 or an end portion of the first leg 1506. An intumescent strip 1510 is also positioned on the first leg 1506 between the compressible gasket 1594 and the bend 1512. The intumescent strip 1510 is positioned on a surface of the first leg 1506 that faces away from the second leg 1508 and is spaced a distance from the compressible gasket 1594. The compressible gasket 1594 straddles the free end 1514 of the first leg 1506 such that the compressible gasket 1594 extends substantially an equal distance away from the planar surfaces of the first leg 1506. In some configurations, the compressible gasket 1594 may have a cross-sectional radius that is substantially equal to the thickness of the intumescent strip 1510 (e.g., 1.5 mm). In other configurations, the compressible gasket 1594 may have a cross-sectional radius that is greater than the thickness of the intumescent strip 1510, for example, between 2 mm to 5 mm.

The compressible gasket 1594 provides an additional sealing member in addition to the intumescent strip 1510. In some configurations, the compressible gasket 1594 may act as a bump stop to limit the amount of narrowing of the vertical wall gap 1550. That is, the compressible gasket 1594 may limit the amount of compression by the intumescent strip 1510. In some configurations, the compressible gasket 1594 may reduce friction between the VDJ 1592 and the adjoining wall panel 1552. Limiting the amount of compression of the intumescent strip 1510 may protect and extend the lifespan of the intumescent strip 1510. In other configurations, the compressible gasket 1594 may function as the fire seal during ambient conditions, while the intumescent strip 1510 expands and functions as the fire seal in a fire.

The compressible gasket 1594 is illustrated as being circular in cross-section. However, the gasket 1594 is not limited to any particular cross-sectional shape and may include curved, flat, and polygonal shapes or any combination thereof. The gasket 322 may be formed from a compressible material such as rubber, foam, plastic, vinyl, etc. In some configurations, the gasket 1594 is formed from a fire-resistant compressible material such as strip of Denver Foam®. The gasket 1594 may be formed by molding the gasket directly onto the angle 1502. Alternatively, the gasket 1594 may be attached to the angle 1502 by an adhesive or mechanical fastener. In addition, the gasket 1594 is illustrated as having a tubular shape with a hollow center. However, in some configurations, the gasket 1594 may have a solid center while maintaining elasticity and compressibility. In some configurations, one or more gaskets 1594 may be disposed at multiple positions along the length of the angle 1502. For example, a second gasket may be positioned between the bend 1512 and the free end 1514 of the first leg 1506.

In some configurations, the fire seal 1504 may incorporate a fire-resistant ribbed protrusion that extends along the length of the first leg 1506. The ribbed protrusion may be positioned between the bend 1512 and the free end 1514. The ribbed protrusion may be sandwiched between and provide a fire rated seal between the adjoining wall panels 1552. The ribbed protrusion may be formed from a compressible material such as rubber, foam, plastic, vinyl, etc. This ribbed protrusion may be able to take the place of fire retardant material.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present angle piece and assemblies have been described in the context of particularly preferred embodiments, the skilled artisan will appreciate, in view of the present disclosure, that certain advantages, features and aspects of the angle piece and assemblies may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. For example, the specific locations of the intumescent strips can be utilized with the variety of different embodiments of the angle pieces disclosed herein in addition to those embodiments specifically illustrated. Thus, it is intended that the scope of the present invention herein disclosed should not be limited by the particular disclosed embodiments described above, but should be determined only by a fair reading of the claims.

What is claimed is:

1. A fire-rated assembly for sealing a linear wall gap along an overhead structure, the fire-rated assembly comprising:

a bottom track comprising a web, a first flange and a second flange, the first and second flanges extending in an upward direction from opposing side edges of the web, the bottom track defining an interior space between the web and the inwardly-facing surfaces of the first and second flanges;

a plurality of studs that are spaced from one another along the bottom track, each of the plurality of studs having a bottom end received within the interior space of the bottom track, each of the plurality of studs extending in a generally vertical direction from the bottom track;

a top track attached to the overhead structure, the top track comprising a web, a first flange and a second flange, the first and second flanges extending in a downward direction from opposing side edges of the web, the top track defining an interior space between the web and the inwardly-facing surfaces of the first and second flanges, wherein upper ends of each of the plurality of studs are received within the interior space of the top track;

an angle piece comprising a first flange and a second flange, the second flange oriented at an angle relative to the first flange, the first flange and the second flange being connected to one another along an edge thereby defining a corner, the first flange extending in a direction parallel with the overhead structure; the first and second flanges being formed from a non-metal material;

a heat-expandable intumescent strip attached to at least one of the first and second flanges of the angle piece, the heat-expandable intumescent strip having an activation temperature that is lower than a melting temperature of the non-metal material; and a gasket attached to the first flange of the angle piece, wherein the gasket contacts the overhead structure to seal the linear wall gap.

2. The fire-rated assembly of claim 1, further comprising a plurality of heat-expandable intumescent strips attached to at least one of the first and second flanges of the angle piece.

3. The fire-rated assembly of claim 1, wherein the non-metal material is comprised of polyvinyl chloride (PVC).

4. The fire-rated assembly of claim 1, wherein the non-metal material has a melting temperature of at least 400 degrees Fahrenheit.

5. The fire-rated assembly of claim 1, wherein a length of the first flange is shorter than a length of the second flange.

6. The fire-rated assembly of claim 1, wherein the gasket and the angle piece are formed by a co-extrusion process.

7. The fire-rated assembly of claim 1, wherein the gasket is attached to both the first and second flanges of the angle piece.

8. The fire-rated assembly of claim 1, further comprising at least one wallboard member extending in the generally vertical direction and coupled to at least one of the plurality of studs, wherein the second flange of the angle piece contacts the wallboard.

9. A fire-rated wall joint product for sealing a linear wall gap along an overhead structure, the fire-rated wall joint product comprising:

an angle piece comprising a first flange and a second flange, the second flange oriented at an angle relative to the first flange, the first flange and the second flange being connected to one another along an edge thereby defining a corner, the first flange extending in a direction parallel with the overhead structure; the first and second flanges being formed from a non-metal material;

a heat-expandable intumescent strip attached to at least one of the first and second flanges of the angle piece, the heat-expandable intumescent strip having an activation temperature that is lower than a melting temperature of the non-metal material; and a gasket attached to the first flange of the angle piece.

10. The fire-rated wall joint product of claim 9, further comprising a plurality of heat-expandable intumescent strips attached to at least one of the first and second flanges of the angle piece.

11. The fire-rated wall joint product of claim 9, wherein the non-metal material is comprised of polyvinyl chloride (PVC).

12. The fire-rated assembly of claim 9, wherein a length of the first flange is shorter than a length of the second flange.

13. The fire-rated assembly of claim 9, wherein the gasket is hollow.

14. The fire-rated assembly of claim 9, wherein the gasket is compressible.

15. The fire-rated assembly of claim 9, wherein the gasket has a circular cross-sectional shape.

16. The fire-rated assembly of claim 9, wherein the gasket has a flat cross-sectional shape.

17. The fire-rated assembly of claim 9, wherein the gasket comprises a rounded shape along a portion of the gasket that contacts the overhead structure.

18. The fire-rated assembly of claim 9, wherein the gasket is attached to both the first and second flanges of the angle piece.

19. The fire-rated assembly of claim 9, wherein the gasket is formed from a fire-resistant material.

20. The fire-rated assembly of claim 9, wherein the gasket and the angle piece are formed by a co-extrusion process.

* * * * *